US009191738B2

(12) United States Patent
Niwa et al.

(10) Patent No.: US 9,191,738 B2
(45) Date of Patent: Nov. 17, 2015

(54) SOUND ENHANCEMENT METHOD, DEVICE, PROGRAM AND RECORDING MEDIUM

(75) Inventors: Kenta Niwa, Tokyo (JP); Sumitaka Sakauchi, Tokyo (JP); Kenichi Furuya, Tokyo (JP); Yoichi Haneda, Tokyo (JP)

(73) Assignee: NIPPON TELGRAPH AND TELEPHONE CORPORATION, Tokyo (JP)

( * ) Notice: Subject to any disclaimer, the term of this patent is extended or adjusted under 35 U.S.C. 154(b) by 236 days.

(21) Appl. No.: 13/996,302

(22) PCT Filed: Dec. 19, 2011

(86) PCT No.: PCT/JP2011/079978

§ 371 (c)(1),
(2), (4) Date: Jun. 20, 2013

(87) PCT Pub. No.: WO2012/086834

PCT Pub. Date: Jun. 28, 2012

(65) Prior Publication Data

US 2013/0287225 A1 Oct. 31, 2013

(30) Foreign Application Priority Data

| | | |
|---|---|---|
| Dec. 21, 2010 | (JP) | 2010-285175 |
| Dec. 21, 2010 | (JP) | 2010-285181 |
| Feb. 9, 2011 | (JP) | 2011-025784 |
| Sep. 1, 2011 | (JP) | 2011-190768 |
| Sep. 1, 2011 | (JP) | 2011-190807 |

(51) Int. Cl.

| | |
|---|---|
| ***H04R 3/00*** | (2006.01) |
| ***G10L 21/0232*** | (2013.01) |
| *G10L 21/0208* | (2013.01) |
| *G10L 21/0216* | (2013.01) |

(52) U.S. Cl.

CPC ..... *H04R 3/00* (2013.01); *G10L 21/0232* (2013.01); *H04R 3/005* (2013.01); *G10L 2021/02082* (2013.01); *G10L 2021/02166* (2013.01); *H04R 2430/03* (2013.01)

(58) Field of Classification Search

None

See application file for complete search history.

(56) References Cited

U.S. PATENT DOCUMENTS 6,473,733 B1 * 10/2002 McArthur et al. ..... 704/224
6,738,481 B2 * 5/2004 Krasny et al. ..... 381/92

(Continued)

OTHER PUBLICATIONS

Frost, O. L., "An Algorithm for Linearly Constrained Adaptive Array Processing", IEEE, vol. 60, No. 8, pp. 926-935, (Aug. 1972).

(Continued)

*Primary Examiner* — Thang Tran

(74) *Attorney, Agent, or Firm* — Oblon, McClelland, Maier & Neustadt, L.L.P.

(57) ABSTRACT

A sound enhancement technique that uses transfer functions $a_{i,g}$ of sounds that come from each of one or more positions/directions that are assumed to be sound sources arriving at each microphone to obtain a filter for a position that is a target of sound enhancement, where i denotes a direction and g denotes a distance for identifying each of the positions. Each of the transfer functions $a_{i,g}$ is represented by sum of a transmission characteristic of a direct sound that directly arrives from the position determined by the direction i and the distance g and a transmission characteristic of one or more reflected sounds produced by reflection of the direct sound off an reflective object. A filter that corresponds to the position that is the target of sound enhancement is applied to frequency-domain signals transformed from M picked-up sounds picked up with M microphones to obtain a frequency-domain output signal.

28 Claims, 29 Drawing Sheets

(56) References Cited

U.S. PATENT DOCUMENTS

| | | | | |
|---|---|---|---|---|
| 6,868,365 | B2 * | 3/2005 | Balan et al. | 702/180 |
| 6,947,570 | B2 * | 9/2005 | Maisano | 381/313 |
| 8,363,846 | B1 * | 1/2013 | Li et al. | 381/92 |
| 2003/0028372 | A1 * | 2/2003 | McArthur et al. | 704/220 |
| 2003/0063759 | A1 * | 4/2003 | Brennan et al. | 381/92 |
| 2003/0108214 | A1 * | 6/2003 | Brennan et al. | 381/94.7 |
| 2005/0265563 | A1 * | 12/2005 | Maisano | 381/92 |
| 2007/0165879 | A1 * | 7/2007 | Deng et al. | 381/92 |
| 2008/0112574 | A1 * | 5/2008 | Brennan et al. | 381/92 |
| 2009/0055170 | A1 * | 2/2009 | Nagahama | 381/92 |
| 2010/0119079 | A1 * | 5/2010 | Kim et al. | 381/94.1 |

OTHER PUBLICATIONS

Flanagan, J. L., et al., "Spatially selective sound capture for speech and audio processing", Speech Communication, vol. 13, pp. 207-222, (Oct. 1993).

Nomura, H., et al., "Microphone array for near sound field", The Journal of the Acoustical Society of Japan, vol. 53, No. 2, pp. 110-116, (1997).

Hioka, Y., et al., "Enhancement of Sound Sources Located within a Particular Area Using a Pair of Small Microphone Arrays", IEICE Transcations on Fundamentals, vol. E91-A, No. 2, pp. 561-574, (Feb. 2008).

Hioka, Y., et al., "A method of separating sound sources located at different distances based on direct-to-reverberation ratio", Proceedings of Autumn Meeting of the Acoustical Society of Japan, pp. 633-634, (Sep. 2009).

Haykin, S., "Adaptive Filter Theory", Kagaku Gijutsu Shuppann, pp. 66-73 and 248-255, (2001).

Kikuma, N., "Adaptive Antenna Technology", OHMSHA, pp. 35-90, (2003).

Asano, F., "Array signal processing-sound source localization/tracking and separation", Corona Publishing, pp. 88-89 and 259-261, (2011).

Kaneda, Y., "Directivity characteristics of adaptive microphone-array for noise reduction (AMNOR)", The Journal of the Acoustical Society of Japan, vol. 44, No. 1, pp. 23-30, (1988).

International Search Report Issued Feb. 7, 2012 in PCT/JP11/079978 Filed Dec. 19, 2011.

European Patent Office Action issued Jun. 30, 2015, in Patent Application No. 11 852 100.4.

Blind Source Separation in Reflective Sound Fields, Asano et al.,Electrotechnical Laboratory, Prest, JST, Tsukuba University, Japan, International Workshop on Hands-Free Speech Communication (HSC2001), Kyoto, Japan, Apr. 9-11, 2001.

* cited by examiner

RELATED ART

RELATED ART

CONVENTIONAL METHOD 1 -------MVDR METHOD (WITHOUT REFLECTOR)

CONVENTIONAL METHOD 2 ..... DELAY-AND-SUM BEAMFORMING METHOD (WITH REFLECTOR)

FIRST EMBODIMENT ——— MVDR METHOD (WITH REFLECTOR)

CONVENTIONAL METHOD 1 -------MVDR METHOD (WITHOUT REFLECTOR)

CONVENTIONAL METHOD 2 ..... DELAY-AND-SUM BEAMFORMING METHOD (WITH REFLECTOR)

FIRST EMBODIMENT ——— MVDR METHOD (WITH REFLECTOR)

SOUND ENHANCEMENT METHOD, DEVICE, PROGRAM AND RECORDING MEDIUM

TECHNICAL FIELD

The present invention relates to a technique capable of enhancing sounds in a desired narrow range (sound enhancement technique).

BACKGROUND ART

When a movie shooting device (video camera or camcorder), for example, equipped with a microphone is zoomed in on a subject to shoot the subject, it is preferable for video recording that only sounds from around the subject should be enhanced in synchronization with the zoom-in shooting. Techniques (sharp directive sound enhancement techniques) to enhance sounds in a narrow range including a desired direction (a target direction) have been studied and developed. The sensitivity of a microphone pertinent to directions around the microphone is called directivity. When the directivity in a particular direction is sharp, sounds arriving from a narrow range including the particular direction are enhanced and sounds outside the range are suppressed. Three conventional techniques relating to the sharp directive sound enhancement technique will be described here first. The term "sound(s)" as used herein is not limited to human voice but refers to "sound(s)" in general such as music and ambient noise as well as calls of animals and human voice.

[1] Sharp Directive Sound Enhancement Technique Using Physical Properties

Typical examples of this category include shotgun microphones and parabolic microphones. The principle of an acoustic tube microphone 900 will be described first with reference to FIG. 1. The acoustic tube microphone 900 uses sound interference to enhance sounds arriving from a target direction. FIG. 1A illustrates enhancement of sounds arriving from a target direction by the acoustic tube microphone 900. The opening of the acoustic tube 901 of the acoustic tube microphone 900 is pointed at the target direction. Sounds arriving from the front (the target direction) of the opening of the acoustic tube 901 straightly travel through inside the acoustic tube 901 and reach a microphone 902 of the acoustic tube microphone 900 with low energy-loss. On the other hand, sounds arriving from directions other than the target direction enter the tube 901 through many slits 903 provided in the sides of the tube as illustrated in FIG. 1B. The sounds that entered through the slits 903 interfere with one another, which lowers the sound pressure levels of the sounds that came from the directions other than the target direction and reached the microphone 902.

The principle of a parabolic microphone 910 will be described next with reference to FIG. 2. The parabolic microphone 910 uses reflection of sounds to enhance the sounds arriving from a target direction. FIG. 2A is a diagram illustrating enhancement of sounds arriving from the target direction by the parabolic microphone 910. A parabolic reflector (paraboloidal surface) 911 of the parabolic microphone 910 is pointed at the target direction so that the line that links between the vertex of the parabolic reflector 911 and the focal point of the parabolic reflector 911 coincides with the target direction. Sounds arriving from the target direction are reflected by the parabolic reflector 911 and are focused on the focal point. Accordingly, a microphone 912 placed at the focal point can enhance and pick up sound signals even with low energy. On the other hand, sounds arriving from the directions other than the target direction and reflected by the parabolic reflector 911 are not focused on the focal point, as illustrated in FIG. 2B. Accordingly, the sound pressure levels of the sounds that came from the direction other than the target direction and arrived at the microphone 912 are lowered.

[2] Sharp Directive Sound Enhancement Technique Using Signal Processing

Typical examples of this category include phased microphone arrays (see non-patent literature 1). FIG. 3 is a diagram illustrating that a phased microphone array including multiple microphones is used to enhance sounds from a target direction and suppress sounds from the other directions other than the target direction. The phased microphone array performs signal processing to apply a filter including information about differences of phase and/or amplitude between the microphones to signals picked up with the microphones and superimposes the resultant signals to enhance sounds from the target direction. Unlike the acoustic tube microphone and the parabolic microphone described in category [1], the phased microphone array can enhance sounds arriving from any directions because it enhances sounds by the signal processing.

[3] Sharp Directive Sound Enhancement Technique by Selective Pickup of Reflected Sounds Typical examples of this category include multi-beam forming (see non-patent literature 2). The multi-beam forming is a sharp directive sound enhancement technique that collects individual sounds, including direct sounds and reflected sounds, together to pick up sounds arriving from a target direction with a high signal-to-noise ratio and has been studied more intensively in the field of wireless rather than acoustics.

Processing of the multi-beam forming in a frequency domain will be described below. Symbols will be defined prior to the description. The index of a frequency is denoted by a and the index of a frame-time number is denoted by k. Frequency domain representations of analog signals received at M microphones are denoted by $\vec{X}(\omega, k)=[X_1(\omega, k), \ldots, X_M(\omega, k)]^T$, the direction from which a direct sound from a sound source located in a direction $\theta_s$ to be enhanced is denoted by $\theta_{s1}$, the directions from which reflected sounds arrive is denoted by $\theta_{s2}, \ldots, \theta_{sR}$. Here, T represents transpose and R−1 is the total number of reflected sounds. A filter that enhances a sound from a direction $\theta_{sr}$ is denoted by $\vec{W}(\omega, \theta_{sr})$. Here, r is an integer that satisfies $1 \le r \le R$.

A precondition for the multi-beam forming is that the directions from which direct and reflected sounds arrive and their arrival times are known. That is, the number of objects, such as walls, floors, reflectors, that are obviously expected to reflect sounds is equal to R−1. The number of reflected sounds, R−1, is often set at a relatively small value such as 3 or 4. This is based on the fact that there is a high correlation between a direct sound and a low-order reflected sound. Since the multi-beam forming enhances individually sounds and synchronously adds the enhanced signals, an output signal $Y(\omega, k, \theta_s)$ can be given by equation (1). Here, H represents Hermitian transpose.

$$Y(\omega, k, \theta_s) = \sum_{r=1}^{R} \vec{W}^H(\omega, \theta_{sr})\vec{X}(\omega, k) \tag{1}$$

Delay-and-sum beam forming will be described as a method for designing a filter $\vec{W}(\omega, \theta_{sr})$. Assuming that direct and reflected sounds arrive as plane waves, then filter $\vec{W}(\omega, \theta_{sr})$ can be given by equation (2).

$$\vec{W}(\omega, \theta_{sr}) = \frac{\vec{h}(\omega, \theta_{sr})}{\vec{h}^H(\omega, \theta_{sr})\vec{h}(\omega, \theta_{sr})} \tag{2}$$

where, $\vec{h}(\omega, \theta_{sr})=[h_1(\omega, \theta_{sr}), \ldots, h_M(\omega, \theta_{sr})]^T$ is a propagation vector of a sound arriving from a direction $\theta_{sr}$.

Assuming that plane waves arrive at a linear microphone array (a microphone array in which M microphones are linearly arranged), then the elements $h_m(\omega, \theta_{sr})$ that make up $\vec{h}(\omega, \theta_{sr})$ can be given by equation (3).

$$h_m(\omega, \theta_{sr}) = \exp\left[-\frac{j\omega u}{c}\left(m - \frac{M+1}{2}\right)\cos\theta_{sr}\right] \cdot \exp[-j\omega\tau(\theta_{sr})] \tag{3}$$

where m is an integer that satisfies $1 \le m \le M$, c is the speed of sound, u represents the distance between adjacent microphones, j is an imaginary unit, and $\tau(\theta_{sr})$ represents a time delay between a direct sound and a reflected sound arriving from the direction $\theta_{sr}$.

Lastly, an output signal $Y(\omega, k, \theta_s)$ is transformed to a time domain to obtain a signal in which a sound from the sound source located in the target direction $\theta_s$ is enhanced.

FIG. 4 illustrates a functional configuration of the sharp directive sound enhancement technique using the multi-beam forming.

Step 1

An AD converter 110 converts analog signals output from M microphones 100-1, . . . , 100-M to digital signals $\vec{x}(t)=[x_1(t), \ldots, x_M(t)]^T$. Here, t represents the index of a discrete time.

Step 2

A frequency-domain transform section 120 transforms the digital signal of each channel to a frequency-domain signal by a method such as fast discrete Fourier transform. For example, for the m-th ($1 \le m \le M$) microphone, signals $x_m((k-1)N+1), \ldots, x_m(kN)$ at N sampling points are stored in a buffer. Here, N is approximately 512 in the case of sampling at 16 KHz. Fast discrete Fourier transform of the analog signals of M channels stored in the buffer is performed to obtain frequency-domain signals $\vec{X}(\omega, k)=[X_1(\omega, k), \ldots, X_M(\omega, k)]^T$.

Step 3

Each of enhancement filtering sections 130-r ($1 \le r \le R$) applies a filter $\vec{W}H(\omega, \theta_{sr})$ for a direction $\theta_{sr}$ to the frequency-domain signals $\vec{X}(\omega, k)=[X_1(\omega, k), \ldots, X_M(\omega, k)]^T$ and outputs a signal $Z_r(\omega, k)$ in which a sound from the direction $\theta_{sr}$ is enhanced. That is, each enhancement filtering section 130-*r* ($1 \le r \le R$) performs processing given by equation (4):

$$Z_r(\omega, k)=\vec{W}^H(\omega, \theta_{sr})\vec{X}(\omega,k) \tag{4}$$

An adder 140 takes inputs of the signals $Z_1(\omega, k), \ldots, Z_R(\omega, k)$ and outputs a sum signal $Y(\omega, k)$. The addition can be given by equation (5):

$$Y(\omega, k) = \sum_{r=1}^{R} Z_r(\omega, k) \tag{5}$$

Step 5

A time-domain transform section 150 transforms the sum signal $Y(\omega, k)$ to a time domain and outputs a time-domain signal y(t) in which the sound from the direction $\theta_s$ is enhanced.

In some situations, for example in a situation where there are multiple sound sources in about the same direction at different distances from a microphone, it may be desired that sounds arriving from the sound sources be selectively enhanced by the sharp directive sound enhancement technique. Consider a situation where a movie shooting device equipped with microphone is zoomed in on a subject to shoot the subject as in the example described earlier. If there is a sound source (referred to as the "rear sound source) in the rear of the focused subject (referred to as the "focused sound source") in the range of the directivity of the microphone, a sound from the focused sound source and a sound from the rear sound source are mixed and enhanced, giving viewers an unnatural listening experience. Therefore, a technique capable of enhancing sounds in a narrow range including a desired direction according to distances from a microphone (a sound spot enhancement technique) is desired. Three conventional techniques relating to the sound spot enhancement technique will be described by way of illustration.

(1) The technique disclosed in non-patent literature 3 is an optimum design method for a delay-and-sum array in a near sound field where sound waves are spherical. The array is designed so that the SN ratio between a target signal from a sound source position and unwanted sounds (background noise and reverberation) is maximized.

(2) The technique disclosed in non-patent literature 4 requires two small microphone arrays and enables spot sound pickup according to distances without needing a large microphone array.

(3) The technique disclosed in non-patent literature 5 distinguish between distances to a sound source with a single microphone array and enhances or suppress sounds from only the sound source in a particular distance range, thereby eliminating interference noise. This technique takes advantage of the fact that the power of a sound arriving directly from a sound source and the power of an incoming reflected sound vary according to distances to enhance sounds according to distances from the sound sources.

CITATION LIST

Non-Patent Literature

Non-patent literature 1: O. L. Frost, "An algorithm for linearly constrained adaptive array processing," Proc. IEEE, vol. 60, pp. 926-935, 1972.

Non-patent literature 2: J. L. Flanagan, A. C. Surendran, E. E. Jan, "Spatially selective sound capture for speech and audio processing," Speech Communication, Volume 13, Issue 1-2, pp. 207-222, October 1993.

Non-patent literature 3: Hiroaki Nomura, Yutaka Kaneda, Junji Kojima, "Microphone array for near sound field," The Journal of the Acoustical Society of Japan, Vol. 53, No. 2, pp. 110-116, 1997.

Non-patent literature 4: Yusuke Hioka, Kazunori Kobayashi, Kenichi Furuya and Akitoshi Kataoka, "Enhancement of Sound Sources Located within a Particular Area Using a Pair of Small Microphone arrays," IEICE Transactions on Fundamentals, Vol. E91-A, No. 2, pp. 561-574, August 2004.

Non-patent literature 5: Yusuke Hioka, Kenta Niwa, Sumitaka Sakauchi, Ken'ichi Furuta and Yoichi Haneda, "A method of separating sound sources located at different distances based on direct-to-reverberation ratio," Proceedings of Autumn Meeting of the Acoustical Society of Japan, pp. 633-634, September 2009.

SUMMARY OF THE INVENTION

Problems to be Solved by the Invention

According to the sharp directive sound enhancement technique described in category [1], a sound arriving from a target direction cannot be enhanced unless the microphone itself is pointed to the target direction, as can be seen from the examples of the acoustic tube microphones and the parabolic microphones. That is, when the target direction can vary, driving and control means for changing the orientation of the acoustic tube microphone or the parabolic microphone itself is needed unless a human physical action is used. Furthermore, while the parabolic microphone excels in high-SN ratio sound pickup because the parabolic microphone can focus the energy of sounds reflected by the parabolic reflector on the focal point, it is difficult for the parabolic microphone as well as the acoustic tube microphone to achieve a high directivity, for example a visual angle of approximately 5° to 10° (a sharp directivity of an angle of approximately ±5° to ±10° with respect to a target direction).

According to the sharp directive sound enhancement technique described in category [2], in order to achieve a higher directivity, more microphones and a larger array size (a larger full length of array) are required. It is not realistic to increase the array size unlimitedly, because of a restricted space where the phased microphone array is placed, costs, and the number of microphones capable of performing real-time processing. For example, microphones available on the market are capable of real-time processing of up to approximately 100 signals. The directivity that can be achieved with a phased microphone array with about 100 microphones is approximately ±30° with respect to a target direction and therefore it is difficult for a phased microphone array to enhance a sound from a target direction with a sharp directivity of approximately ±5° to ±10°, for example. Furthermore, it is difficult for the conventional technique in category [2] to pick up a sound from a target direction with a high SN ratio so that the sound is not buried in sounds from other directions than the target direction.

According to the sharp directive sound enhancement technique described in category [3], while a sound from a target direction can be picked up with a high SN ratio so that the sound is not buried in sounds from directions other than the target direction and sounds from any directions can be enhanced without needing the driving and control means mentioned above, it is difficult for the technique to achieve a high directivity. In particular, human voice includes a high proportion of frequency components in a range from approximately 100 Hz to approximately 2 kHz. However, it is difficult for the conventional technique in category [3] to achieve a sharp directivity of approximately ±5° to ±10° in a target direction in such a low frequency band.

The sound spot enhancement technique described in (1) does not take any measures for protecting against interference sources because the technique uses the delay-and-sum array method. The sound spot enhancement technique described in (2) requires a plurality of microphone arrays and therefore can be disadvantageous because of the increased size of and cost of the system. The increased size of the microphone arrays restricts the installation and conveyance of the arrays. Information concerning reverberation varies with environmental changes and it is difficult for the sound spot enhancement technique described in (3) to robustly respond to such environmental changes.

In light of these circumstances, a first object of the present invention is to provide a sound enhancement technique (a sound spot enhancement technique) that can pick up a sound with a sufficiently high SN ratio and follow a sound from any direction without needing physically moving a microphone, and yet has a sharper directivity in a desired direction than the conventional techniques and can enhance sounds according to the distances from the microphone array. A second object of the present invention is to provide a sound enhancement technique (a sharp directive sound enhancement technique) that can pick up a sound with a sufficiently high SN ratio, can follow a sound from any direction without needing physically moving a microphone, and yet has a sharper directivity in a desired direction than the conventional techniques.

Means to Solve the Problems (Sound Spot Enhancement Technique)

A transmission characteristic $a_{i,g}$ of a sound that comes from each of one or more positions that are assumed to be sound sources (where i denotes the direction and g denotes the distance for identifying each position) and arrives at microphones (the number of microphones M≥2) is used to obtain a filter for a position that is a target of sound enhancement [a filter design process]. Each transmission characteristic $a_{i,g}$ is represented by the sum of transfer functions of a direct sound that comes from a position determined by a direction i and a distance g and directly arrives at the M microphones and transfer functions of one or more reflected sounds that is produced by reflection of the direct sound off an reflective object and arrives at the M microphones. The filter is designed to be applied, for each frequency, to a frequency-domain signal transformed from each of M picked-up signals obtained by picking up sounds with the M microphones. The filter obtained as a result of the filter design process is applied to a frequency-domain signal for each frequency to obtain an output signal [a filter application process]. The output signal is a frequency-domain signal in which the sound from the position that is the target of sound enhancement is enhanced.

Each transmission characteristic $a_{i,g}$ may be, for example, the sum of a steering vector of a direct sound and a steering vector(s) of one or more reflected sounds whose decays due to reflection and arrival time differences from the direct sound have been corrected or may be obtained by measurements in a real environment.

In the filter design process, a filter may be obtained for each frequency such that the power of sounds from positions other than the position that is the target of sound enhancement is minimized. Alternatively, a filter may be obtained for each frequency such that the SN ratio of a sound from the position that is the target of sound enhancement is maximized. Alternatively, a filter may be obtained for each frequency such that the power of sounds from positions other than one or more positions that are assumed to be sound sources is minimized while a filter coefficient for one of the M microphones is maintained at a constant value.

Alternatively, the filter may be obtained for each frequency in the filter design process such that the power of sounds from positions other than the position that is the target of sound enhancement and suppression points is minimized on conditions that (1) the filter passes sounds in all frequency bands from the position that is the target of sound enhancement and that (2) the filter suppresses sounds in all frequency bands from one or more suppression points. Alternatively, the filter may be obtained for each frequency by normalizing a transmission characteristic $a_{s,h}$ of a sound from the position at i=s, g=h that is the target of sound enhancement. Alternatively, a filter may be obtained for each frequency by using a spatial correlation matrix represented by transfer functions $a_{i,g}$ corresponding to positions other than the position that is the target of sound enhancement. Alternatively, the filter may be obtained for each frequency such that the power of sounds from positions other than the position that is the target of sound enhancement is minimized on condition that the filter reduces the amount of decay of a sound from the position that is the target of sound enhancement to a predetermined value or less. Alternatively, a filter may be obtained for each frequency by using a spatial correlation matrix represented by frequency-domain signals obtained by transforming signals obtained by observation with a microphone array. Alternatively, a filter may be obtained for each frequency by using a spatial correlation matrix represented by transfer functions $a_{i,g}$ corresponding to each of one or more positions that are assumed to be sound sources.

(Sharp Directive Sound Enhancement Technique)

A transmission characteristic $a_\theta$ of a sound that comes from each of one or more directions from which sounds assumed to come and arrives at microphones (the number of microphones M≥2) is used to obtain a filter for a position that is a target of sound enhancement [a filter design process]. Each transmission characteristic $a_\theta$ is represented by the sum of transfer functions of a direct sound that comes from a direction θ and directly arrives at the M microphones and transfer functions of one or more reflected sounds that is produced by reflection of the direct sound off an reflective object and arrives at the M microphones. The filter is designed to be applied, for each frequency, to a frequency-domain signal transformed from each of M picked-up signals obtained by picking up sounds with the M microphones. The filter obtained as a result of the filter design process is applied to a frequency-domain signal for each frequency to obtain an output signal [a filter application process]. The output signal is a frequency-domain signal in which the sound from the position that is the target of sound enhancement is enhanced.

Each transmission characteristic $a_\theta$ may be, for example, the sum of a steering vector of a direct sound and a steering vector(s) of one or more reflected sounds whose decays due to reflection and arrival time differences from the direct sound have been corrected or may be obtained by measurements in a real environment.

In the filter design process, a filter may be obtained for each frequency such that the power of sounds from directions other than the direction that is the target of sound enhancement is minimized. Alternatively, a filter may be obtained for each frequency such that the SN ratio of a sound from the direction that is the target of sound enhancement is maximized. Alternatively, a filter may be obtained for each frequency such that the power of sounds from directions from which sounds are likely to arrive is minimized while a filter coefficient for one of the M microphones is maintained at a constant value.

Alternatively, the filter may be obtained for each frequency in the filter design process such that the power of sounds from directions other than the direction that is the target of sound enhancement and null directions is minimized on conditions that (1) the filter passes sounds in all frequency bands from the direction that is the target of sound enhancement and that (2) the filter suppresses sounds in all frequency bands from one or more null directions. Alternatively, the filter may be obtained for each frequency by normalizing a transmission characteristic $a_s$ of a sound from the direction θ=s that is the target of sound enhancement. Alternatively, a filter may be obtained for each frequency by using a spatial correlation matrix represented by transfer functions $a_\phi$ corresponding to directions other than the direction that is the target of sound enhancement. Alternatively, the filter may be obtained for each frequency such that the power of sounds from directions other than the direction that is the target of sound enhancement is minimized on condition that the filter reduces the amount of decay of a sound from the direction that is the target of sound enhancement to a predetermined value or less. Alternatively, a filter may be obtained for each frequency by using a spatial correlation matrix represented by frequency-domain signals obtained by transforming signals obtained by observation with a microphone array.

Effects of the Invention (Sound Spot Enhancement Technique)

Since the sound spot enhancement technique of the present invention uses not only a direct sound from a desired direction but also reflected sounds, the sound spot enhancement technique is capable of picking up sounds with a sufficiently high SN ratio from the direction. Furthermore, the sound spot enhancement technique of the present invention is capable of following a sound in any direction without needing to physically move the microphone because sound enhancement is accomplished by signal processing. Moreover, since each transmission characteristic $a_{i,g}$ is represented by the sum of the transmission characteristic of a direct sound that comes from the position determined by a direction i and a distance g and directly arrives at M microphones and the transmission characteristic(s) of one or more reflected sounds that are produced by reflection of the sound off an reflective object and arrive at the M microphones, a filter that increases the degree of suppression of coherence which determines the degree of directivity in a desired direction can be designed to typical filter design criteria, as will be described later in further detail in the <<Principle of Sound Spot Enhancement Technique>> section. That is, a sharper directivity in a desired direction can be achieved than was previously possible. Since reflected sounds are used as will be described later in further detail in the <<Principle of Sound Spot Enhancement Technique>> section, there are significant differences in transmission characteristic among sounds from different positions at different distances in about the same direction as viewed from the microphone array. By extracting the differences among transfer functions by beam forming, sounds in a narrow range including a desired direction can be enhanced according to distances from the microphone array.

(Sharp Directive Sound Enhancement Technique)

Since the sharp directive sound enhancement technique of the present invention uses not only a direct sound from a desired direction but also reflected sounds, the sharp directive sound enhancement technique is capable of picking up sounds with a sufficiently high SN ratio from the direction. Furthermore, the sharp directive sound enhancement technique of the present invention is capable of following a sound in any direction without needing to physically move the microphone because sound enhancement is accomplished by signal processing. Moreover, since each transmission characteristic $a_\phi$ is represented by the sum of the transmission characteristic of a direct sound that comes from a direction ϕ and directly arrives at M microphones and the transmission characteristic(s) of one or more reflected sounds that are produced by reflection of the sound off an reflective object and arrive at the M microphones, a filter that increases the degree of suppression of coherence which determines the degree of directivity in a desired direction can be designed to typical filter design criteria, as will be described later in further detail in the <<Principle of Sharp Directive Sound Enhancement>> section. That is, a sharper directivity in a desired direction can be achieved than was previously possible.

DETAILED DESCRIPTION OF THE EMBODIMENTS

Figure 1A:
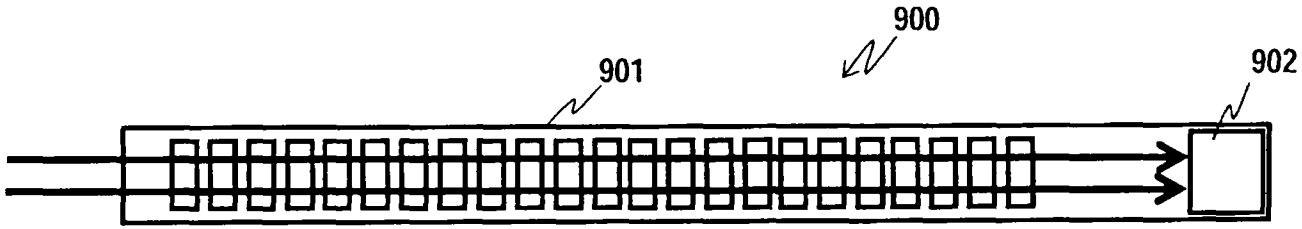
FIG. 1A RELATED ART
FIG. 1A is a diagram illustrating that sounds arriving from a target direction is enhanced by an acoustic tube microphone.
Figure 1B:
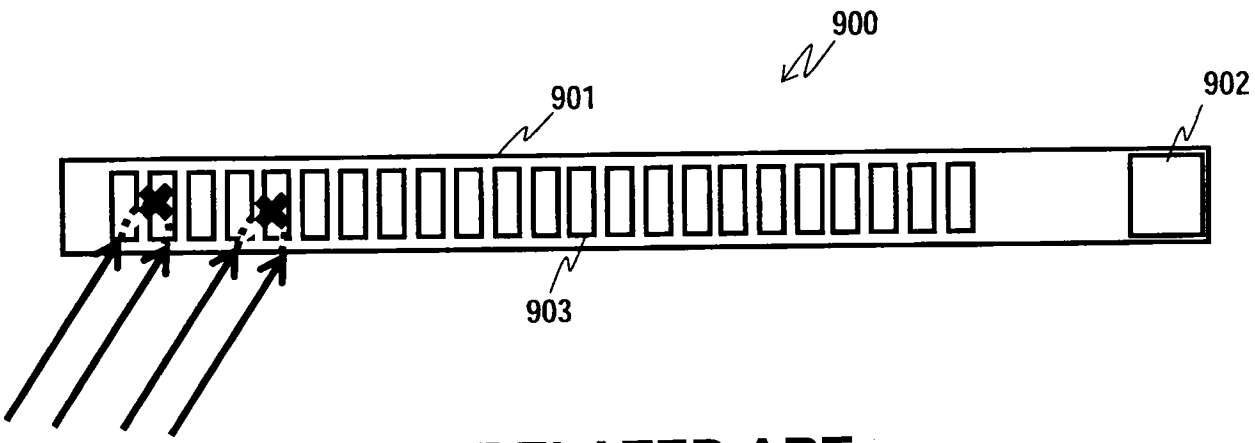
FIG. 1B RELATED ART
FIG. 1B is a diagram illustrating that sounds arriving from directions other than a target direction are suppressed by an acoustic tube microphone.
Figure 2A:
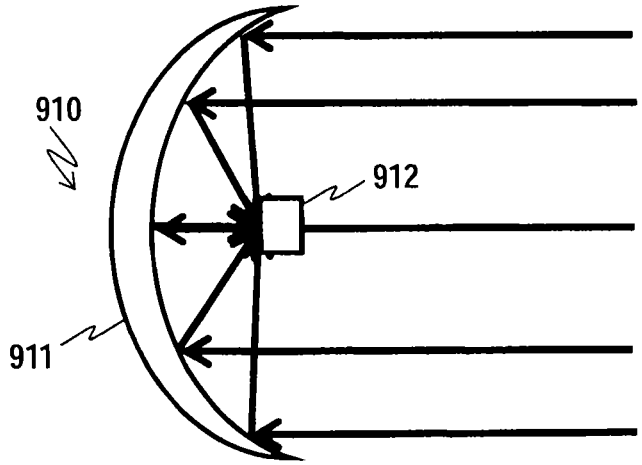
FIG. 2A is a diagram illustrating that sounds arriving from a target direction are enhanced by a parabolic microphone.
Figure 2B:
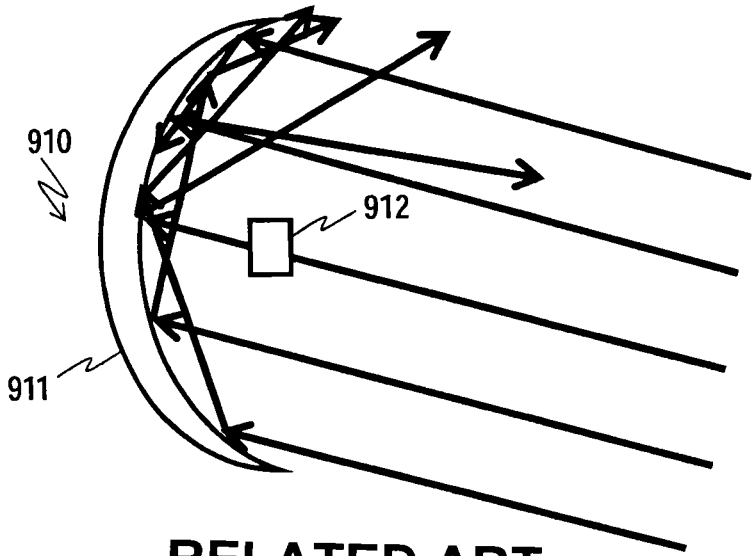
RELATED ART FIG. 2B
FIG. 2B is a diagram illustrating that sounds arriving from directions other than a target direction are suppressed by a parabolic microphone.
Figure 3:
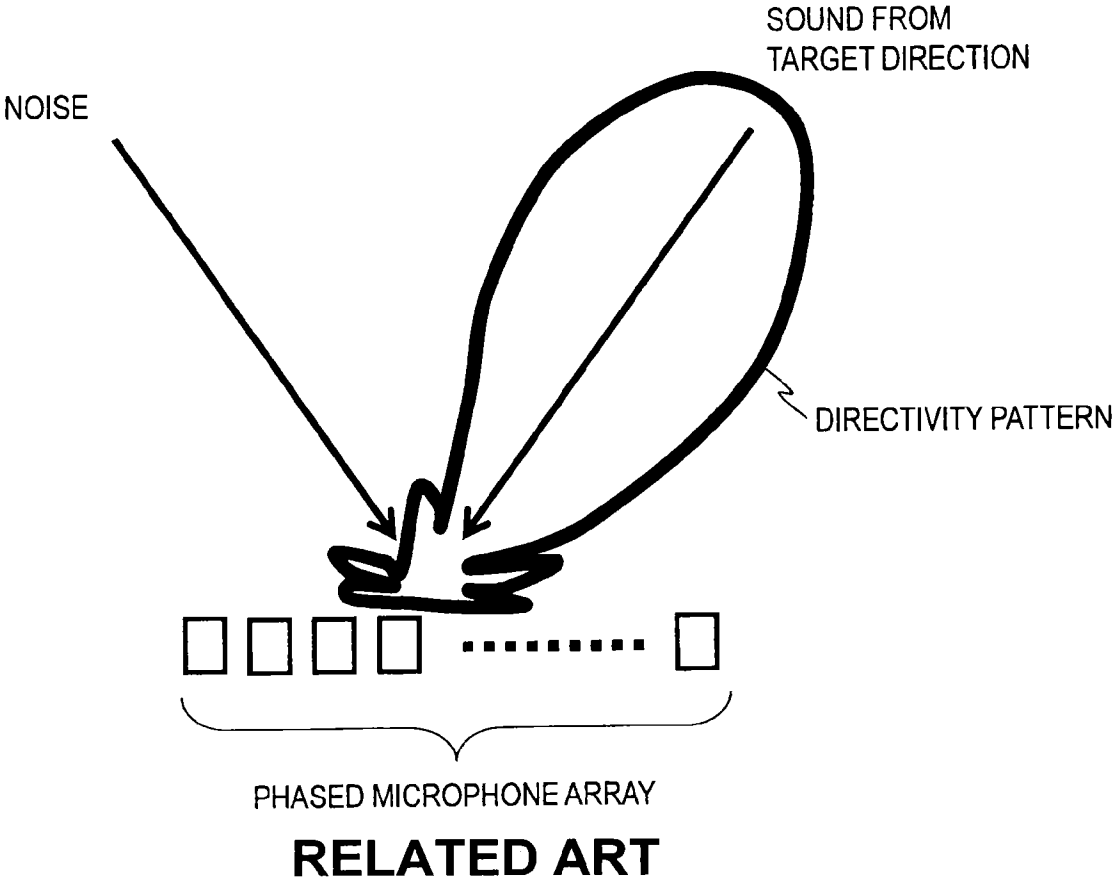
FIG. 3 is a diagram illustrating that a sound from a target direction is enhanced and a sound from a direction other than the target direction is suppressed using a phased microphone array including a plurality of microphones.
Figure 4:
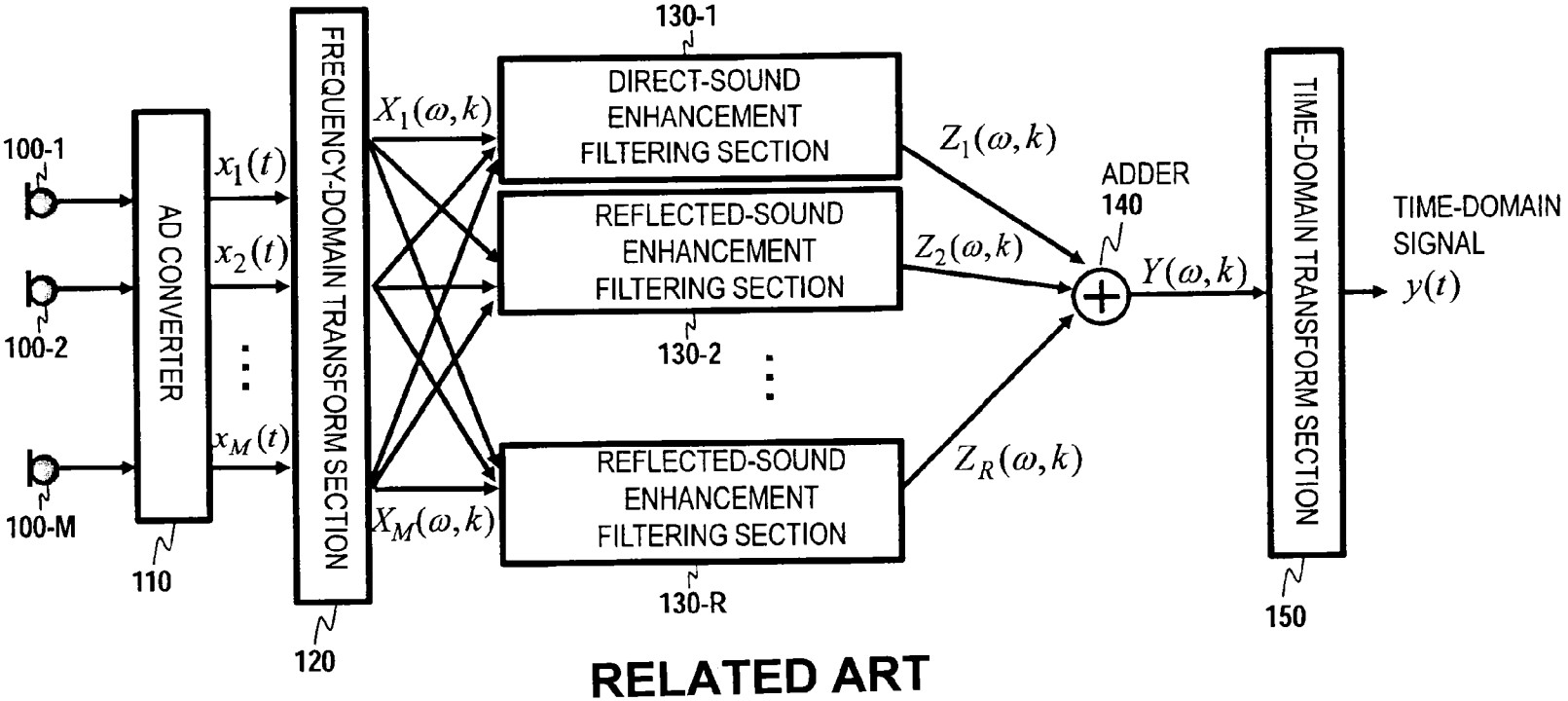
FIG. 4 is a diagram illustrating a functional configuration of a sharp directive sound enhancement technique using multi-beam forming as an example of conventional techniques.

A sharp directive sound enhancement technique will be described first and then a sound spot enhancement technique will be described.

<<Sharp Directive Sound Enhancement Technique>>

A principle of a sharp directive sound enhancement technique of the present invention will be described. The sharp directive sound enhancement technique of the present invention is based on the nature of a microphone array technique being capable of following sounds from any direction on the basis of signal processing and positively uses reflected sounds to pick up sounds with a high SN ratio. One feature of the present invention is a combined use of reflected sounds and a signal processing technique that enables a sharp directivity.

Prior to the description, symbols will be defined again. The index of a discrete frequency is denoted by $\omega$ (The index $\omega$ of a discrete frequency may be considered to be an angular frequency $\omega$ because a frequency f and an angular frequency $\omega$ satisfies the relation $\omega=2\pi f$. With regard to $\omega$, the "index of a discrete frequency" may be also sometimes simply referred to as a "frequency") and the index of frame-time number is denoted by k. Frequency-domain representation of a k-th frame of an analog signal received at M microphones is denoted by $\vec{X}(\omega, k)=[X_1(\omega, k), \ldots, X_M(\omega, k)]^T$ and a filter that enhances a frequency-domain signal $\vec{X}(\omega, k)$ of a sound from a target direction $\theta_s$ as viewed from the center of a microphone array with a frequency $\omega$ is denoted by $\vec{X}(\omega,$ $\theta_s$), where M is an integer greater than or equal to 2 and T represents the transpose. Then, a frequency-domain signal $Y(\omega, k, \theta_s)$ resulting from the enhancement of the frequency-domain signal $\vec{X}(\omega, k)$ of the sound from the target direction $\theta_s$ with the frequency $\omega$ (hereinafter the resulting signal is referred to as an output signal) can be given by equation (6):

$$Y(\omega, k, \theta_s)=\vec{W}^H(\omega, \theta_s)\vec{X}(\omega, k) \tag{6}$$

where H represents the Hermitian transpose.

While the "center of a microphone array" can be arbitrarily determined, typically the geometrical center of the array of the M microphones is treated as the "center of a microphone array". In the case of a linear microphone array, for example, the point equidistant from the microphones at the both ends of the array is treated as the "center of the microphone array". In the case of a planar microphone array in which microphones are arranged in a square matrix of m×m ($m^2$=M), for example, the position at which the diagonals linking the microphones at the corners intersect is treated as the "center of the microphone array".

A filter $\vec{W}(\omega, \theta_s)$ may be designed in various ways. A design using minimum variance distortionless response (MVDR) method will be described here. In the MVDR method, a filter $\vec{W}(\omega, \theta_s)$ is designed so that the power of sounds from directions other than a target direction $\theta_s$ (hereinafter sounds from directions other than the target direction $\theta_s$ will be also referred to as "noise") is minimized at a frequency $\omega$ (see equation (7)) by using a spatial correlation matrix $Q(\omega)$ under the constraint condition of equation (8). Transfer functions at a frequency $\omega$ between a sound source and the M microphones is denoted by $\vec{a}(\omega, \theta_s)=[a_1(\omega, \theta_s), \ldots, a_M(\omega, \theta_s)]^T$, where the sound source is assumed to be in a direction $\theta_s$. In other words, $\vec{a}(\omega, \theta_s)=[a_1(\omega, \theta_s), \ldots, a_M(\omega, \theta_s)]^T$ represents transfer functions of a sound from the direction $\theta_s$ to the microphones included in the microphone array at frequency $\omega$. The spatial correlation matrix $Q(\omega)$ represents the correlation among components $X_1(\omega, k), \ldots, X_M(\omega, k)$ of a frequency-domain signal $\vec{X}(\omega, k)$ at frequency $\omega$ and has $E[X_i(\omega, k)X_j^*(\omega, k)]$ ($1 \le i \le M$, $1 \le j \le M$) as its (i, j) elements. The operator $E[\bullet]$ represents a statistical averaging operation and the symbol * is a complex conjugate operator. The spatial correlation matrix $Q(\omega)$ can be expressed using statistics values of $X_1(\omega, k), \ldots, X_M(\omega, k)$ obtained from observation or may be expressed using transfer functions. The latter case, where the spatial correlation matrix $Q(\omega)$ is expressed using transfer functions, will be described momentarily hereinafter.

$$\min_{\vec{W}(\omega,\theta_s)} \left(\vec{W}^H(\omega, \theta_s)Q(\omega)\vec{W}(\omega, \theta_s)\right) \tag{7}$$

$$\vec{W}^H(\omega, \theta_s)\vec{a}(\omega, \theta_s) = 1.0 \tag{8}$$

It is known that the filter $\vec{W}(\omega, \theta_s)$ which is an optimal solution of equation (7) can be given by equation (9) (see Reference 1 listed later).

$$\vec{W}(\omega, \theta_s) = \frac{Q^{-1}(\omega)\vec{a}(\omega, \theta_s)}{\vec{a}^H(\omega, \theta_s)Q^{-1}(\omega)\vec{a}(\omega, \theta_s)} \tag{9}$$

As will be appreciated from the fact that the inverse matrix of the spatial correlation matrix $Q(\omega)$ is included in equation (9), the structure of the spatial correlation matrix $Q(\omega)$ is important for achieving a sharp directivity. It will be appreciated from equation (7) that the power of noise depends on the structure of the spatial correlation matrix $Q(\omega)$.

A set of indices p of directions from which noise arrives is denoted by $\{1, 2, \ldots, P-1\}$. It is assumed that the index s of the target direction $\theta_s$ does not belong to the set $\{1, 2, \ldots, P-1\}$. Assuming that P−1 noises come from arbitrary directions, the spatial correlation matrix $Q(\omega)$ can be given by equation (10a). In order to design a filter that sufficiently functions in the presence of many noises, it is preferable that P be a relatively large value. It is assumed here that P is an integer on the order of M. While the description is given as if the target direction $\theta_s$ is a constant direction (and therefore directions other than the target direction $\theta_s$ are described as directions from which noise arrives) for the clarity of explanation of the principle of the sharp directive sound enhancement technique of the present invention, the target direction $\theta_s$ in reality may be any direction that can be a target of sound enhancement. Usually, a plurality of directions can be target directions $\theta_s$. In this light, the differentiation between the target direction $\theta_s$ and noise directions is subjective. It is more correct to consider that one direction selected from P different directions that are predetermined as a plurality of possible directions from which whatever sounds, including a target sound or noise, may arrive is the target direction and the other directions are noise directions. Therefore, the spatial correlation matrix $Q(\omega)$ can be represented by transfer functions $\vec{a}(\omega, \theta_\phi)=[a_1(\omega, \theta_\phi), \ldots, a_M(\omega, \theta_\phi)]^T$ ($\phi \in \Phi$) of sounds that come from directions $\theta_\phi$ included in a plurality of possible directions from which sounds may arrive to the microphones and can be written as equation (10b), where $\Phi$ is the union of set $\{1, 2, \ldots, P-1\}$ and a set $\{s\}$. Note that $|\Phi|=P$ and $|\Phi|$ represents the number of elements of the set $\Phi$.

$$Q(\omega) = \vec{a}(\omega, \theta_s)\vec{a}^H(\omega, \theta_s) + \sum_{p\in\{1,\cdots,P-1\}} \vec{a}(\omega, \theta_p)\vec{a}(\omega, \theta_p) \tag{10a}$$

$$Q(\omega) = \sum_{\phi\in\Phi} \vec{a}(\omega, \theta_\phi)\vec{a}^H(\omega, \theta_\phi) \tag{10b}$$

Here, it is assumed that the transmission characteristic $\vec{a}(\omega, \theta_s)$ of a sound from the target direction $\theta_s$ and the transfer functions $\vec{a}(\omega, \theta_p)=[a_1(\omega, \theta_p), \ldots, a_M(\omega, \theta_p)]^T$ of sounds from directions $p \in \{1, 2, \ldots, P-1\}$ are orthogonal to each other. That is, it is assumed that there are P orthogonal basis systems that satisfy the condition given by equation (11). The symbol $\perp$ represents orthogonality. If $\vec{A} \perp \vec{B}$, the inner product of vectors $\vec{A}$ and $\vec{B}$ is zero. It is assumed here that P≤M. Note that if the condition given by equation (11) can be relaxed to assume that there are P basis systems that can be regarded approximately as orthogonal basis systems, P is preferably a value on the order of M or a relatively large value greater than or equal to M.

$$\vec{a}(\omega, \theta_s) \perp \vec{a}(\omega, \theta_1) \perp \ldots \perp \vec{a}(\omega, \theta_{P-1}) \tag{11}$$

Then, the spatial correlation matrix $Q(\omega)$ can be expanded as equation (12). Equation (12) means that the spatial correlation matrix $Q(\omega)$ can be decomposed into a matrix $V(\omega)=[\vec{a}(\omega, \theta_s), \vec{a}(\omega, \theta_1), \ldots, \vec{a}(\omega, \theta_{p-1})]^T$ made up of P transfer functions that satisfy orthogonality and a unit matrix $\Lambda(\omega)$. Here, $\rho$ is an eigenvalue of a transmission characteristic $\vec{a}(\omega, \theta_\phi)$ that satisfies equation (11) for the spatial correlation matrix $Q(\omega)$ and is a real value.

$$Q(\omega)=\rho\vec{V}(\omega)\vec{\Lambda}(\omega)\vec{V}^H(\omega) \tag{12}$$

Then, the inverse matrix of the spatial correlation matrix $Q(\omega)$ can be given by equation (13).

$$Q^{-1}(\omega) = \frac{1}{\rho}\vec{V}^{H}(\omega)\vec{\Lambda}^{-1}(\omega)\vec{V}(\omega) \tag{13}$$

Substitution of equation (13) into equation (7) shows that the power of noise is minimized. If the power of noise is minimized, it means that the directivity in the target direction $\theta_s$ is achieved. Therefore, orthogonality between the transfer functions of sounds from different directions is an important condition for achieving directivity in the target direction $\theta_s$.

The reason why it is difficult for conventional techniques to achieve a sharp directivity in a target direction $\theta_s$ will be discussed below.

Conventional techniques assumed in designing filters that transfer functions were made up of those of direct sounds. In reality, there are reflected sounds that are produced by reflection of sounds from the same sound source off surfaces such as walls and a ceiling and arrive at microphones. However, the conventional techniques regarded reflected sounds as a factor that degrade directivity and ignored the presence of reflected sounds. In the conventional techniques, transfer functions $\vec{a}_{conv}(\omega, \theta)=[a_1(\omega, \theta), \ldots, a_M(\omega, \theta)]^T$ were treated as $\vec{a}_{conv}(\omega, \theta)=\vec{h}_d(\omega, \theta)$, where $\vec{h}_d(\omega, \theta)=[h_{d1}(\omega, \theta), \ldots, h_{dM}(\omega, \theta)]^T$ represents steering vectors of only a direct sound arriving from a direction $\theta$. Note that a steering vector is a complex vector where phase response characteristics of microphones at a frequency $\omega$ with respect to a reference point are arranged for a sound wave from a direction $\theta$ viewed from the center from the microphone array.

Assuming that sounds arrive at a linear microphone array as plane waves, an m-th element $h_{dm}(\omega, \theta)$ of the steering vector $\vec{h}_d(\omega, \theta)$ of a direct sound is given by, for example, equation (14a), where m is an integer that satisfies $1 \le m \le M$, c represents the speed of sound, u represents the distance between adjacent microphones, j is an imaginary unit. The reference point is the midpoint of the full-length of the linear microphone array (the center of the linear microphone array). The direction $\theta$ is defined as the angle formed by the direction from which a direct sound arrives and the direction in which the microphones included in the linear microphone array, as viewed from the center of the linear microphone array (see FIG. 9). Note that a steering vector can be expressed in various ways. For example, assuming that the reference point is the position of the microphone at one end of the linear microphone array, an m-th element $h_{dm}(\omega, \theta)$ of the steering vector $\vec{h}_d(\omega, \theta)$ of a direct sound can be given by equation (14b). In the following description, the assumption is that the m-th element $h_{dm}(\omega, \theta)$ of the steering vector $\vec{h}_d(\omega, \theta)$ of a direct sound can be written as equation (14a).

$$h_{dm}(\omega, \theta) = \exp\left[-\frac{j\omega u}{c}\left(m - \frac{M+1}{2}\right)\cos\theta\right] \tag{14a}$$

$$h_{dm}(\omega, \theta) = \exp\left(-\frac{j\omega u}{c}(m-1)\cos\theta\right] \tag{14b}$$

The inner product $\gamma_{conv}(\omega, \theta)$ of a transmission characteristic of a direction $\theta$ and a transmission characteristic of a target direction $\theta_s$ can be given by equation (15), where $\theta \neq \theta_s$.

$$\begin{aligned}\gamma_{conv}(\omega, \theta) &= \vec{a}^{H}_{conv}(\omega, \theta_s)\vec{a}_{conv}(\omega, \theta) \\ &= \vec{h}^{H}_{d}(\omega, \theta_s)\vec{h}_d(\omega, \theta) \\ &= \sum_{m=1}^{M} \exp\left[-\frac{j\omega u}{c}\left(m - \frac{M+1}{2}\right)(\cos\theta - \cos\theta_s)\right]\end{aligned} \tag{15}$$

Hereinafter, $\gamma_{conv}(\omega, \theta)$ is referred to as coherence. The direction $\theta$ in which the coherence $\gamma_{conv}(\omega, \theta)$ is 0 can be given by equation (16), where q is an arbitrary integer, except 0. Since $0<\theta<\pi/2$, the range of q is limited for each frequency band.

$$\theta = \arccos\left(\frac{2q\pi c}{M\omega u} + \cos\theta_s\right) \tag{16}$$

Figure 5A:
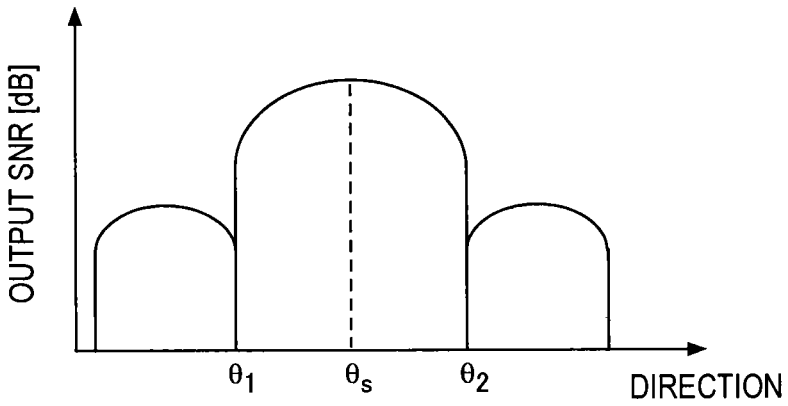
FIG. 5A is a diagram schematically showing that a sufficiently high directivity cannot be achieved by taking only direct sounds into account.

Since only parameters relating to the size of the microphone array (M and u) can be changed in equation (16), it is difficult to reduce the coherence $\gamma_{conv}(\omega, \theta)$ without changing any of the parameters relating to the size of the microphone array if the difference (angular difference) $|\theta-\theta_s|$ between directions is small. If this is the case, the power of noise is not reduced to a sufficiently small value and directivity having a wide beam width in the target direction $\theta_s$ as schematically illustrated in FIG. 5A will result.

The sharp directive sound enhancement technique of the present invention is based on the consideration described above and is characterized by positively taking into account reflected sounds, unlike in the conventional technique, on the basis of an understanding that in order to design a filter that provides a sharp directivity in the target direction $\theta_s$, it is important to enable the coherence to be reduced to a sufficiently small value even when the difference (angular difference) $|\theta-\theta_s|$ between directions is small.

Two types of plane waves, namely direct sounds from a sound source and reflected sounds produced by reflection of that sound off a reflective object 300, together enter the microphones of a microphone array. Let the number of reflected sounds be denoted by $\Xi$. Here, $\Xi$ is a predetermined integer greater than or equal to 1. Then, a transmission characteristic $\vec{a}(\omega, \theta)=[a_1(\omega, \theta), \ldots, a_M(\omega, \theta)]^T$ can be expressed by the sum of a transmission characteristic of a direct sound that comes from a direction that can be a target of sound enhancement and directly arrives at the microphone array and the transmission characteristic(s) of one or more reflected sounds that are produced by reflection of that sound off a reflective object and arrive at the microphone array. Specifically, the transmission characteristic can be represented as the sum of the steering vector of the direct sound and the steering vector of $\Xi$ reflected sounds whose decays due to reflection and arrival time differences from the direct sound are corrected, as shown in equation (17a), where $\tau_\xi(\theta)$ is the arrival time difference between the direct sound and a $\xi$-th ($1 \le \xi \le \Xi$) reflected sound and $\alpha_\xi$ ($1 \le \xi \le \Xi$) is a coefficient for taking into account decays of sounds due to reflection. Here, $\vec{h}_{r\xi}(\omega, \theta)=[h_{r1\xi}(\omega, \theta), \ldots, h_{rM\xi}(\omega, \theta)]^T$ represents the steering vectors of reflected sounds corresponding to the direct sound from direction $\theta$. Typically, $\alpha_\xi$ ($1 \le \xi \le \Xi$) is less than or equal to 1 ($1 \le \xi \le \Xi$). For each reflected sound, if the number of reflections in the path from the sound source to the microphones is 1, $\alpha_\xi$ ($1 \le \xi \le \Xi$) can be considered to represent the acoustic reflectance of the object from which the $\xi$-th reflected sound was reflected.

$$\vec{a}(\omega, \theta) = \vec{h}_d(\omega, \theta) + \sum_{\xi=1}^{\Xi} \alpha_\xi \exp[-j\omega\tau_\xi(\theta)] \cdot \vec{h}_{r\xi}(\omega, \theta) \tag{17a}$$

Since it is desirable that one or more reflected sounds be provided to the microphone array made up of M microphones, it is preferable that there is one or more reflective objects. From this point of view, a sound source, the microphone array, and one or more reflective objects are preferably in such a positional relation that a sound from the sound source is reflected off at least one reflective object before arriving at the microphone array, assuming that the sound source is located in the target direction. Each of the reflective objects has a two-dimensional shape (for example a flat plate) or a three-dimensional shape (for example a parabolic shape). Each reflective object has preferably about the size of the microphone array or greater (greater by a factor of 1 to 2). In order to effectively use reflected sounds, the reflectance $\alpha_\xi$ ($1 \le \xi \le \Xi$) of each reflective object is preferably at least greater than 0, and more preferably, the amplitude of a reflected sound arriving at the microphone array is greater than the amplitude of the direct sound by a factor of 0.2 or greater. For example, each reflective object is a rigid solid. Each reflective object may be a movable object (for example a reflector) or an immovable object (such as a floor, wall, or ceiling). Note that if an immovable object is set as a reflective object, the steering vector for the reflective object needs to be changed as the microphone array is relocated (see functions $\Psi(\theta)$ and $\Psi_\xi(\theta)$ described later) and consequently the filter needs to be recalculated (re-set). Therefore, the reflective objects are preferably accessories of the microphone array for the sake of robustness against environmental changes (in this case, $\Xi$ reflected sounds assumed are considered to be sounds reflected off the reflective objects). Here the "accessories of the microphone array" are "tangible objects capable of following changes of the position and orientation of the microphone array while maintaining the positional relation (geometrical relation) with the microphone array). A simple example may be a configuration where reflective objects are fixed to the microphone array.

In order to concretely describe advantages of the sharp directive sound enhancement technique of the present invention, it is assumed in the following that $\Xi=1$, sounds are reflected once, and one reflective object exists at a distance of L meters from the center of the microphone array. The reflective object is a thick rigid object. Since $\Xi=1$ in this case, the symbol representing this is omitted and therefore equation (17a) can be rewritten as equation (17b):

$$\vec{a}(\omega, \theta) = \vec{h}_d(\omega, \theta) + \alpha \exp[-j\omega\tau(\theta)] \cdot \vec{h}_r(\omega, \theta) \tag{17b}$$

An m-the element of the steering vector $\vec{h}_r(\omega, \theta) = [h_{r1}(\omega, \theta), \ldots, h_{rM}(\omega, \theta)]^T$ of a reflected sound can be given by equation (18a) in the same way that the steering vector of a direct sound is represented (see equation (14a)). The function $\Psi(\theta)$ outputs the direction from which a reflected sound arrives. Note that if the steering vector of a direct sound is written as equation (14b), an m-th element of the steering vector $\vec{h}_r(\omega, \theta) = [h_{r\xi}(\omega, \theta), \ldots, h_{rM}(\omega, \theta)]^T$ of a reflected sound is given by equation (18b). Typically, an m-th element of a $\xi$-th ($1 \le \xi \le \Xi$) steering vector $\vec{h}_{r\xi}(\omega, \theta) = [h_{r1\xi}(\omega, \theta), \ldots, h_{rM\xi}(\omega, \theta)]^T$ is given by equation (18c) or equation (18d). The function $\Psi_\xi(\theta)$ outputs the direction from which the $\xi$-th reflected sound arrives.

$$h_{rm}(\omega, \theta) = \exp\left[-\frac{j\omega u}{c}\left(m - \frac{M+1}{2}\right)\cos(\Psi(\theta))\right] \tag{18a}$$

$$h_{rm}(\omega, \theta) = \exp\left[-\frac{j\omega u}{c}(m-1)\cos(\Psi(\theta))\right] \tag{18b}$$

$$h_{rm\xi}(\omega, \theta) = \exp\left[-\frac{j\omega u}{c}\left(m - \frac{M+1}{2}\right)\cos(\Psi_\xi(\theta))\right] \tag{18c}$$

$$h_{rm\xi}(\omega, \theta) = \exp\left[-\frac{j\omega u}{c}(m-1)\cos(\Psi_\xi(\theta))\right] \tag{18d}$$

Since the location of a reflective object can be set as appropriate, the direction from which a reflected sound arrives can be treated as a variable parameter.

Assuming that a flat-plate reflective object is near the microphone array (the distance L is not extremely large compared with the size of the microphone array), the coherence $\gamma(\omega, \theta)$ is given by equation (19), where $\theta \neq \theta$.

$$\begin{aligned}\gamma(\omega, \theta) &= \vec{a}^H(\omega, \theta_s)\vec{a}(\omega, \theta) \\ &= \vec{h}_d^H(\omega, \theta_s)\vec{h}_d(\omega, \theta) \\ &\quad + \alpha \exp[-j\omega\tau(\theta)] \cdot \vec{h}_d^H(\omega, \theta_s)\vec{h}_r(\omega, \theta) \\ &\quad + \alpha \exp[j\omega\tau(\theta_s)] \cdot \vec{h}_r^H(\omega, \theta_s)\vec{h}_d(\omega, \theta) \\ &\quad + \alpha^2 \exp[-j\omega(\tau(\theta) - \tau(\theta_s))] \cdot \vec{h}_r^H(\omega, \theta_s)\vec{h}_r(\omega, \theta)\end{aligned} \tag{19}$$

It will be apparent from equation (19) that the coherence $\gamma(\omega, \theta)$ of equation (19) can be smaller than coherence $\gamma_{conv}(\omega, \theta)$ of the conventional technique of equation (15). Since parameters ($\Psi(\theta)$ and L) that can be changed by relocating or reorienting the reflective object are included in the second to fourth terms of equation (19), there is a possibility that the first term, $\vec{h}_d^H(\omega, \theta)\vec{h}_d(\omega, \theta)$, can be eliminated.

For example, if a flat reflector is placed in such a position that the direction along which the microphones are arranged in a linear microphone array is normal to the reflector, $\Psi(\theta) = \pi - \theta$ holds for the function $\Psi(\theta)$ and equation (20) folds for the difference $\tau(\theta)$ in arrival time between a direct sound and a reflected sound. Therefore, the conditions of equatione (21) and (22) are generated for the elements of equation (19). Here, the symbol * is a complex conjugate operator.

$$\tau(\theta) = \begin{cases} (2L\cos\theta)/c & \left(0 < \theta \le \frac{\pi}{4}\right) \\ (2L\sin\theta\tan\theta)/c & \left(\frac{\pi}{4} < \theta < \frac{\pi}{2}\right) \end{cases} \tag{20}$$

$$\vec{h}_d^H(\omega, \theta_s)\vec{h}_d(\omega, \theta) = \vec{h}_d^H(\omega, \theta_s)\vec{h}_r(\omega, \theta) \tag{21}$$

$$\vec{h}_d^H(\omega, \theta_s)\vec{h}_r(\omega, \theta) = \left[\vec{h}_d^H(\omega, \theta_s)\vec{h}_d(\omega, \theta)\right]^* \tag{22}$$

Since the absolute value of $\vec{h}_d^H(\omega, \theta)\vec{h}_r(\omega, \theta)$ is sufficiently smaller than $\vec{h}_d^H(\omega, \theta)\vec{h}_d(\omega, \theta)$, the second and third terms of equation (19) are neglected. Then the coherence $\gamma(\omega, \theta)$ can be approximated as equation (23):

$$\tilde{\gamma}(\omega, \theta) \approx \{1 + \alpha^2 \exp[-j\omega(\tau(\theta) - \tau(\theta_s))]\}\vec{h}_d^H(\omega, \theta_s)\vec{h}_d(\omega, \theta) \tag{23}$$

Even if $\vec{h}_d^H(\omega, \theta)\vec{h}_d(\omega, \theta) \neq 0$, an approximated coherence $\tilde{\gamma}(\omega, \theta)$ has a minimal solution $\theta$ of equation (24), where q is an arbitrary positive integer. The range of q is restricted for each frequency.

$$\theta = \begin{cases} \arccos\left(\frac{(2q+1)\pi c}{2\omega L} + \cos\theta_s\right) & \left(0 < \theta \le \frac{\pi}{4}\right) \\ \frac{(2q+1)\pi c}{4\omega L} + \frac{1}{2}\sqrt{\left(\frac{(2q+1)\pi c}{4\omega L}\right)^2 + 4} & \left(\frac{\pi}{4} < \theta < \frac{\pi}{2}\right) \end{cases} \tag{24}$$

That is, not only the coherence in a direction given by equation (16) but also the coherence in a direction given by equation (24) can be suppressed. Since suppression of coherence can reduce the power of noise, a sharp directivity can be achieved as schematically shown in FIG. 5B.

Figure 5B:
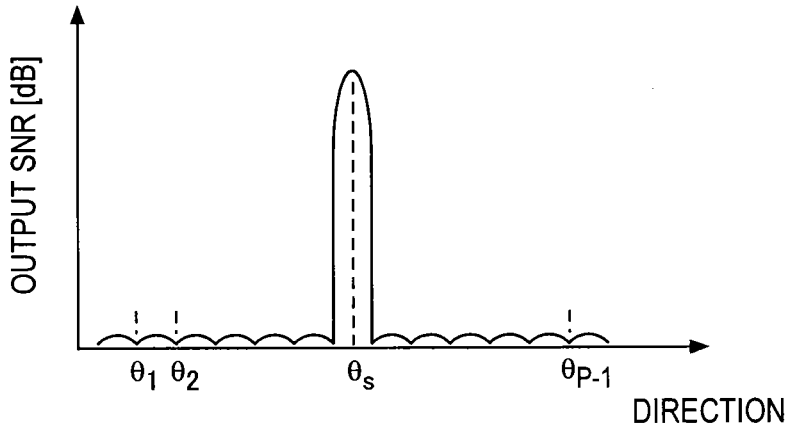
FIG. 5B is a diagram schematically showing that a sufficiently high directivity can be achieved by taking both of direct and reflected sounds into account.
Figure 6:
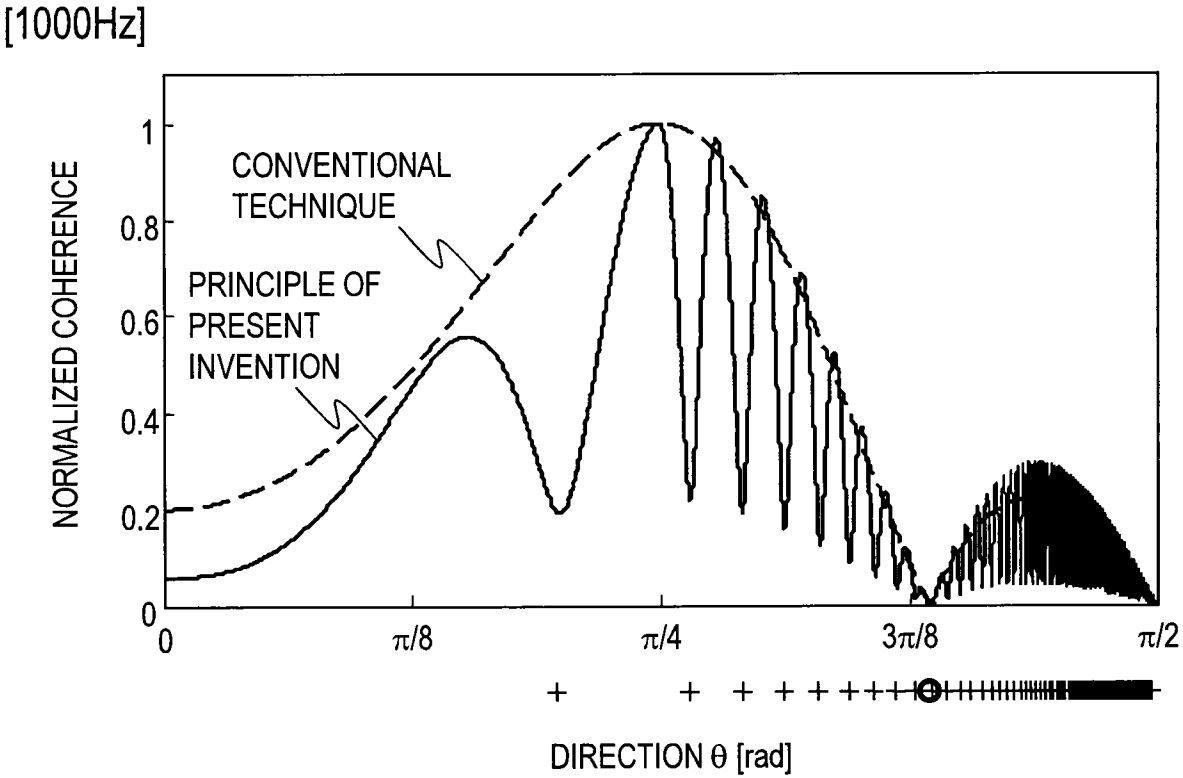
FIG. 6 is a diagram showing the direction dependencies of coherences of a conventional technique and a principle of the present invention.

While FIGS. 5A and 5B schematically show the difference between directivity achieved by the principle of the sharp directive sound enhancement technique of the present invention and directivity achieved by a conventional technique, FIG. 6 specifically shows the difference between θ given by equation (16) and θ given by equation (24). Here, $\omega=2\pi\times 1000$ [rad/s], L=0.70 [m], and $\theta_s=\pi/4$ [rad]. Direction dependence of normalized coherence is shown in FIG. 6 for comparison between the techniques. The direction indicated by a circle is θ given by equation (16) and the directions indicated by the symbol + are θ given by equation (24). As can be seen from FIG. 6, according to the conventional technique, θ that yields a coherence of 0 for $\theta_s=\pi/4$ [rad] exists only in the direction indicated by the circle, whereas according to the principle of the sharp directive sound enhancement of the present invention, θ that yields a coherence of 0 for $\theta_s=\pi/4$ [rad] exists in many directions indicated by the symbol +. Especially, directions indicated by the symbol + exist far closer to $\theta_s=\pi/4$ [rad] than the direction indicated by the circle. Therefore, it will be understood that the technique of the present invention achieves a sharper directivity than the conventional technique.

As is apparent from the foregoing description, the essence of the sharp directive sound enhancement technique of the present invention is that the transmission characteristic $\vec{a}(\omega, \theta_s)=[a_1(\omega, \theta), \ldots, a_M(\omega, \theta)]^T$ is represented by the sum of the steering vector of a direct sound and the steering vectors of Ξ reflected sounds, as shown in Equation (17a), for example. Since this does not affect the filter design concept, filters $\vec{W}(\omega, \theta_s)$ can be designed by a method other than the minimum variance distortionless response (MVDR) method.

Methods other than the MVDR method described above will be described. They are: <1> a filter design method based on SNR maximization criterion, <2> a filter design method based on power inversion, <3> a filter design method using MVDR with one or more null directions (directions in which the gain of noise is suppressed) as a constraint condition, <4> a filter design method using delay-and-sum beam forming, <5> a filter design method using the maximum likelihood method, and <6> a filter design method using the adaptive microphone-array for noise reduction (AMNOR) method. For <1> the filter design method based on SNR maximization criterion and <2> the filter design method based on power inversion, refer to Reference 2 listed below. For <3> the filter design method using MVDR with one or more null directions (directions in which the gain of noise is suppressed) as a constraint condition, refer to Reference 3 listed below. For <6> the filter design method using the adaptive microphone-array for noise reduction (AMNOR) method, refer to Reference 4 listed below.

<1> Filter Design Method Based on SNR Maximization Criterion

In the filter design method based on SNR maximization criterion, a filter $\vec{W}(\omega, \theta_s)$ is determined on the basis of a criterion of maximizing the SN ratio (SNR) in a target direction $\theta_s$. The spatial correlation matrix for a sound from the target direction $\theta_s$ is denoted by $R_{ss}(\omega)$ and the spatial correlation matrix for a sound from a direction other than the target direction $\theta_s$ is denoted by $R_{nn}(\omega)$. Then the SNR can be given by equation (25). Here, $R_{ss}(\omega)$ can be given by equation (26) and $R_{nn}(\omega)$ can be given by equation (27). Transfer functions $\vec{a}(\omega, \theta)=[a_1(\omega, \theta_s), \ldots, a_M(\omega, \theta_s)]^T$ can be given by equation (17a) (to be precise, equation (17a) where θ is replaced with $\theta_s$).

$$SNR = \frac{\vec{W}^H(\omega, \theta_s)R_{ss}(\omega)\vec{W}(\omega, \theta_s)}{\vec{W}^H(\omega, \theta_s)R_{nn}(\omega)\vec{W}(\omega, \theta_s)} \tag{25}$$

$$R_{ss}(\omega) = \vec{a}(\omega, \theta_s)\vec{a}^H(\omega, \theta_s) \tag{26}$$

$$R_{nn}(\omega) = \sum_{p\in\{1,\cdots,P-1\}} \vec{a}(\omega, \theta_p)\vec{a}^H(\omega, \theta_p) \tag{27}$$

The filter $\vec{W}(\omega, \theta_s)$ that maximizes the SNR of equation (25) can be obtained by setting the gradient relating to filter $\vec{W}(\omega, \theta_s)$ to zero, that is, by equation (28).

$$\nabla_{\vec{W}(\omega,\theta_s)}[SNR] = 0 \tag{28}$$

where $$\nabla_{\vec{W}(\omega,\theta_s)}[SNR] = \frac{2R_{ss}(\omega)\vec{W}(\omega, \theta_s)\left(\vec{W}^H(\omega, \theta_s)R_{nn}(\omega)\vec{W}(\omega, \theta_s)\right) - 2R_{nn}(\omega)\vec{W}(\omega, \theta_s)\left(\vec{W}^H(\omega, \theta_s)R_{ss}(\omega)\vec{W}(\omega, \theta_s)\right)}{\left(\vec{W}^H(\omega, \theta_s)R_{nn}(\omega)\vec{W}(\omega, \theta_s)\right)^2}$$

Thus, the filter $\vec{W}(\omega, \theta_s)$ that maximizes the SNR of equation (25) can be given by equation (29):

$$\vec{W}(\omega, \theta_s)=R_{nn}^{-1}(\omega)\vec{a}(\omega, \theta_s) \tag{29}$$

Equation (29) includes the inverse matrix of the spatial correlation matrix $R_{nn}(\omega)$ of a sound from a direction other than the target direction $\theta_s$. It is known that the inverse matrix of $R_{nn}(\omega)$ can be replaced with the inverse matrix of a spatial correlation matrix $R_{xx}(\omega)$ of a whole input including sounds from the target direction $\theta_s$ and other directions than the target direction $\theta_s$. Note that $R_{xx}(\omega)=R_{ss}(\omega)+R_{nn}(\omega)=Q(\omega)$ (see equatione (10a), (26) and (27)). That is, the filter $\vec{W}(\omega, \theta_s)$ that maximizes the SNR of equation (25) may be obtained by equation (30):

$$\vec{W}(\omega, \theta_s)=R_{xx}^{-1}(\omega)\vec{a}(\omega, \theta_s) \tag{30}$$

<2> Filter Design Method Based on Power Inversion

In the filter design method based on power inversion, a filter $\vec{W}(\omega, \theta_s)$ is determined on the basis of a criterion of minimizing the average output power of a beam former while a filter coefficient for one microphone is fixed at a constant value. Here, an example where the filter coefficient for the first microphone among M microphones is fixed will be described. In this design method, a filter $\vec{W}(\omega, \theta_s)$ is designed that minimizes the power of sounds from all directions (all directions from which sounds can arrive) by using a spatial correlation matrix $R_{xx}(\omega)$ (see equation (31)) under the constraint condition of equation (32). Transfer functions $\vec{a}(\omega, \theta_s)=[a_1(\omega, \theta_s), \ldots, a_M(\omega, \theta_s)]^T$ can be given by equation (17a) (to be precise, by equation (17a) where θ is replaced with $\theta_s$). Here, $R_{xx}(\omega)=Q(\omega)$ (see equatione (10a), (26) and (27)).

$$\min_{\vec{W}(\omega,\theta_s)} \left(\vec{W}^H(\omega, \theta_s)R_{xx}(\omega)\vec{W}(\omega, \theta_s)\right) \tag{31}$$

$$\vec{W}^H(\omega, \theta_s)\vec{G} = \vec{G}^H R_{xx}^{-1}(\omega)\vec{G} \tag{32}$$

where $$\vec{G} = [1, 0, \cdots, 0]^T$$

It is known that the filter $\vec{W}(\omega, \theta_s)$ that is an optimum solution of equation (31) can be given by equation (33):

$$\vec{W}(\omega, \theta_s)=R_{xx}^{-1}(\omega)\vec{G} \tag{33}$$

<3> Filter Design Method Using MVDR with One or More Null Directions as Constraint Condition In the MVDR method described earlier, a filter $\vec{W}(\omega, \theta_s)$ has been designed under the single constraint condition that a filter is obtained that minimizes the average output power of a beam former given by equation (7) (that is, the power of noise which is sounds from directions other than a target direction) under the constraint condition that the filter passes sounds from a target direction $\theta_s$ in all frequency bands as expressed by equation (8). According to the method, the power of noise can be generally suppressed. However, the method is not necessarily preferable if it is previously known that there is a noise source(s) that has strong power in one or more particular directions. If this is the case, a filter is required that strongly suppresses one or more particular known directions (that is, null directions) in which the noise source(s) exist(s). Therefore, the filter design method described here obtains a filter that minimizes the average output power of the beam former given by equation (7) (that is, minimizes the average output power of sounds from directions other than a target direction and the null directions) under the constraint conditions that (1) the filter passes sounds from the target direction $\theta_s$ in all frequency bands and that (2) the filter suppresses sounds from B known null directions $\theta_{N1}, \theta_{N2}, \ldots, \theta_{NB}$ (B is a predetermined integer greater than or equal to 1) in all frequency bands. Let a set of indices $\phi$ of directions from which sound arrives be denoted by $\{1, 2, \ldots, P\}$, then $N_j \in \{1, 2, \ldots, P\}$ (where $j \in \{1, 2, \ldots, B\}$) and $B \leq P-1$, as has been described earlier.

Let $\vec{a}(\omega, \theta_i)=[a_1(\omega, \theta_i), \ldots, a_M(\omega, \theta_i)]^T$ be transfer functions between a sound source assumed to be located in a direction $\theta_i$ and the M microphones at a frequency $\omega$, in other words, transfer functions of a sound from a direction $\theta_i$ at a frequency $\omega$ arriving at the microphones of a microphone array, then a constraint condition can be given by equation (34). Here, indices $i \in \{s, N1, N2, \ldots, NB\}$, transfer functions $\vec{a}(\omega, \theta_i)=[a_1(\omega, \theta_i), \ldots, a_M(\omega, \theta_i)]^T$ can be given by equation (17a) (to be precise, by equation (17a) where $\theta$ is replaced with $\theta_i$), and $f_i(\omega)$ represents a pass characteristic at a frequency $\omega$ for a direction $\theta_i$.

$$\vec{W}^H(\omega, \theta_s)\vec{a}(\omega, \theta_i)=f_i(\omega)\ i \in \{s, N1, N2, \ldots, NB\} \tag{34}$$

Equation (34) can be represented as a matrix, for example as equation (35). Here, $\vec{A}(\omega, \theta_s)=[\vec{a}(\omega, \theta_s), \vec{a}(\omega, \theta_{N1}), \vec{a}(\omega, \theta_{NB})]$ $$\vec{W}^H(\omega, \theta_s)\vec{A}(\omega, \theta_s)=\vec{F} \tag{35}$$

where $$\vec{F}=[f_s(\omega), f_{N1}(\omega), \ldots, f_{NB}(\omega)]$$

Taking into consideration the constraint conditions that (1) the filter passes sounds from the target direction $\theta_s$ in all frequency bands and that (2) the filter suppresses sounds from B known null directions $\theta_{N1}, \theta_{N2}, \ldots, \theta_{NB}$ in all frequency bands, ideally $f_s(\omega)=1.0$ and $f_i(\omega)=0.0$ ($i \in \{N1, N2, \ldots, NB\}$) should be set. This means that the filter completely passes sounds in all frequency bands from the target direction $\theta_s$ and completely blocks sounds in all frequency bands from B known null directions $\theta_{N1}, \theta_{N2}, \ldots, \theta_{NB}$. In reality, however, it is difficult in some situations to effect such control as completely passing all frequency bands or completely blocking all frequency bands. In such a case, the absolute value of $f_s(\omega)$ is set to a value close to 1.0 and the absolute value of $f_i(\omega)$ ($i \in \{N1, N2, \ldots, NB\}$) is set to a value close to 0.0. Of course, $f_i(\omega)$ and $f_j(\omega)$ ($i \neq j$; i and $j \in \{N1, N2, \ldots, NB\}$) may be the same or different.

According to the filter design method described here, the filter $\vec{W}(\omega, \theta_s)$ that is an optimum solution of equation (7) under the constraint condition given by equation (35) can be given by equation (36) (see Reference 3 listed below).

$$\vec{W}(\omega, \theta_s)=Q^{-1}(\omega)\vec{A}(\omega, \theta_s)(\vec{A}^H(\omega, \theta_s)Q^{-1}(\omega)\vec{A}(\omega, \theta_s))^{-1}\vec{F} \tag{36}$$

<4> Filter Design Method Using Delay-And-Sum Beam forming

As apparent from equation (2), assuming that direct and reflected sounds that arrive are plane waves, then a filter $\vec{W}(\omega, \theta_s)$ can be given by equation (37). That is, the filter $\vec{W}(\omega, \theta_s)$ can be obtained by normalizing a transmission characteristic $\vec{a}(\omega, \theta_s)$. The transmission characteristic $\vec{a}(\omega, \theta_s)=[a_1(\omega, \theta_s), \ldots, a_M(\omega, \theta_s)]^T$ can be given by equation (17a) (to be precise, by equation (17a) where $\theta$ is replaced with $\theta_s$). The filter design method does not necessarily achieve a high filtering accuracy but requires only a small quantity of computation.

$$\vec{W}(\omega, \theta_s) = \frac{\vec{a}(\omega, \theta_s)}{\vec{a}^H(\omega, \theta_s)\vec{a}(\omega, \theta_s)} \tag{37}$$

<5> Filter Design Method Using Maximum Likelihood Method

By excluding spatial information concerning sounds from a target direction from a spatial correlation matrix $Q(\omega)$ in the MVDR method described earlier, flexibility of suppression of noise can be improved and the power of noise can be further suppressed. Therefore, in the filter design method described here, the spatial correlation matrix $Q(\omega)$ is written as the second term of the right-hand side of equation (10a), that is, equation (10c). A filter $\vec{W}(\omega, \theta_s)$ can be given by equation (9) or (36). Here, $Q(\omega)$ included in equatione (9) and (36) or $R_{xx}(\omega)=Q(\omega)$ included in equatione (30) and (33) is a spatial correlation matrix given by equation (10c).

$$Q(\omega) = \sum_{p\in\{1,\cdots,P-1\}} \vec{a}(\omega, \theta_p)\vec{a}^H(\omega, \theta_p) \tag{10c}$$

<6> Filter Design Method Using AMNOR Method

The AMNOR method obtains a filter that allows some amount of decay D of a sound from a target direction by trading off the amount of decay D of the sound from the target direction against the power of noise remaining in a filter output signal (for example, the amount of decay D is maintained at a certain threshold D^ or less) and, when a mixed signal of [a] a signal produced by applying transfer functions between a sound source and microphones to a virtual signal from a target direction (hereinafter referred to as the virtual target signal) and [b] noise (obtained by observation with M microphones in a noisy environment without a sound from the target direction) is input, outputs a filter output signal that reproduces best the virtual target signal in terms of least squares error (that is, the power of noise contained in a filter output signal is minimized). According to the AMNOR method, a filter $\vec{W}(\omega, \theta_s)$ can be given by equation (38) (see Reference 4 listed below). Here, $R_{ss}(\omega)$ can be given by equation (26) and $R_{nn}(\omega)$ can be given by equation (27). Transfer functions $\vec{a}(\omega, \theta)=[a_1(\omega, \theta_s), \ldots, a_M(\omega, \theta_s)]^T$ can be given by equation (17a) (to be precise, by equation (17a) where $\theta$ is replaced with $\theta_s$).

$$\vec{W}(\omega, \theta_s)=P_s\vec{a}(\omega, \theta_s)(R_{nn}(\omega)+P_sR_{ss}(\omega))^{-1} \tag{38}$$

$P_s$ is a coefficient that assigns a weight to the level of the virtual target signal and called the virtual target signal level. The virtual target signal level $P_s$ is a constant that is not dependent on frequencies. The virtual target signal level $P_s$ may be determined empirically or may be determined so that the difference between the amount of decay D of a sound from the target direction and the threshold $\hat{D}$ is within an arbitrarily predetermined error margin. The latter case will be described. The frequency response $F(\omega)$ of the filter $\vec{W}(\omega, \theta_s)$ to a sound from a target direction $\theta_s$ in the AMNOR method can be given by equation (39). Let the amount of decay $D(P_s)$ when using the filter $\vec{W}(\omega, \theta_s)$ given by equation (38) be denoted by $D(P_s)$, then the amount of decay $D(P_s)$ can be defined by equation (40). Here, $\omega_0$ represents the upper limit of frequency $\omega$ (typically, a higher-frequency adjacent to a discrete frequency $\omega$). The amount of decay $D(P_s)$ is a monotonically decreasing function of $P_s$. Therefore, a virtual target signal level $P_s$ such that the difference between the amount of decay $D(P_s)$ and the threshold $\hat{D}$ is within an arbitrarily predetermined error margin can be obtained by repeatedly obtaining the amount of decay $D(P_s)$ while changing $P_s$ with the monotonicity of $D(P_s)$.

$$F(\omega) = \vec{W}^H(\omega, \theta_s)\vec{a}(\omega, \theta_s) \tag{39}$$

$$D(P_s) = \frac{1}{2\omega_0}\int_{-\omega_0}^{\omega_0} |1 - F(\omega)|^2 \, d\omega \tag{40}$$

<Variation>

In the foregoing description, the spatial correlation matrices $Q(\omega)$, $R_{ss}(\omega)$ and $R_{nn}(\omega)$ are expressed using transfer functions. However, the spatial correlation matrices $Q(\omega)$, $R_{ss}(\omega)$ and $R_{nn}(\omega)$ can also be expressed using the frequency-domain signals $\vec{X}(\omega, k)$ described earlier. While the spatial correlation matrix $Q(\omega)$ will be described below, the following description applies to $R_{ss}(\omega)$ and $R_{nn}(\omega)$ as well. ($Q(\omega)$ can be replaced with $R_{ss}(\omega)$ or $R_{nn}(\omega)$). The spatial correlation matrix $R_{ss}(\omega)$ can be obtained using frequency-domain representations of analog signals obtained by observation with a microphone array (including M microphones) in an environment where only sounds from a target direction exist. The spatial correlation matrix $R_{nn}(\omega)$ can be obtained using frequency-domain representations of an analog signal obtained by observation with a microphone array (including M microphones) in an environment where no sounds from a target direction exist (that is, a noisy environment).

The spatial correlation matrix $Q(\omega)$ using frequency domain signals $\vec{X}(\omega, k)=[X_1(\omega, k), \ldots, X_M(\omega, k)]^T$ can be given by equation (41). Here, the operator $E[\bullet]$ represents a statistical averaging operation. When viewing a discrete time series of an analog signal received with a microphone array (including M microphones) as a stochastic process, the operator $E[\bullet]$ represents a arithmetic mean value (expected value) operation if the stochastic process is a so-called wide-sense stationary process or a second-order stationary process. In this case, the spatial correlation matrix $Q(\omega)$ can be given by equation (42) using frequency-domain signals $\vec{X}(\omega, k-i)$ ($i=0, 1, \ldots, \zeta-1$) of a total of $\zeta$ current and past frames stored in a memory, for example. When $i=0$, a k-th frame is the current frame. Note that the spatial correlation matrix $Q(\omega)$ given by equation (41) or (42) may be recalculated for each frame or may be calculated at regular or irregular interval, or may be calculated before implementation of an embodiment, which will be described later (especially when $R_{ss}(\omega)$ or $R_{nn}(\omega)$ is used in filter design, the spatial correlation matrix $Q(\omega)$ is preferably calculated beforehand by using frequency-domain signals obtained before implementation of the embodiment). If the spatial correlation matrix $Q(\omega)$ is recalculated for each frame, the spatial correlation matrix $Q(\omega)$ depends on the current and past frames and therefore the spatial correlation matrix will be explicitly represented as $Q(\omega, k)$ as in equatione (41a) and (42a).

$$Q(\omega) = E\left[\vec{X}(\omega, k)\vec{X}^H(\omega, k)\right] \tag{41}$$

$$Q(\omega) = \sum_{i=0}^{\zeta-1} \vec{X}(\omega, k-i)\vec{X}^H(\omega, k-i) \tag{42}$$

$$Q(\omega, k) = E\left[\vec{X}(\omega, k)\vec{X}^H(\omega, k)\right] \tag{41a}$$

$$Q(\omega, k) = \sum_{i=0}^{\zeta-1} \vec{X}(\omega, k-i)\vec{X}^H(\omega, k-i) \tag{42a}$$

If the spatial correlation matrix $Q(\omega, k)$ represented by equation (41a) or (42a) is used, the filter $\vec{W}(\omega, \theta_s)$ also depends on the current and past frames and therefore is explicitly represented as $\vec{W}(\omega, \theta_s, k)$. Then, a filter $\vec{W}(\omega, \theta_s)$ represented by any of equatione (9), (29), (30), (33), (36) and (38) described with the filter design methods described above is rewritten as equatione (9m), (29m), (30m), (33m), (36m) or (38m).

$$\vec{W}(\omega, \theta_s, k) = \frac{Q^{-1}(\omega, k)\vec{a}(\omega, \theta_s)}{\vec{a}^H(\omega, \theta_s)Q^{-1}(\omega, k)\vec{a}(\omega, \theta_s)} \tag{9m}$$

$$\vec{W}(\omega, \theta_s, k) = R_{nn}^{-1}(\omega, k)\vec{a}(\omega, \theta_s) \tag{29m}$$

$$\vec{W}(\omega, \theta_s, k) = R_{xx}^{-1}(\omega, k)\vec{a}(\omega, \theta_s) \tag{30m}$$

$$\vec{W}(\omega, \theta_s, k) = R_{xx}^{-1}(\omega, k)\vec{G} \tag{33m}$$

$$\vec{W}(\omega, \theta_s, k) = Q^{-1}(\omega, k)\vec{A}(\omega, \theta_s)\left(\vec{A}^H(\omega, \theta_s)Q^{-1}(\omega, k)\vec{A}(\omega, \theta_s)\right)^{-1}\vec{F} \tag{36m}$$

$$\vec{W}(\omega, \theta_s, k) = P_s\vec{a}(\omega, \theta_s)(R_{nn}(\omega, k) + P_sR_{ss}(\omega, k))^{-1} \tag{38m}$$

<<First Embodiment of Sharp Directive Sound Enhancement Technique>>

Figure 7:
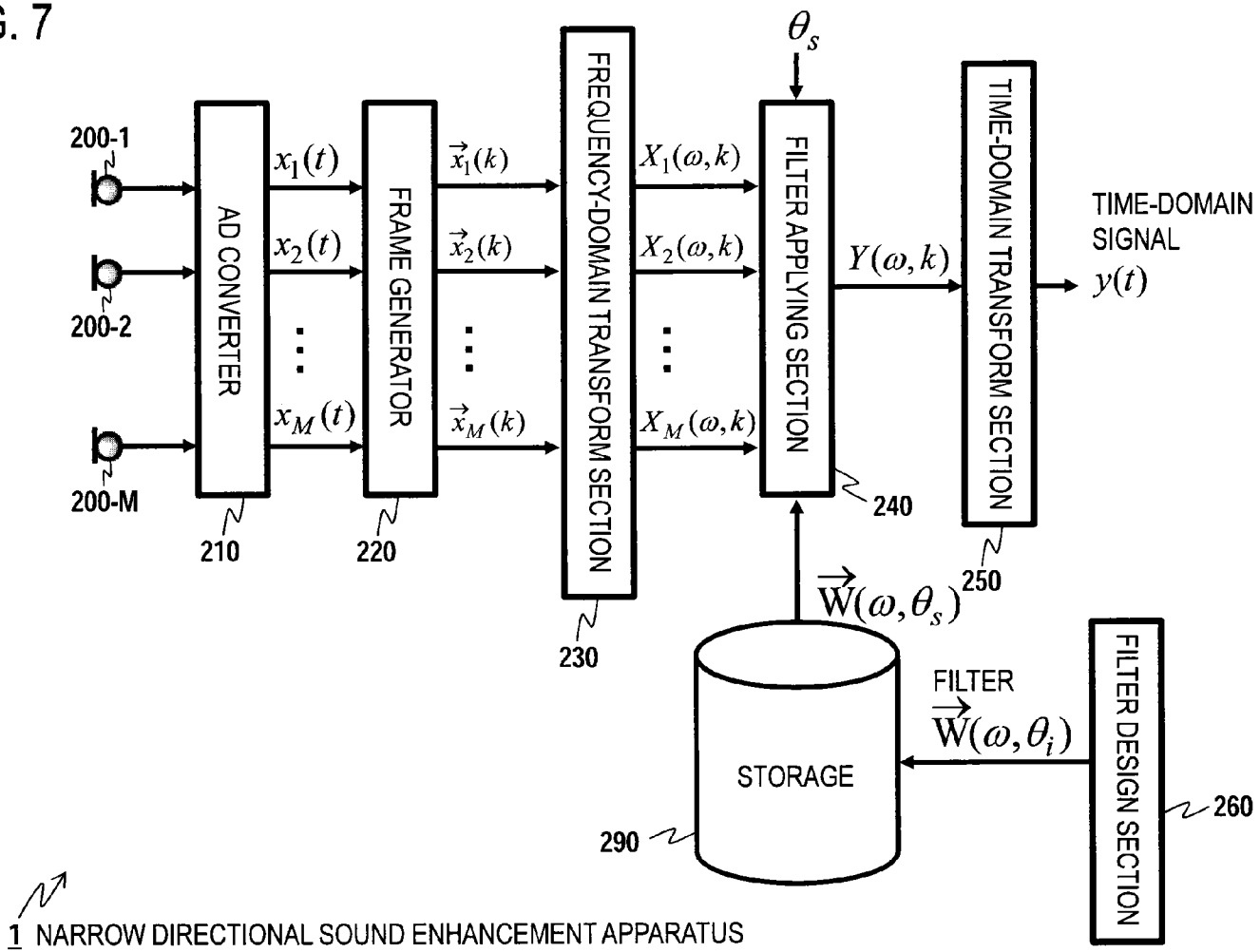
FIG. 7 is a diagram illustrating a functional configuration of a sharp directive sound enhancement apparatus (first embodiment)
Figure 8:
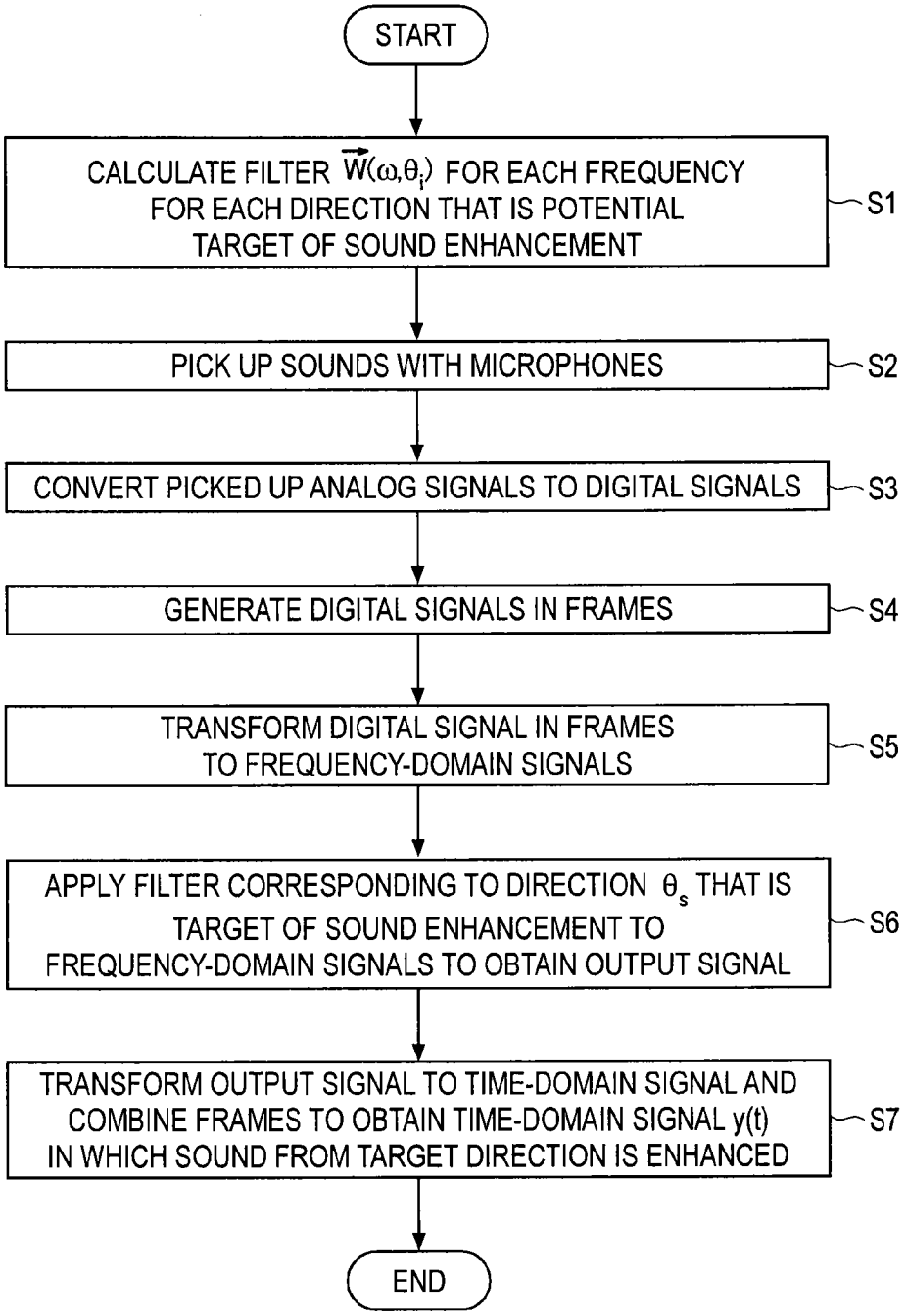
FIG. 8 is a diagram illustrating a procedure of a sharp directive sound enhancement method (first embodiment)

FIGS. 7 and 8 illustrate a functional configuration and a process flow of a first embodiment of a sharp directive sound enhancement technique of the present invention. A sound enhancement apparatus 1 of the first embodiment (hereinafter referred to as the sharp directive sound enhancement apparatus) includes an AD converter 210, a frame generator 220, a frequency-domain transform section 230, a filter applying section 240, a time-domain transform section 250, a filter design section 260, and storage 290.

[Step S1]

The filter design section 260 calculates beforehand a filter $\vec{W}(\omega, \theta_i)$ for each frequency for each of discrete directions from which sounds to be enhanced can arrive. The filter design section 260 calculates filters $\vec{W}(\omega, \theta_1), \ldots, \vec{W}(\omega, \theta_i), \ldots, \vec{W}(\omega, \theta_I)$ ($1 \leq i \leq I$, $\omega \in \Omega$; i is an integer and $\Omega$ is a set of frequencies $\omega$), where I is the total number of discrete directions from which sounds to be enhanced can arrive (I is a predetermined integer greater than or equal to 1 and satisfies $I \leq P$).

To do so, transfer functions $\vec{a}(\omega, \theta_i)=[a_1(\omega, \theta_i), \ldots, a_M(\omega, \theta_i)]^T$ ($1 \leq i \leq I$, $\omega \in \Omega$) need to be obtained except for the case of <Variation> described above. Transmission characteristic $\vec{a}(\omega, \theta_i)=[a_1(\omega, \theta_i), \ldots, a_M(\omega, \theta_i)]^T$ can be calculated practically according to equation (17a) (to be precise, by equation (17a) where $\theta$ is replaced with $\theta_i$) on the basis of the arrangement of the microphones in the microphone array and environmental information such as the positional relation of reflective objects such as a reflector, floor, walls, or ceiling to the microphone array, the arrival time difference between a direct sound and a $\xi$-th reflected sound ($1 \leq \xi \leq \Xi$), and the acoustic reflectance of the reflective object. Note that if the <3> filter design method using MVDR with one or more null directions as constraint condition is used, the indices i of the directions used for calculating the transfer functions $\vec{a}(\omega, \theta_i)$ ($1 \leq i \leq I$, $\omega \in \Omega$) preferably cover all of indices N1, N2, . . . , NB of directions of at least B null directions. In other words, indices N1, N2, . . . , NB of the directions of B null directions are set to any of different integers greater than or equal to 1 and less than or equal to I.

The number $\Xi$ of reflected sounds is set to an integer that satisfies $1 \leq \Xi$. The number $\Xi$ is not limited and can be set to an appropriate value according to the computational capacity and other factors. If one reflector is placed near the microphone array, the transfer functions $\vec{a}(\omega, \theta_i)$ can be calculated practically according to equation (17b) (to be precise, by equation (17b) where $\theta$ is replaced with $\theta_i$).

To calculate steering vectors, equatione (14a), (14b), (18a), (18b), (18d) or (18d), for example, can be used. Note that transfer functions obtained by actual measurements in a real environment, for example, may be used for designing the filters instead of using equatione (17a) and (17b).

Then, $\vec{W}(\omega, \theta_i)$ ($1 \leq i \leq I$) is obtained according to any of equatione (9), (29), (30), (33), (36), (37) and (38), for example, using the transfer functions $\vec{a}(\omega, \theta_i)$, except for the case described in <Variation>. Note that if equation (9), (30), (33) or (36) is used, the spatial correlation matrix $Q(\omega)$ (or $R_{xx}(\omega)$) can be calculated according to equation (10b), except for the case described with respect to <5> the filter design method using the maximum likelihood method. If equation (9), (30), (33) or (36) is used according to <5> the filter design method using the maximum likelihood method described earlier, the spatial correlation matrix $Q(\omega)$ (or $R_{xx}(\omega)$) can be calculated according to equation (10c). If equation (29) is used, the spatial correlation matrix $R_{nn}(\omega)$ can be calculated according to equation (27). $I \times |\Omega|$ filters $\vec{W}(\omega, \theta_i)$ ($1 \leq i \leq I$, $\omega \in \Omega$) are stored in the storage 290, where $|\Omega|$ represents the number of the elements of the set $\Omega$.

[Step S2]

The M microphones 200-1, . . . , 200-M making up the microphone array are used to pick up sounds, where M is an integer greater than or equal to 2.

There is no restraint on the arrangement of the M microphones. However, a two- or three-dimensional arrangement of the M microphones has the advantage of eliminating uncertainty of a direction from which sounds to be enhanced arrive. That is, a planar or steric arrangement of the microphones can avoid the problem with a horizontal linear arrangement of the M microphones that a sound arriving from a front direction cannot be distinguished from a sound arriving from right above, for example. In order to provide a wide range of directions that can be set as sound-pickup directions, each microphone preferably has a directivity capable of picking up sounds with a certain level of sound pressure in potential target directions $\theta_s$ which are sound-pickup directions. Accordingly, microphones having relatively weak directivity, such as omnidirectional microphones or unidirectional microphones are preferable.

[Step S3]

The AD converter 210 converts analog signals (pickup signals) picked up with the M microphones 200-1, . . . , 200-M to digital signals $\vec{x}(t)=[x_1(t), \ldots, X_M(t)]^T$, where t represents the index of a discrete time.

[Step S4]

The frame generator 220 takes inputs of the digital signals $\vec{x}(t)=[x_1(t), \ldots, x_M(t)]^T$ output from the AD converter 210, stores N samples in a buffer on a channel by channel basis, and outputs digital signals $\vec{x}(k)=[\vec{x}_1(k), \ldots, \vec{x}_M(k)]^T$ in frames, where k is an index of a frame-time number and $\vec{x}_m(k)$ $[x_m((k-1)N+1), \ldots, x_m(kN)]$ ($1 \leq m \leq M$). N depends on the sampling frequency and 512 is appropriate for sampling at 16 kHz.

[Step S5]

The frequency-domain transform section 230 transforms the digital signals $x \rightarrow (k)$ in frames to frequency-domain signals $\vec{X}(\omega, k)=[X_1(\omega, k), \ldots, X_M(\omega, k)]^T$ and outputs the frequency-domain signals, where $\omega$ is an index of a discrete frequency. One way to transform a time-domain signal to a frequency-domain signal is fast discrete Fourier transform. However, the way to transform the signal is not limited to this. Other method for transforming to a frequency domain signal may be used. The frequency-domain signal $\vec{X}(\omega, k)$ is output for each frequency $\omega$ and frame k at a time.

[Step S6]

The filter applying section 240 applies the filter $W \rightarrow (\omega, \theta_s)$ corresponding to a target direction $\theta_s$ to be enhanced to the frequency-domain signal $\vec{X}(\omega, k)=[X_1(\omega, k), \ldots, X_m(\omega, k)]^T$ in each frame k for each frequency $\omega \in \Omega$ and outputs an output signal $Y(\omega, k, \theta_s)$ (see equation (43)). The index s of the target direction $\theta_s$ is $s \in \{1, \ldots, I\}$ and the filters $\vec{W}(\omega, \theta_s)$ are stored in the storage 290. Therefore, the filter applying section 240 only has to retrieve the filter $\vec{W}(\omega, \theta_s)$ that corresponds to the target direction $\theta_s$ to be enhanced from the storage 290. If the index s of the target direction $\theta_s$ does not belong to the set $\{1, \ldots, I\}$, that is, the filter $\vec{W}(\omega, \theta_s)$ that corresponds to the target direction $\theta_s$ has not been calculated in the process at step S1, the filter design section 260 may calculate at this moment the filter $\vec{W}(\omega, \theta_s)$ that corresponds to the target direction $\theta_s$ or a filter $\vec{W}(\omega, \theta_{s'})$ that corresponds to a direction $\theta_{s'}$ close to the target direction $\theta_s$ may be used.

$$Y(\omega, k, \theta_s)=\vec{W}^H(\omega, \theta_s)\vec{X}(\omega, k) \ \forall \omega \in \Omega \tag{43}$$

[Step S7]

The time-domain transform section 250 transforms the output signal $Y(\omega, k, \theta_s)$ of each frequency $\omega \in \Omega$ in a k-th frame to a time domain to obtain a time-domain frame signal y(k) in the k-th frame, then combines the obtained frame time-domain signals y(k) in the order of frame-time number index, and outputs a time-domain signal y(t) in which the sound from the target direction $\theta_s$ is enhanced. The method for transforming a frequency-domain signal to a time-domain signal is inverse transform of the transform used in the process at step S5 and may be fast discrete inverse Fourier transform, for example.

While the first embodiment has been described here in which the filters $\vec{W}(\omega, \theta_i)$ are calculated beforehand in the process at step S1, the filter design section 260 may calculate the filter $\vec{W}(\omega, \theta_i)$ for each frequency after the target direction $\theta_s$ is determined, depending on the computational capacity of the sharp directive sound enhancement apparatus 1.

<<Second Embodiment of Sharp Directive Sound Enhancement Technique>>

Figure 10:
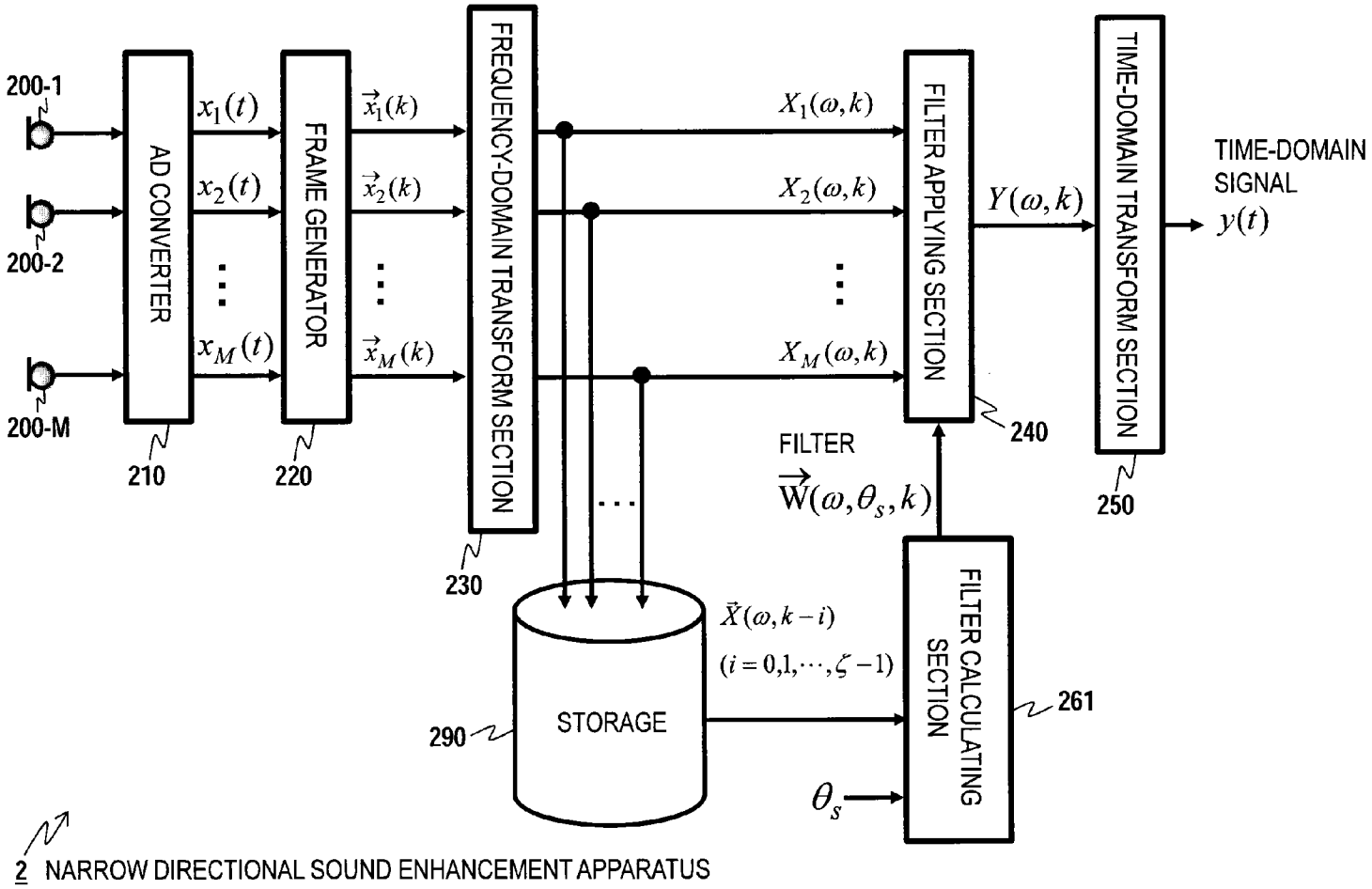
FIG. 10 is a diagram illustrating a functional configuration of a sharp directive sound enhancement apparatus (second embodiment)
Figure 11:
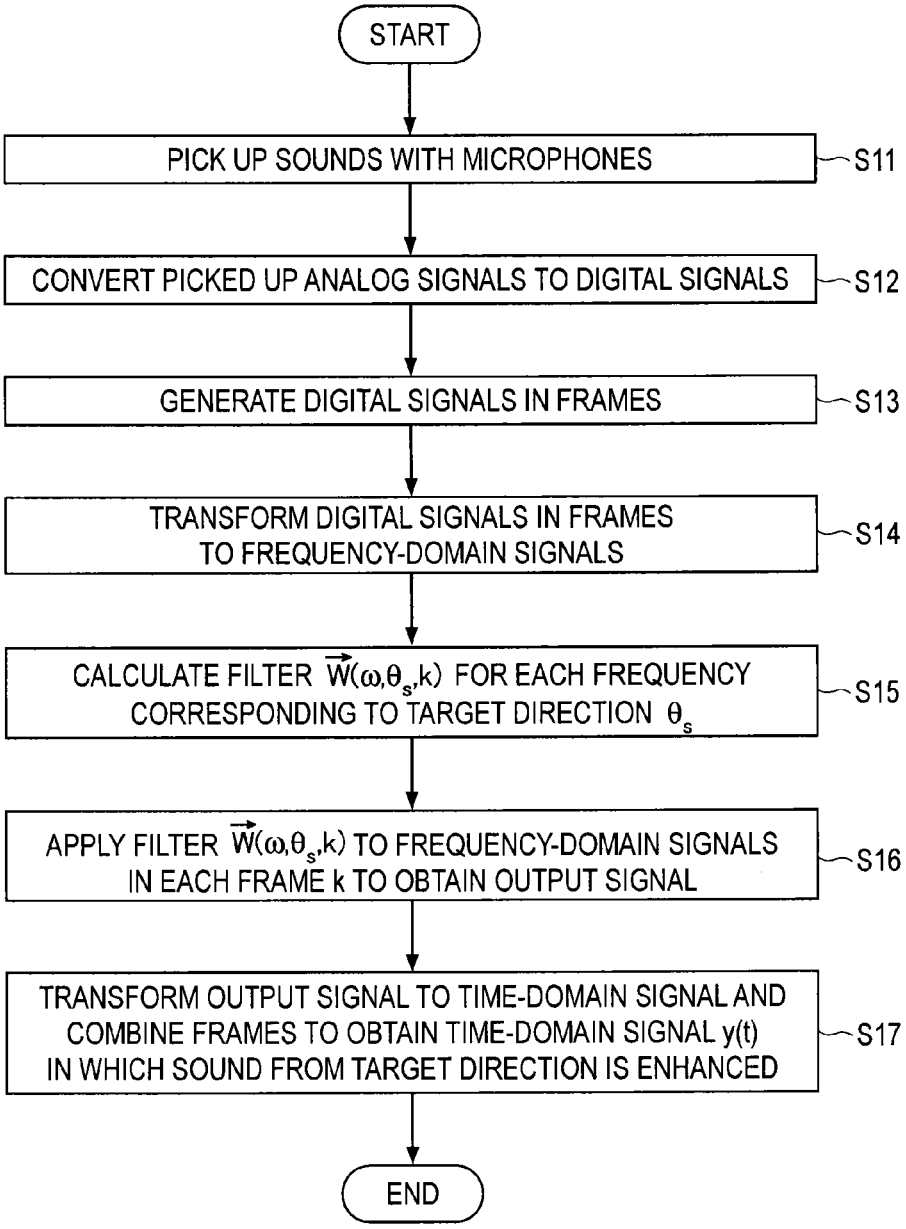
FIG. 11 is a diagram illustrating a procedure of a sharp directive sound enhancement method (second embodiment)

FIGS. 10 and 11 illustrate a functional configuration and a process flow of a second embodiment of a sharp directive sound enhancement technique of the present invention. A sharp directive sound enhancement apparatus 2 of the second embodiment includes an AD converter 210, a frame generator 220, a frequency-domain transform section 230, a filter applying section 240, a time-domain transform section 250, a filter calculating section 261, and a storage 290.

[Step S11]

M microphones 200-1, . . . , 200-M making up a microphone array is used to pick up sounds, where M is an integer greater than or equal to 2. The arrangement of the M microphones is as described in the first embodiment.

[Step S12]

The AD converter 210 converts analog signals (pickup signals) picked up with the M microphones 200-1, . . . , 200-M to digital signals $\vec{x}(t)=[x_1(t), \ldots, x_M(t)]^T$, where t represents the index of a discrete time.

[Step S13]

The frame generator 220 takes inputs of the digital signals $\vec{x}(t)=[x_1(t), \ldots, x_M(t)]^T$ output from the AD converter 210, stores N samples in a buffer on a channel by channel basis, and outputs digital signals $\vec{x}(k)=[\vec{x}_1(k), \ldots, \vec{x}_M(k)]^T$ in frames, where k is an index of a frame-time number and $\vec{x}_m(k)$ $[x_m((k-1)N+1), \ldots, x_m(kN)]$ $(1 \le m \le M)$. N depends on the sampling frequency and 512 is appropriate for sampling at 16 kHz.

[Step S14]

The frequency-domain transform section 230 transforms the digital signals $\vec{x}(k)$ in frames to frequency-domain signals $\vec{X}(\omega, k)=[X_1(\omega, k), \ldots, X_M(\omega, k)]^T$ and outputs the frequency-domain signals, where ω is an index of a discrete frequency. One way to transform a time-domain signal to a frequency-domain signal is fast discrete Fourier transform. However, the way to transform the signal is not limited to this. Other method for transforming to a frequency domain signal may be used. The frequency-domain signal $\vec{X}(\omega, k)$ is output for each frequency ω and frame k at a time.

[Step S15]

The filter calculating section 261 calculates the filter $\vec{W}(\omega, \theta_s, k)$ ($\omega \in \Omega$; Ω is a set of frequencies ω) that corresponds to the target direction $\theta_s$ to be used in a current k-th frame.

To do so, transfer functions $\vec{a}(\omega, \theta_s)=[a_1(\omega, \theta_s), \ldots, a_M(\omega, \theta_s)]^T$ ($\omega \in \Omega$) need to be provided. Transfer functions $\vec{a}(\omega, \theta_s)=[a_1(\omega, \theta_s), \ldots, a_M(\omega, \theta_s)]^T$ can be calculated practically according to equation (17a) (to be precise, by equation (17a) where θ is replaced with $\theta_s$) on the basis of the arrangement of the microphones in the microphone array and environmental information such as the positional relation of reflective objects such as a reflector, floor, walls, or ceiling to the microphone array, the arrival time difference between a direct sound and a ξ-th reflected sound ($1 \le \xi \le \Xi$), and the acoustic reflectance of the reflective object. Note that if <3> the filter design method using MVDR with one or more null directions as a constraint condition is used, transfer functions $\vec{a}(\omega, \theta_{Nj})$ ($1 \le j \le B$, $\omega \in \Omega$) also need to be obtained. The transfer functions can be calculated practically according to equation (17a) (to be precise, by equation (17a) where θ is replaced with $\theta_{Nj}$) on the basis of the arrangement of the microphones in the microphone array and environmental information such as the positional relation of reflective objects such as a reflector, a floor, a wall, or ceiling to the microphone array, the arrival time difference between a direct sound and a ξ-th reflected sound ($1 \le \xi \le \Xi$), and the acoustic reflectance of the reflective object.

The number Ξ of reflected sounds is set to an integer that satisfies $1 \le \Xi$. The number Ξ is not limited and can be set to an appropriate value according to the computational capacity and other factors. If one reflector is placed near the microphone array, the transfer functions $\vec{a}(\omega, \theta_s)$ can be calculated practically according to equation (17b) (to be precise, by equation (17b) where θ is replaced with $\theta_s$). In this case, transfer functions $\vec{a}(\omega, \theta_{Nj})$ ($1 \le j \le B$, $\omega \in \Omega$) can be practically calculated according to equation (17b) (to be precise, by equation (17b) where θ is replaced with $\theta_{Nj}$).

To calculate steering vectors, equatione (14a), (14b), (18a), (18b), (18c) or (18d), for example, can be used. Note that transfer functions obtained by actual measurements in a real environment, for example, may be used for designing the filters instead of using equatione (17a) and (17b).

Then, the filter calculating section 261 calculates filters $\vec{W}(\omega, \theta_s, k)$ ($\omega \in \Omega$) according to any of equatione (9m), (29m)m (30m), (33m), (36m) and (38m) using the transfer functions $\vec{a}(\omega, \theta_s)$ ($\omega \in \Omega$) and, if needed, the transfer functions $\vec{a}(\omega, \theta_{Nj})$ ($1 \le j \le B$, $\omega \in \Omega$). Note that the spatial correlation matrix Q(ω) (or $R_{xx}(\omega)$) can be calculated according to equation (41a) or (42a). In the calculation of the spatial correlation matrix Q(ω), frequency-domain signals $\vec{X}(\omega, k-i)$ ($i=0, 1, \ldots, \zeta-1$) of a total of ζ current and past frames stored in the storage 290, for example, are used.

[Step S16]

The filter applying section 240 applies the filter $\vec{W}(\omega, \theta_s, k)$ corresponding to a target direction $\theta_s$ to be enhanced to the frequency-domain signal $\vec{X}(\omega, k)=[X_1(\omega, k), \ldots, X_M(\omega, k)]^T$ in each frame k for each frequency $\omega \in \Omega$ and outputs an output signal $Y(\omega, k, \theta_s)$ (see equation (44)).

$$Y(\omega, k, \theta_s)=\vec{W}^H(\omega, \theta_s, k)\vec{X}(\omega, k) \ \forall \omega \in \Omega \tag{44}$$

[Step S17]

The time-domain transform section 250 transforms the output signal $Y(\omega, k, \theta_s)$ of each frequency $\omega \in \Omega$ of a k-th frame to a time domain to obtain a time-domain frame signal y(k) in the k-th frame, then combines the obtained frame time-domain signals y(k) in the order of frame-time number index, and outputs a time-domain signal y(t) in which the sound from the target direction $\theta_s$ is enhanced. The method for transforming a frequency-domain signal to a time-domain signal is inverse transform of the transform method used in the process at step S14 and may be fast discrete inverse Fourier transform, for example.

[Experimental Example of Sharp Directive Sound Enhancement Technique]

Figure 9:
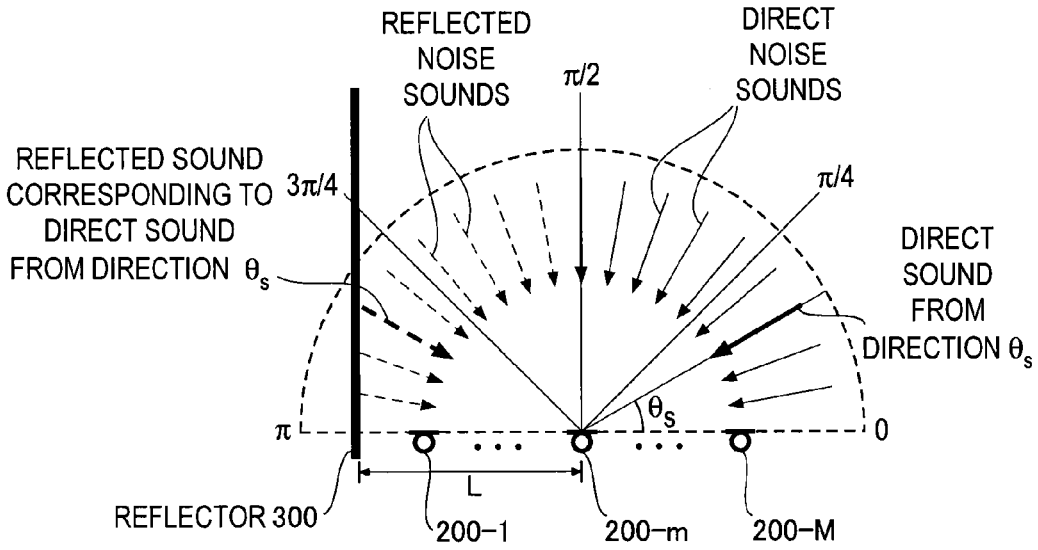
FIG. 9 is a diagram illustrating a configuration of a first example.

Results of an experiment on the first embodiment of the sharp directive sound enhancement technique of the present invention (the minimum variance distortionless response (MVDR) method under a single constraint condition) will be described. As illustrated in FIG. 9, 24 microphones are arranged linearly and a reflector 300 is placed so that the direction along which the microphones in the linear microphone array is normal to the reflector 300. While there is no restraint on the shape of the reflector 300, a semi-thick rigid planar reflector having a size of 1.0 m×1.0 m was used. The distance between adjacent microphones was 4 cm and the reflectance $\alpha$ of the reflector 300 was 0.8. A target direction $\theta_s$ was set to 45 degrees. On the assumption that sounds would arrive at the linear microphone array as plane waves, transfer functions were calculated according to equation (17b) (see equatione (14a) and (18a)) and the directivities of generated filters were investigated. Two conventional methods (the MVDR method without reflector and the delay-and-sum beam forming method with reflector) were used for comparison with the technique.

Figure 12:
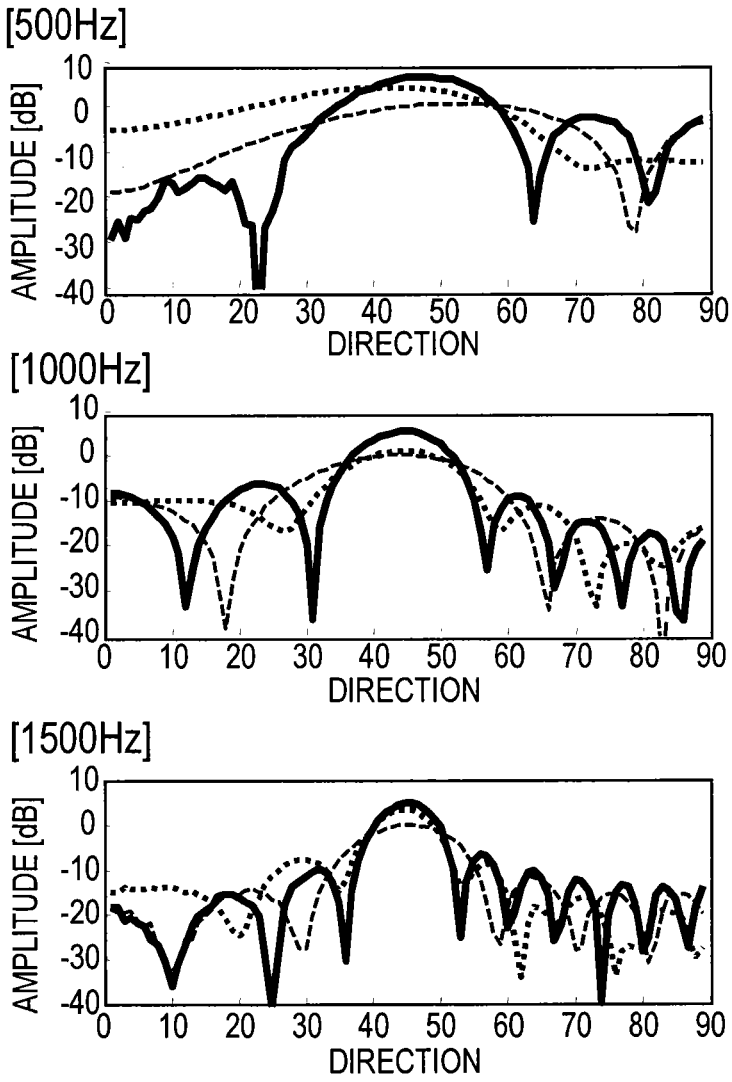
FIG. 12 is a diagram showing results of an experiment on a first example.
Figure 13:
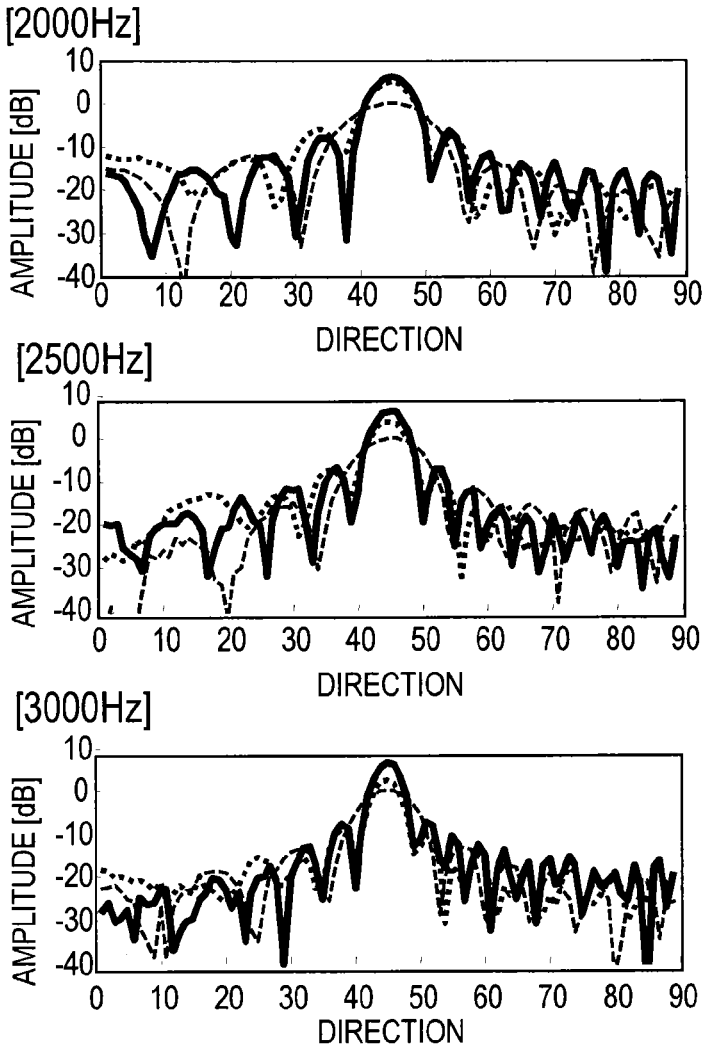
FIG. 13 is a diagram showing results of an experiment on the first example.
Figure 14:
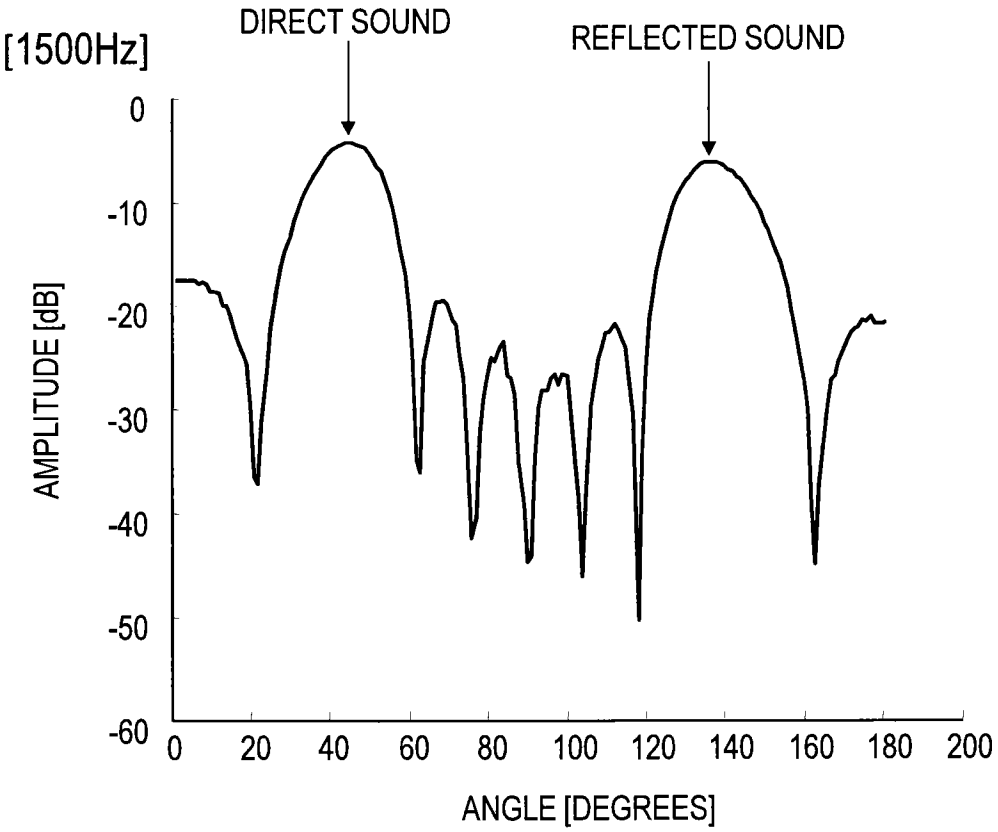
FIG. 14 is a diagram showing directivity with a filter $\vec{W}(\omega, \theta)$ in the first example.

FIGS. 12 and 13 show results of the experiment. It can be seen that first embodiment of the sharp directive sound enhancement technique of the present invention can achieve a sharp directivity in the target direction in all frequency bands as compared with the two conventional methods. It will be understood that the sharp directive sound enhancement technique is effective especially in lower frequency bands. FIG. 14 shows the directivity of filters $\vec{W}(\omega, \theta)$ generated according to first embodiment of the sharp directive sound enhancement technique of the present invention. It can be seen from FIG. 14 that the technique enhances not only direct sounds but also reflected sounds.

Figure 15:
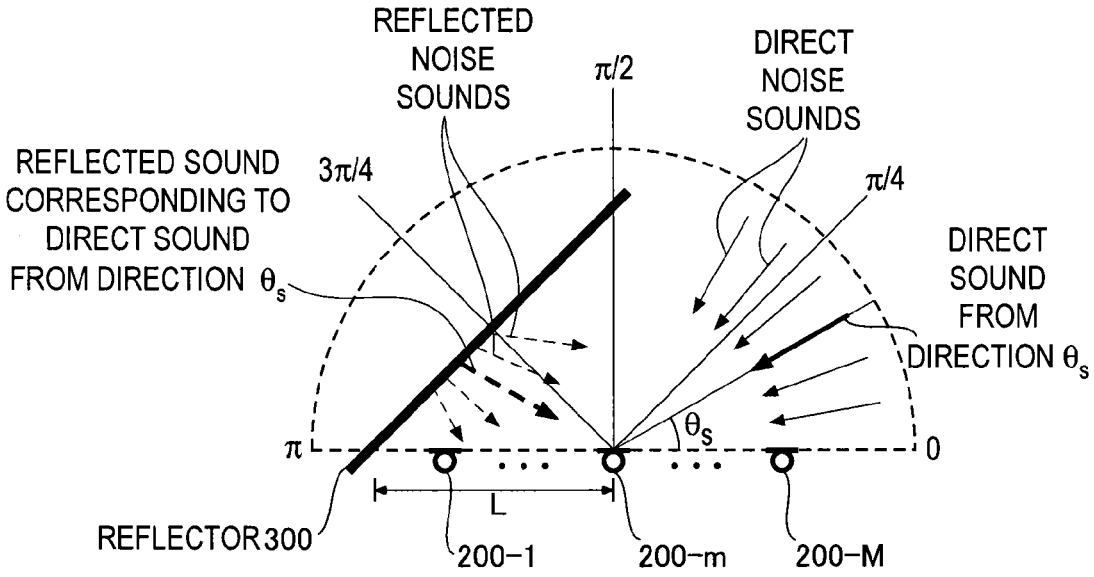
FIG. 15 is a diagram illustrating a configuration of a second example.

The same experiment was conducted with the reflector 300 placed so that the flat surface of the reflector 300 formed an angle of 45 degrees with the direction in which the microphones of the linear microphone array were arranged, as shown in FIG. 15. A target direction $\theta_s$ was set at 22.5 degrees. The other experimental conditions were the same as those in the experiment in which the reflector 300 was placed so that the direction in which the microphones of the linear microphone array were arranged was normal to the reflector 300.

Figure 16:
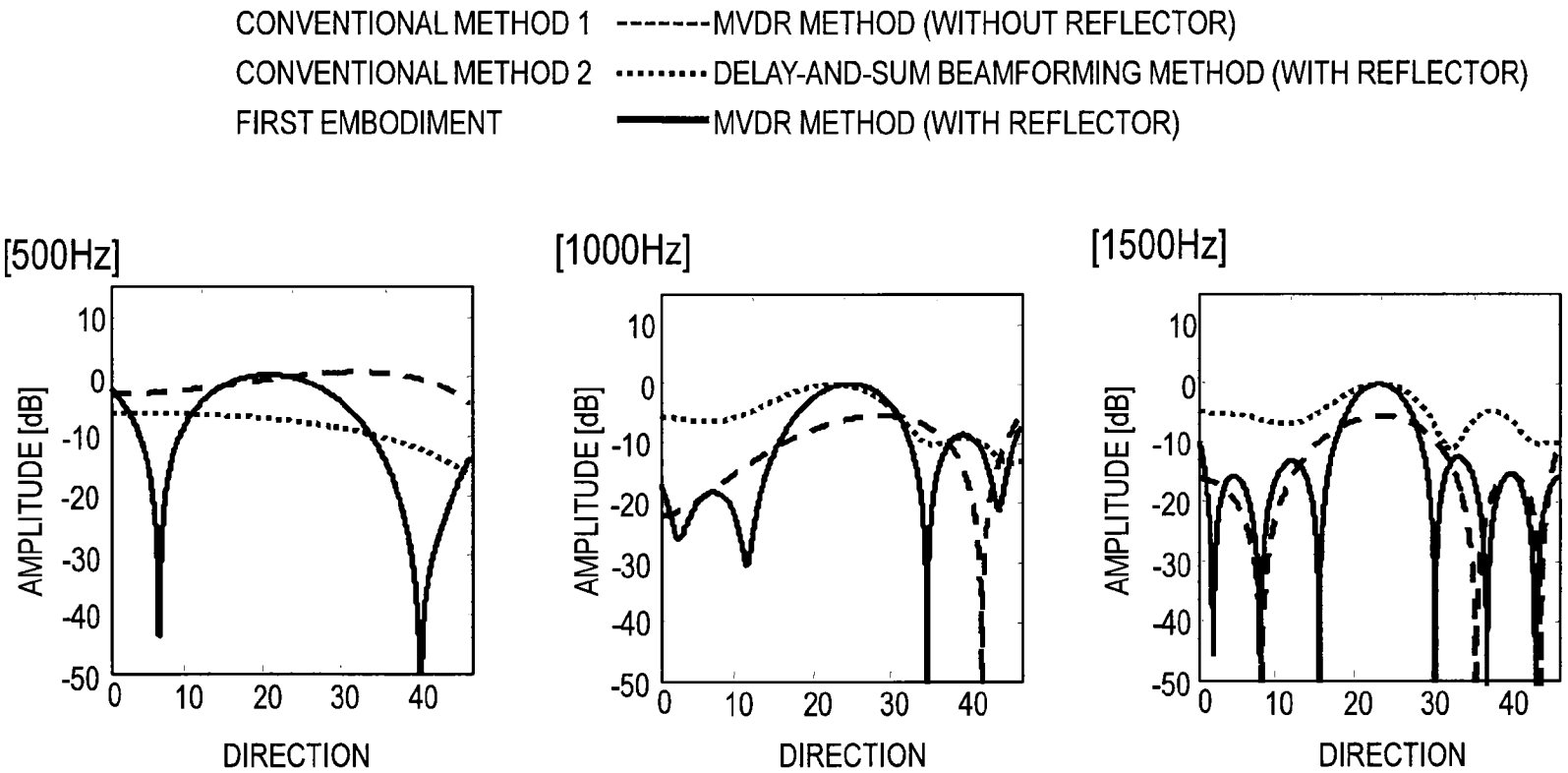
FIG. 16 is a diagram showing results of an experiment on an experimental example.
Figure 17:
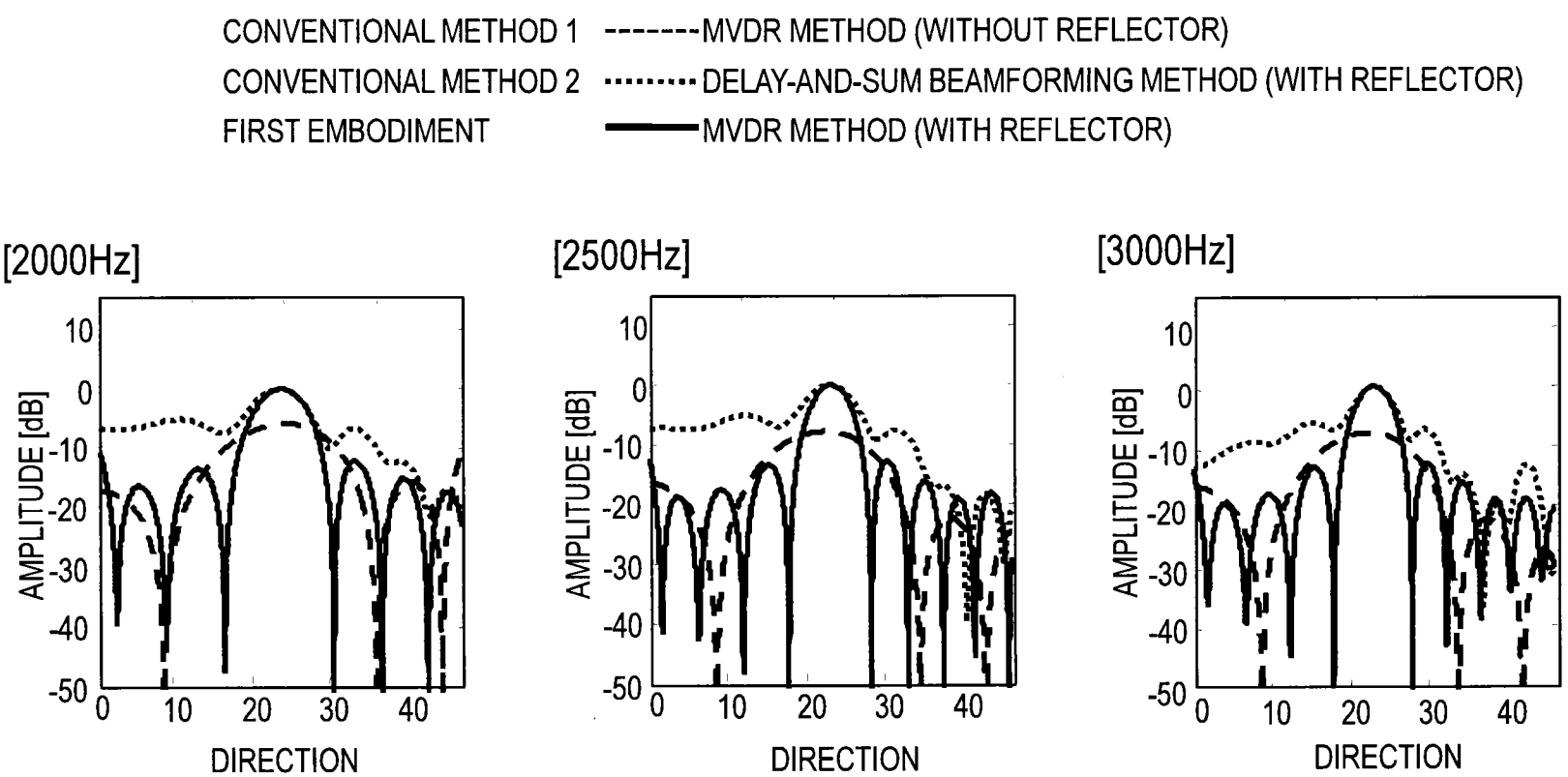
FIG. 17 is a diagram illustrating results of an experiment on an experimental example.

FIGS. 16 and 17 show results of the experiment. It can be seen that the first embodiment of the sharp directive sound enhancement technique of the present invention can achieve a sharp directivity in the target direction in all frequency bands as compared with the two conventional methods. It will be understood that the sharp directive sound enhancement technique is effective especially in lower frequency bands.

<Example Applications>

Figuratively speaking, the sharp directive sound enhancement technique is equivalent to generation of a clear image from an unsharp, blurred image and is useful for obtaining detailed information about an acoustic field. The following is description of examples of services where the sharp directive sound enhancement technique of the present invention is useful.

A first example is creation of contents that are combination of audio and video. The use of an embodiment of the sharp directive sound enhancement technique of the present invention allows the target sound from a great distance to be clearly enhanced even in a noisy environment with noise sounds (sounds other than target sounds). Therefore, for example sounds in a particular area corresponding to a zoomed-in moving picture of a dribbling soccer player that was shot from outside the field can be added to the moving picture.

A second example is an application to a video conference (or an audio teleconference). When a conference is held in a small room, the voice of a human speaker can be enhanced to a certain degree with several microphones according to a conventional technique. However, in a large conference room (for example, a large space where there are human speakers at a distance of 5 m or more from microphones), it is difficult to clearly enhance the voice of a human speaker at a distance with the conventional techniques by the conventional method and a microphone needs to be placed in front of each human speaker. In contrast, the use of an embodiment of the sharp directive sound enhancement technique of the present invention is capable of clearly enhancing sounds from a great distance and therefore enables construction of a video conference system that is usable in a large conference room without having to place a microphone in front of each human speaker.

<<Principle of Sound Spot Enhancement Technique>>

A principle of a sound spot enhancement technique of the present invention will be described below. The sound spot enhancement technique of the present invention is based on the nature of a microphone array technique being capable of following sounds from any direction on the basis of signal processing and positively uses reflected sounds to pick up sounds with a high SN ratio. One feature of the present invention is a combined use of reflected sounds and a signal processing technique that enables a sharp directivity. In particular, one of the remarkable features of the sound spot enhancement technique of the present invention is the use of a reflective object to increase the difference between in transfer functions of different sound sources to a microphone array, in light of the fact that the transfer functions of sound sources located in nearly the same directions from the microphone array but at different distances from the microphone array to the microphone array are very similar to one another. By extracting differences in transmission characteristic through signal processing, a sound spot enhancement technique capable of enhancing sounds according to the distances from the microphone array can be achieved.

Prior to the description, symbols will be defined again. The index of a discrete frequency is denoted by $\omega$ (The index $\omega$ of a discrete frequency may be considered to be an angular frequency $\omega$ because a frequency f and an angular frequency $\omega$ satisfies the relation $\omega=2\pi f$. With regard to $\omega$, the "index of a discrete frequency" may be also sometimes simply referred to as a "frequency") and the index of frame-time number is denoted by k. Frequency-domain representation of a k-th frame of an analog signal received at M microphones is denoted by $\vec{X}(\omega, k)=[X_1(\omega, k), \ldots, X_M(\omega, k)]^T$ and a filter that enhances a frequency-domain signal $\vec{X}(\omega, k)$ of a sound from a sound source assumed to be located in a direction $\theta s$ as viewed from the center of the microphone array at a distance $D_h$ from the center of the microphone array with a frequency $\omega$ is denoted by $\vec{W}(\omega, \theta_s, D_h)$, where M is an integer greater than or equal to 2 and T represents the transpose. It is assumed here that the distance $D_h$ is fixed.

While the "center of a microphone array" can be arbitrarily determined, typically the geometrical center of the array of the M microphones is treated as the "center of a microphone array". In the case of a linear microphone array, for example, the point equidistant from the microphones at the both ends of the array is treated as the "center of the microphone array". In the case of a planar microphone array in which microphones are arranged in a square matrix of m×m ($m^2$=M), for example, the position at which the diagonals linking the microphones at the corners intersect is treated as the "center of the microphone array."

The expression "sound source assumed to be located in . . . " has been used because the actual presence of a sound source at the location is not essential to the sound spot enhancement technique of the present invention. That is, as will be apparent from the later description, the sound spot enhancement technique of the present invention in essence performs signal processing of applying filters to signals represented by frequencies and enables embodiments in which a filter is created beforehand for each discrete distance $D_h$. Accordingly, the actual presence of a sound source at the location is not required even at the stage where the sound spot enhancement processing is actually performed. For example, if a sound source actually exists at a location in a direction $\theta_s$ as viewed from the microphone array and at a distance of $D_h$ from the microphone array at the stage where the sound spot enhancement processing is actually performed, a sound from the sound source can be enhanced by choosing an appropriate filter for the location. If the sound source does not actually exist at the location and if it is assumed that there are no sounds and even no noise at all, a sound enhanced by the filter will be ideally complete silence. However, this is no different from enhancing a "sound arriving from the location".

Under these conditions, a frequency-domain signal $Y(\omega, k, \theta_s, D_h)$ resulting from the enhancement of a frequency-domain signal $\vec{X}(\omega, k)$ of a sound from a sound source assumed to be at a location in a direction $\theta_s$ at a distance of $D_h$ as viewed from the center of the microphone array (hereinafter referred to as a "location $(\theta_s, D_h)$" unless otherwise stated) with frequency $\omega$ can be given by equation (106) (hereinafter the resulting signal is referred to as an output signal).

$$Y(\omega, k, \theta_s, D_h)=\vec{W}^H(\omega, \theta_s, D_h)\vec{X}(\omega, k) \tag{106}$$

where H represents the Hermitian transpose.

The filter $\vec{W}(\omega, \theta_s, D_h)$ may be designed in various ways. A design using minimum variance distortionless response (MVDR) method will be described here. In the MVDR method, a filter $\vec{W}(\omega, \theta_s, D_h)$ is designed so that the power of sounds from directions other than a direction $\theta_s$ (hereinafter sounds from directions other than the direction $\theta_s$ will be also referred to as "noise") is minimized at a frequency $\omega$ by using a spatial correlation matrix $Q(\omega)$ under the constraint condition of equation (108). (see equation (107). It should be noted that the spatial correlation matrix $Q(\omega)$ is specified as $Q(\omega, D_h)$ because it is assumed here that the direction $D_h$ is fixed.) Assuming that a sound source is located in a position $(\theta_s, D_h)$, then $\vec{a}(\omega, \theta_s, D_h)=[a_1(\omega, \theta_s, D_h), \ldots, a_M(\omega, \theta_s, D_h)]^T$ represents transfer functions at a frequency $\omega$ between the sound source and the M microphones. In other words, $\vec{a}(\omega, \theta_s, D_h)=[a_1(\omega, \theta_s, D_h), \ldots, a_M(\omega, \theta_s, D_h)]^T$ represents transfer functions of a sound from the position $(\theta_s, D_h)$ to the microphones included in the microphone array at frequency $\omega$. The spatial correlation matrix $Q(\omega)$ represents the correlation among components $X_1(\omega, k), \ldots, X_M(\omega, k)$ of a frequency-domain signal $\vec{X}(\omega, k)$ at frequency $\omega$ and has $E[X_i(\omega, k)X_j^*(\omega, k)]$ $(1 \le i \le M, 1 \le j \le M)$ as its (i, j) elements. The operator E[•] represents a statistical averaging operation and the symbol * is a complex conjugate operator. The spatial correlation matrix $Q(\omega)$ can be expressed using statistics values of $X_1(\omega, k), \ldots, X_M(\omega, k)$ obtained from observation or may be expressed using transfer functions. The latter case, where the spatial correlation matrix $Q(\omega)$ is expressed using transfer functions, will be described momentarily hereinafter.

$$\min_{\vec{W}(\omega,\theta_s,D_h)} \left\{\vec{W}^H(\omega, \theta_s, D_h)Q(\omega, D_h)\vec{W}(\omega, \theta_s, D_h)\right\} \tag{107}$$

$$\vec{W}^H(\omega, \theta_s, D_h)\vec{a}(\omega, \theta_s, D_h) = 1.0 \tag{108}$$

It is known that the filter $\vec{W}(\omega, \theta_s, D_h)$ which is an optimal solution of equation (107) can be given by equation (109) (see Reference 1 listed later).

$$\vec{W}(\omega, \theta_s, D_h) = \frac{Q^{-1}(\omega, D_h)\vec{a}(\omega, \theta_s, D_h)}{\vec{a}^H(\omega, \theta_s, D_h)Q^{-1}(\omega, D_h)\vec{a}(\omega, \theta_s, D_h)} \tag{109}$$

As will be appreciated from the fact that the inverse matrix of the spatial correlation matrix $Q(\omega, D_h)$ is included in equation (109), the structure of the spatial correlation matrix $Q(\omega, D_h)$ is important for achieving a sharp directivity. It will be appreciated from equation (107) that the power of noise depends on the structure of the spatial correlation matrix $Q(\omega, D_h)$.

A set of indices p of directions from which noise arrives is denoted by $\{1, 2, \ldots, P-1\}$. It is assumed that the index s of the target direction $\theta_s$ does not belong to the set $\{1, 2, \ldots, P-1\}$. Assuming that P−1 noises come from arbitrary directions, the spatial correlation matrix $Q(\omega, D_h)$ can be given by equation (110a). In order to design a filter that sufficiently functions in the presence of many noises, it is preferable that P be a relatively large value. It is assumed here that P is an integer on the order of M. While the description is given as if the direction $\theta_s$ is a constant direction (and therefore directions other than the direction $\theta_s$ are described as directions from which noise arrives) for the clarity of explanation of the principle of the sound spot enhancement technique of the present invention, the direction $\theta_s$ in reality may be any direction that can be a target of sound enhancement. Usually, a plurality of directions can be directions $\theta_s$. In this light, the differentiation between the direction $\theta_s$ and noise directions is subjective. It is more correct to consider that one direction selected from P different directions that are predetermined as a plurality of possible directions from which whatever sounds, including a target sound or noise, may arrive is the direction that can be a target of sound enhancement and the other directions are noise directions. Therefore, the spatial correlation matrix $Q(\omega, D_h)$ can be represented by transfer functions $\vec{a}(\omega, \theta_\phi, D_h)=[a_1(\omega, \theta_\phi, D_h), \ldots, a_M(\omega, \theta_\phi, D_h)]^T$ $(\phi \in \Phi)$ of sounds that come from directions $\theta_\phi$ included in a plurality of possible directions that are at a distance $D_h$ from the center of the microphone array and from which sounds may arrive to the microphones and can be written as equation (110b), where $\Phi$ is the union of set $\{1, 2, \ldots, P-1\}$ and a set $\{s\}$. Note that $|\Phi|=P$ and $|\Phi|$ represents the number of elements of the set $\Phi$.

$$Q(\omega, D_h) = \vec{a}(\omega, \theta_s, D_h)\vec{a}^H(\omega, \theta_s, D_h) + \sum_{p\in\{1,\cdots,P-1\}} \vec{a}(\omega, \theta_p, D_h)\vec{a}^H(\omega, \theta_p, D_h) \tag{110a}$$

$$Q(\omega, D_h) = \sum_{\phi\in\Phi} \vec{a}(\omega, \theta_s, D_h)\vec{a}^H(\omega, \theta_s, D_h) \tag{110b}$$

Here, it is assumed that the transmission characteristic $\vec{a}(\omega, \theta_s, D_h)$ of a sound from the direction $\theta_s$ and the transfer functions $\vec{a}(\omega, \theta_p, D_h)=[a_1(\omega, \theta_p, D_h), \ldots, a_M(\omega, \theta_p, D_h)]^T$ of sounds from directions $p \in \{1, 2, \ldots, P-1\}$ are orthogonal to each other. That is, it is assumed that there are P orthogonal basis systems that satisfy the condition given by equation (111). The symbol ⊥ represents orthogonality. If $\vec{A} \perp \vec{B}$, the inner product of vectors $\vec{A}$ and $\vec{B}$ is zero. It is assumed here that $P \le M$. Note that if the condition given by equation (111) can be relaxed to assume that there are P basis systems that can be regarded approximately as orthogonal basis sys tems, P is preferably a value on the order of M or a relatively large value greater than or equal to M.

$$\vec{a}(\omega, \theta_s, D_h) \perp \vec{a}(\omega, \theta_1, D_h) \perp \ldots \perp \vec{a}(\omega, \theta_{P-1}, D_h) \tag{111}$$

Then, the spatial correlation matrix $Q(\omega, D_h)$ can be expanded as equation (112). Equation (112) means that the spatial correlation matrix $Q(\omega, D_h)$ can be decomposed into a matrix $V(\omega, D_h)=[\vec{a}(\omega, \theta_s, D_h), \vec{a}(\omega, \theta_1, D_h), \ldots, \vec{a}(\omega, \theta_{p-1}, D_h)]^T$ made up of P transfer functions that satisfy orthogonality and a unit matrix $\Lambda(\omega, D_h)$. Here, ρ is an eigenvalue of a transmission characteristic $\vec{a}(\omega, \theta_\Phi, D_h)$ that satisfies equation (111) for the spatial correlation matrix $Q(\omega, D_h)$ and is a real value.

$$Q(\omega, D_h)=\rho \vec{V}(\omega, D_h) \vec{\Lambda}(\omega, D_h) \vec{V}^H(\omega, D_h) \tag{112}$$

Then, the inverse matrix of the spatial correlation matrix $Q(\omega)$ can be given by equation (113).

$$Q^{-1}(\omega, D_h) = \frac{1}{\rho} \vec{V}^H(\omega, D_h) \vec{\Lambda}^{-1}(\omega, D_h) \vec{V}(\omega, D_h) \tag{113}$$

Substitution of equation (113) into equation (107) shows that the power of noise is minimized. If the power of noise is minimized, it means that the directivity in the direction $\theta_s$ is achieved. Therefore, orthogonality between the transfer functions of sounds from different directions is an important condition for achieving directivity in the direction $\theta_s$.

The reason why it is difficult for conventional techniques to achieve a sharp directivity in a direction $\theta_s$ will be discussed below.

Conventional techniques assumed in designing filters that transfer functions are made up of those of direct sounds. In reality, there are reflected sounds that are produced by reflection of sounds from the same sound source off surfaces such as walls and a ceiling and arrive at microphones. However, the conventional techniques regarded reflected sounds as a factor that degrade directivity and ignored the presence of reflected sounds. Assuming that sounds arrive at a linear microphone array as plane waves, the conventional technique treated transfer functions $\vec{a}_{conv}(\omega, \theta)=[a_1(\omega, \theta), \ldots, a_M(\omega, \theta)]^T$ as $\vec{a}_{conv}(\omega, \theta)=\vec{h}_d(\omega, \theta)$, where $\vec{h}_d(\omega, \theta)=[h_{d1}(\omega, \theta), \ldots, h_{dM}(\omega, \theta)]^T$ represents steering vectors of only a direct sound arriving from a direction θ (Since sound waves are considered to be plane waves, the steering vectors do not depend on distance D.) Note that a steering vector is a complex vector where phase response characteristics of microphones at a frequency ω with respect to a reference point are arranged for a sound wave from a direction θ viewed from the center of the microphone array.

It is assumed hereinafter momentarily that sound arrives at the linear microphone as plane waves. Assume that an m-th element $h_{dm}(\omega, \theta)$ of the steering vector $\vec{h}_d(\omega, \theta)$ of a direct sound is given by, for example, equation (114c), where u represents the distance between adjacent microphones, j is an imaginary unit. In this case, the reference point is the midpoint of the full-length of the linear microphone array (the center of the linear microphone array). The direction θ is defined as the angle formed by the direction from which a direct sound arrives and the direction in which the microphones included in the linear microphone array are arranged, as viewed from the center of the linear microphone array (see FIG. 9). Note that a steering vector can be expressed in various ways. For example, assuming that the reference point is the position of the microphone at one end of the linear microphone array, an m-th element $h_{dm}(\omega, \theta)$ of the steering vector $\vec{h}_d(\omega, \theta)$ of a direct sound can be given by equation (114d). In the following description, the assumption is that the m-th element $h_{dm}(\omega, \theta)$ of the steering vector $\vec{h}_d(\omega, \theta)$ of a direct sound can be written as equation (114c).

$$h_{dm}(\omega, \theta) = \exp\left[-\frac{j\omega u}{c}\left(m - \frac{M+1}{2}\right)\cos\theta\right] \tag{114c}$$

$$h_{dm}(\omega, \theta) = \exp\left[-\frac{j\omega u}{c}(m-1)\cos\theta\right] \tag{114d}$$

The inner product $\gamma_{conv}(\omega, \theta)$ of a transmission characteristic of a direction θ and a transmission characteristic of a target direction $\theta_s$ can be given by equation (115), where $\theta \neq \theta_s$.

$$\begin{aligned}\gamma_{conv}(\omega, \theta) &= \vec{a}^H_{conv}(\omega, \theta_s)\vec{a}_{conv}(\omega, \theta) \\ &= \vec{h}^H_d(\omega, \theta_s)\vec{h}_d(\omega, \theta) \\ &= \sum_{m=1}^{M} \exp\left[-\frac{j\omega u}{c}\left(m - \frac{M+1}{2}\right)(\cos\theta - \cos\theta_s)\right]\end{aligned} \tag{115}$$

Hereinafter, $\gamma_{conv}(\omega,\theta)$ is referred to as coherence. The direction θ in which the coherence $\gamma_{conv}(\omega,\theta)$ is 0 can be given by equation (116), where q is an arbitrary integer, except 0. Since $0<\theta<\pi/2$, the range of q is limited for each frequency band.

$$\theta = \arccos\left(\frac{2q\pi c}{M\omega u} + \cos\theta_s\right) \tag{116}$$

Since only parameters relating to the size of the microphone array (M and u) can be changed in equation (116), it is difficult to reduce the coherence $\gamma_{conv}(\omega, \theta)$ without changing any of the parameters relating to the size of the microphone array if the difference (angular difference) $|\theta-\theta_s|$ between directions is small. If this is the case, the power of noise is not reduced to a sufficiently small value and directivity having a wide beam width in the target direction $\theta_s$ as schematically illustrated in FIG. 5A will result.

The sound spot enhancement technique of the present invention is based on the consideration described above and is characterized by positively taking into account reflected sounds, unlike in the conventional technique, on the basis of an understanding that in order to design a filter that provides a sharp directivity in the direction $\theta_s$, it is important to enable the coherence to be reduced to a sufficiently small value even when the difference (angular difference) $|\theta-\theta_s|$ betweendirections is small.

Two types of plane waves, namely direct sounds from a sound source and reflected sounds produced by reflection of that sound off a reflective object 300, together enter the microphones of a microphone array. Let the number of reflected sounds be denoted by Ξ. Here, Ξ is a predetermined integer greater than or equal to 1. Then, a transmission characteristic $\vec{a}(\omega, \theta)=[a_1(\omega, \theta), \ldots, a_M(\omega, \theta)]^T$ can be expressed by the sum of a transmission characteristic of a direct sound that comes from a direction that can be a target of sound enhancement and directly arrives at the microphone array and the transmission characteristic(s) of one or more reflected sounds that are produced by reflection of that sound off a reflective object and arrive at the microphone array. Specifically, the transmission characteristic can be represented as the sum of the steering vector of the direct sound and the steering vector of $\Xi$ reflected sounds whose decays due to reflection and arrival time differences from the direct sound are corrected, as shown in equation (117a), where $\tau_\xi(\theta)$ is the arrival time difference between the direct sound and a $\xi$-th ($1 \le \xi \le \Xi$) reflected sound and $\alpha_\xi$ ($1 \le \xi \le \Xi$) is a coefficient for taking into account decays of sounds due to reflection. Here, $\vec{h}_{r\xi}(\omega, \theta) = [h_{r1\xi}(\omega, \theta), \ldots, h_{rM\xi}(\omega, \theta)]^T$ represents the steering vectors of reflected sounds corresponding to the direct sound from direction $\theta$. Typically, $\alpha_\xi$ ($1 \le \xi \le \Xi$) is less than or equal to 1 ($1 \le \xi \le \Xi$). For each reflected sound, if the number of reflections in the path from the sound source to the microphones is 1, $\alpha_\xi$ ($1 \le \xi \le \Xi$) can be considered to represent the acoustic reflectance of the object from which the $\xi$-th reflected sound was reflected.

$$\vec{a}(\omega, \theta) = \vec{h}_d(\omega, \theta) + \sum_{\xi=1}^{\Xi} \alpha_\xi \exp[-j\omega\tau_\xi(\theta)] \cdot \vec{h}_{r\xi}(\omega, \theta) \tag{117a}$$

Since it is desirable that one or more reflected sounds be provided to the microphone array made up of M microphones, it is preferable that there is one or more reflective objects. From this point of view, a sound source, the microphone array, and one or more reflective objects are preferably in such a positional relation that a sound from the sound source is reflected off at least one reflective object before arriving at the microphone array, assuming that the sound source is located in the target direction for sound enhancement. Each of the reflective objects has a two-dimensional shape (for example a flat plate) or a three-dimensional shape (for example a parabolic shape). Each reflective object is preferably about the size of the microphone array or greater (greater by a factor of 1 to 2). In order to effectively use reflected sounds, the reflectance $\alpha_\xi$ ($1 \le \xi \le \Xi$) of each reflective object is preferably at least greater than 0, and more preferably, the amplitude of a reflected sound arriving at the microphone array is greater than the amplitude of the direct sound by a factor of 0.2 or greater. For example, each reflective object is a rigid solid. Each reflective object may be a movable object (for example a reflector) or an immovable object (such as a floor, wall, or ceiling). Note that if an immovable object is set as a reflective object, the steering vector for the reflective object needs to be changed as the microphone array is relocated (see functions $\Psi(\theta)$ and $\Psi_\xi(\theta)$ described later) and consequently the filter needs to be recalculated (re-set). Therefore, the reflective objects are preferably accessories of the microphone array for the sake of robustness against environmental changes (in this case, $\Xi$ reflected sounds assumed are considered to be sounds reflected off the reflective objects). Here the "accessories of the microphone array" are "tangible objects capable of following changes of the position and orientation of the microphone array while maintaining the positional relation (geometrical relation) with the microphone array). A simple example may be a configuration where reflective objects are fixed to the microphone array.

In order to concretely describe advantages of the sound spot enhancement technique of the present invention, it is assumed in the following that $\Xi=1$, sounds are reflected once, and one reflective object exists at a distance of L meters from the center of the microphone array. The reflective object is a thick rigid object. Since $\Xi=1$ in this case, the symbol representing this is omitted and therefore equation (117a) can be rewritten as equation (117b):

$$\vec{a}(\omega, \theta) = \vec{h}_d(\omega, \theta) + \alpha \exp[-j\omega\tau(\theta)] \cdot \vec{h}_r(\omega, \theta) \tag{117b}$$

An m-th element of the steering vector $\vec{h}_r(\omega, \theta) = [h_{r1}(\omega, \theta), \ldots, h_{rM}(\omega, \theta)]^T$ of a reflected sound can be given by equation (118a) in the same way that the steering vector of a direct sound is represented (see equation (114c)). The function $\Psi(\theta)$ outputs the direction from which a reflected sound arrives. Note that if the steering vector of a direct sound is written as equation (114d), an m-th element of the steering vector $\vec{h}_r(\omega, \theta) = [h_{r1}(\omega, \theta), \ldots, h_{rM}(\omega, \theta)]^T$ of a reflected sound is given by equation (118b). If $\Xi \le 2$, an m-th element of a $\xi$-th ($1 \le \xi \le \Xi$) steering vector $\vec{h}_{r\xi}(\omega, \theta) = [h_{r1\xi}(\omega, \theta), \ldots, h_{rM\xi}(\omega, \theta)]^T$ is given by equation (118c) or equation (118d). The function $\Psi_\xi(\theta)$ outputs the direction from which the $\xi$-th ($1 \le \xi \le \Xi$) reflected sound arrives.

$$h_{rm}(\omega, \theta) = \exp\left[-\frac{j\omega u}{c}\left(m - \frac{M+1}{2}\right)\cos(\Psi(\theta))\right] \tag{118a}$$

$$h_{rm}(\omega, \theta) = \exp\left[-\frac{j\omega u}{c}(m-1)\cos(\Psi(\theta))\right] \tag{118b}$$

$$h_{rm\xi}(\omega, \theta) = \exp\left[-\frac{j\omega u}{c}\left(m - \frac{M+1}{2}\right)\cos(\Psi_\xi(\theta))\right] \tag{118c}$$

$$h_{rm\xi}(\omega, \theta) = \exp\left[-\frac{j\omega u}{c}(m-1)\cos(\Psi_\xi(\theta))\right] \tag{118d}$$

Since the location of a reflective object can be set as appropriate, the direction from which a reflected sound arrives can be treated as a variable parameter.

Assuming that a flat-plate reflective object is near the microphone array (the distance L is not extremely large compared with the size of the microphone array), the coherence $\gamma(\omega, \theta)$ is given by equation (119), where $\theta \ne \theta_s$.

$$\begin{aligned}\gamma(\omega, \theta) = {} & \vec{a}^H(\omega, \theta_s)\vec{a}(\omega, \theta) \\ = {} & \vec{h}_d^H(\omega, \theta_s)\vec{h}_d(\omega, \theta) \\ & + \alpha \exp[-j\omega\tau(\theta)] \cdot \vec{h}_d^H(\omega, \theta_s)\vec{h}_r(\omega, \theta) \\ & + \alpha \exp\left[j\omega\tau(\theta_s) \cdot \vec{h}_r^H(\omega, \theta_s)\vec{h}_d(\omega, \theta)\right. \\ & + \alpha^2 \exp[-j\omega(\tau(\theta) - \tau(\theta_s))] \cdot \vec{h}_r^H(\omega, \theta_s)\vec{h}_r(\omega, \theta)\end{aligned} \tag{119}$$

It will be apparent from equation (119) that the coherence $\gamma(\omega, \theta)$ of equation (119) can be smaller than coherence $\gamma_{conv}(\omega, \theta)$ of the conventional technique of equation (115). Since parameters ($\Psi(\theta)$ and L) that can be changed by relocating or reorienting the reflective object are included in the second to fourth terms of equation (119), there is a possibility that the first term, $\vec{h}_d^H(\omega, \theta)\vec{h}_d(\omega, \theta)$, can be eliminated.

For example, if a flat reflector is placed in such a position that the direction along which the microphones are arranged in a linear microphone array is normal to the reflector, $\Psi(\theta) = \pi - \theta$ holds for the function $\Psi(\theta)$ and equation (120) folds for the difference $\tau(\theta)$ in arrival time between a direct sound and a reflected sound. Therefore, the conditions of equatione (121) and (122) are generated for the elements of equation (119). Here, the symbol * is a complex conjugate operator.

$$\tau(\theta) = \begin{cases} (2L\cos\theta)/c & \left(0 < \theta \le \frac{\pi}{4}\right) \\ (2L\sin\theta\tan\theta)/c & \left(\frac{\pi}{4} < \theta < \frac{\pi}{2}\right) \end{cases} \tag{120}$$

-continued $$\vec{h}_d^H(\omega, \theta_s)\vec{h}_d(\omega, \theta) = \vec{h}_d^H(\omega, \theta_s)\vec{h}_r(\omega, \theta) \tag{121}$$

$$\vec{h}_d^H(\omega, \theta_s)\vec{h}_r(\omega, \theta) = \left[\vec{h}_r^H(\omega, \theta_s)\vec{h}_d(\omega, \theta)\right]^* \tag{122}$$

Since the absolute value of $\vec{h}_d^H(\omega, \theta)\vec{h}_r(\omega, \theta)$ is sufficiently smaller than $\vec{h}_d^H(\omega, \theta)\vec{h}_d(\omega, \theta)$, the second and third terms of equation (119) are neglected. Then the coherence $\gamma(\omega, \theta)$ can be approximated as equation (123):

$$\tilde{\gamma}(\omega, \theta) \approx \{1+\alpha^2 exp[-j\omega(\tau(\theta)-\tau(\theta_s))]\}\vec{h}_d^H(\omega, \theta_s)\vec{h}_d(\omega, \theta) \tag{123}$$

Even if $\vec{h}_d^H(\omega, \theta)\vec{h}_d(\omega, \theta) \neq 0$, an approximated coherence $\tilde{\gamma}(\omega, \theta)$ has a minimal solution $\theta$ of equation (124), where q is an arbitrary positive integer. The range of q is restricted for each frequency.

$$\theta = \begin{cases} \arccos\left(\dfrac{(2q+1)\pi\ c}{2\omega L} + \cos\theta_s\right) & \left(0 < \theta \le \dfrac{\pi}{4}\right) \\ \dfrac{(2q+1)\pi\ c}{4\omega L} + \dfrac{1}{2}\sqrt{\left(\dfrac{(2q+1)\pi\ c}{4\omega L}\right)^2 + 4} & \left(\dfrac{\pi}{4} < \theta < \dfrac{\pi}{2}\right) \end{cases} \tag{124}$$

That is, not only the coherence in a direction given by equation (116) but also the coherence in a direction given by equation (124) can be suppressed. Since suppression of coherence can reduce the power of noise, a sharp directivity can be achieved as schematically shown in FIG. 5B.

While FIGS. 5A and 5B schematically show the difference between directivity achieved by the sharp directive sound enhancement technique of the present invention and directivity achieved by a conventional technique, FIG. 6 specifically shows the difference between $\theta$ given by equation (116) and $\theta$ given by equation (124). Here, $\omega=2\pi\times1000$ [rad/s], L=0.70 [m], and $\theta_s=\pi/4$ [rad]. Direction dependence of normalized coherence is shown in FIG. 6 for comparison between the techniques. The direction indicated by a circle is $\theta$ given by equation (116) and the directions indicated by the symbol + are $\theta$ given by equation (124). As can be seen from FIG. 6, according to the conventional technique, $\theta$ that yields a coherence of 0 for $\theta_s=\pi/4$ [rad] exists only in the direction indicated by the circle, whereas according to the principle of the sharp directive sound enhancement technique of the present invention, $\theta$ that yields a coherence of 0 for $\theta_s=\pi/4$ [rad] exists in many directions indicated by the symbol +. Especially, directions indicated by the symbol + exist far closer to $\theta_s=\pi/4$ [rad] than the direction indicated by the circle. Therefore, it will be understood that the technique of the present invention achieves a sharper directivity than the conventional technique.

While for clarity of explanation of the principle of the sound spot enhancement technique of the present invention, it has been assumed in the foregoing that sounds waves arrive as plane waves, the essence of the spot sound enhancement technique of the present invention is that the transmission characteristic $\vec{a}(\omega, \theta, D)=[a_1(\omega, \theta, D), \ldots, a_M(\omega, \theta, D)]^T$ is represented by the sum of the steering vector of a direct sound and the steering vectors of $\Xi$ reflected sounds, as shown in Equation (117a), for example, as is apparent from the foregoing description. Accordingly, it will be understood that the technique is not limited to sound waves that arrive as plane waves, but is capable of achieving sound enhancement of sounds arriving as spherical waves with a higher directivity than the conventional technique.

Transfer functions $\vec{a}(\omega, \theta, D)$ of sound waves that arrive as spherical waves will be described. Two types of spherical waves, namely direct sounds from a sound source and reflected sounds produced by reflection of that sound off a reflective object 300, together enter the microphones of a microphone array. Let the number of reflected sounds be denoted by $\Xi$. Here, $\Xi$ is a predetermined integer greater than or equal to 1. Then, a transmission characteristic $\vec{a}(\omega, \theta, D)=[a_1(\omega, \theta, D), \ldots, a_M(\omega, \theta, D)]^T$ can be expressed by the sum of a transmission characteristic of a direct sound that comes from a position $(\theta_s, D)$ that can be a target of sound enhancement and directly arrives at the microphone array and the transmission characteristic(s) of one or more reflected sounds that are produced by reflection of that sound off a reflective object and arrive at the microphone array. Specifically, the transmission characteristic can be represented as the sum of the steering vector of the direct sound and the steering vector of $\Xi$ reflected sounds whose decays due to reflection and arrival time differences from the direct sound are corrected, as shown in equation (125), where $\tau_\xi(\theta, D)$ is the arrival time difference between the direct sound and a $\xi$-th ($1\le\xi\le\Xi$) reflected sound and $\alpha_\xi(1\le\xi\le\Xi)$ is a coefficient for taking into account decays of sounds due to reflection. Here, $\vec{h}d(\omega, \theta, D_h)=[h_{d1}(\omega, \theta, D_h), \ldots, h_{dM}(\omega, \theta, D_h)]^T$ represents the steering vector of a direct sound from position $(\theta_s, D)$ and $\vec{h}_{r\xi}(\omega, \theta, D)=[h_{r1\xi}(\omega, \theta, D), \ldots, h_{rM\xi}(\omega, \theta, D)]^T$ represents the steering vector of a reflected sound corresponding to the direct sound from position $(\theta_s, D)$. A note about the term "steering vector" will be added here. A "steering vector" is also called "direction vector" and, as the name suggests, represents typically a complex vector that is dependent on "direction". From this view point, it is more precise to refer a complex vector that is dependent on a position $(\theta_s, D)$ as an "extended steering vector", for example. However, for the sake of simplicity, the complex vector that is dependent on a position $(\theta_s, D)$ will be also simply referred to as the "steering vector" herein. Typically, $\alpha_\xi$ ($1\le\xi\le\Xi$) is less than or equal to 1 ($1\le\xi\le\Xi$). For each reflected sound, if the number of reflections in the path from the sound source to the microphones is 1, $\alpha_\xi$ ($1\le\xi\le\Xi$) can be considered to represent the acoustic reflectance of the object from which the $\xi$-th reflected sound was reflected.

$$\vec{a}(\omega, \theta, D) = \vec{h}_d(\omega, \theta, D) + \sum_{\xi=1}^{\Xi} \alpha_\xi\ \exp[-j\omega\tau_\xi(\theta, D)]\cdot\vec{h}_{r\xi}(\omega, \theta, D) \tag{125}$$

In equation (125), an m-th element $h_{dm}(\omega, \theta, D_h)$ of the steering vector $\vec{h}_d(\omega, \theta, D_h)$ of the direct sound can be given by equation (125a), for example. Here m is an integer that satisfies $1\le m\le M$, c represents the speed of sound, and j is an imaginary unit. In an appropriately set spatial coordinate system, $\vec{v}_{\theta,D}^{(d)}$ represents a position vector of a position $(\theta, D)$, $\vec{u}_m$ represents a position vector of an m-th microphone, the symbol $\|\bullet\|$ represents a norm, and $f(\|\vec{v}_{\theta,D}^{(d)}-\vec{u}_m\|)$ is a function representing a distance decay of a sound wave. For example, $f(\|\vec{v}_{\theta,D}^{(d)}-\vec{u}_m\|)=1/\|\vec{v}_{\theta,D}^{(d)}-\vec{u}_m\|$ and in this case equation (125a) can be written as equation (125b).

$$h_{dm}(\omega, \theta, D) = f\left(\|\vec{v}_{\theta,D}^{(d)} - \vec{u}_m\|\right)\cdot\exp\left[-\frac{j\omega}{c}\|\vec{v}_{\theta,D}^{(d)} - \vec{u}_m\|\right] \tag{125a}$$

-continued $$h_{dm}(\omega, \theta, D) = \frac{1}{\|\vec{v}_{\theta,D}^{(d)} - \vec{u}_m\|}\exp\left[-\frac{j\omega}{c}\|\vec{v}_{\theta,D}^{(d)} - \vec{u}_m\|\right] \tag{125b}$$

In equation (125), an m-th element $h_{rm\xi}(\omega, \theta, D)$ of the steering vector $\vec{h}_{r\xi}(\omega, \theta, D)=h_{r1\xi}(\omega, \theta, D), \ldots, h_{rM\xi}(\omega, \theta, D)]^T$ can be given by equation (126a), like the steering vector of the direct sound (see equation (125a)). Here, m is an integer that satisfies $1 \le m \le M$, c represents the speed of sound, and j is an imaginary unit. In the spatial coordinate system, $\vec{v}_{\theta,D}^{(\xi)}$ represents a position vector of a position that is an mirror image of a position (θ, D) with respect to the reflecting surface of a ξ-th reflector, $\vec{u}_m$, represents the position vector of the m-th microphone, the symbol ||•|| represents a norm, and $f(\|\vec{v}_{\theta,D}^{(\xi)}-\vec{u}_m\|)$ is a function representing a distance decay of a sound wave. For example, $f(\|\vec{v}_{\theta,D}^{(\xi)}-\vec{u}_m\|)=1/\|\vec{v}_{\theta,D}^{(\xi)}-\vec{u}_m\|$ and in this case equation (126a) can be written as equation (126b).

$$h_{rm\xi}(\omega, \theta, D) = f\left(\|\vec{v}_{\theta,D}^{(\xi)} - \vec{u}_m\|\right)\cdot\exp\left[-\frac{j\omega}{c}\|\vec{v}_{\theta,D}^{(\xi)} - \vec{u}_m\|\right] \tag{126a}$$

$$h_{rm\xi}(\omega, \theta, D) = \frac{1}{\|\vec{v}_{\theta,D}^{(\xi)} - \vec{u}_m\|}\exp\left[-\frac{j\omega}{c}\|\vec{v}_{\theta,D}^{(\xi)} - \vec{u}_m\|\right] \tag{126b}$$

Note that a ξ-th arrival time difference $\tau_\xi(\theta, D)$ and positional vector $\vec{v}_{\theta,D}^{(\xi)}$ can be theoretically calculated on the basis of the positional relation among the position (θ, D), the microphone array and the ξ-th reflective object when the positional relation is determined.

Figure 18A:
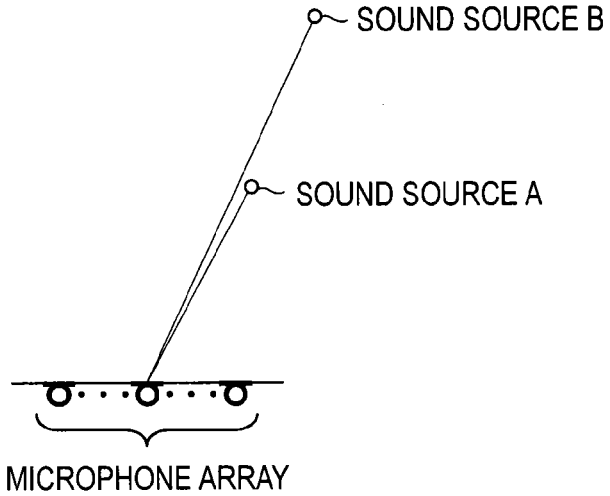
FIG. 18A is a diagram illustrating direct sounds arriving at a microphone array from two sound sources A and B.

Unlike the conventional techniques, the sound spot enhancement technique of the present invention positively takes into account reflected sounds and therefore is capable of a sharp directive sound spot enhancement. This will be described by taking two sound sources by way of example. It is difficult to spot-enhance sounds emanating from two sound sources A and B at different distances from a microphone array but in about the same directions viewed from the microphone array as illustrated in FIG. 18A only from direct sounds from the two sound sources for the following reason. Given the fact that $\theta_{[A]}\approx\theta_{[B]}$ and $D_{[A]}\neq D_{[B]}$, there is a difference between a decay function value $f(\|\vec{v}_{\theta[A],D[A]}^{(d)}-\vec{u}_m\|)$ appearing in the steering vector $\vec{h}_d(\omega, \theta_{[A]}, D_{[A]})$ of a direct sound corresponding to the position $(\theta_{[A]}, D_{[A]})$ of sound source A and a decay function value $f(\|\vec{v}_{\theta[B],D[B]}^{(d)}-\vec{u}_m\|)$ appearing in the steering vector $\vec{h}_d(\omega, \theta_{[B]}, D_{[B]})$ of a direct sound corresponding to the position $(\theta_{[B]}, D_{[B]})$ of sound source B as a function of distance from the microphone array. However, in reality the distinction between the intensity of a source signal (sound volume) and its decay function value cannot be made from the intensity of a sound (sound volume) picked up with the microphone array. That is, if $\vec{a}_{conv}(\omega, \theta, D)=\vec{h}_d(\omega, \theta, D)$ as in the conventional technique, the transfer functions of direct sounds are not sufficient as an indication for differentiating between distances of sound sources in about the same directions and therefore it is difficult to design filters capable of spot enhancement, as apparent from equatione (109), (110a) and (110b).

Figure 18B:
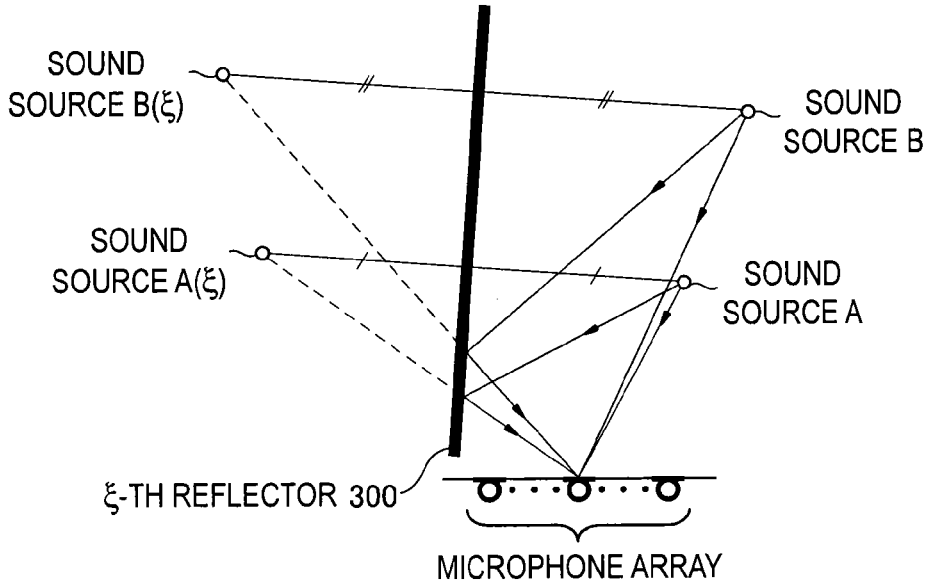
FIG. 18B is a diagram illustrating direct sounds arriving at a microphone array from two sound sources A and B and reflected sounds arriving at the microphone array from two virtual sound sources $A(\xi)$ and $B(\xi)$.

In contrast, the sound spot enhancement technique of the present invention positively takes into account reflected sounds therefore virtual sound sources A(ξ) and B(ξ) of ξ-th reflected sounds exist at positions of mirror images of sound sources A and B with respect to the reflecting surface of the ξ-th reflector 300 from the view point of the microphone array as illustrated in FIG. 18B. This is equivalent to that sounds that emanate from sound sources A and B and are reflected at the ξ-th reflector 300 come from virtual sound sources A(ξ) and B(ξ). There is a significant difference between the ξ-th reflected sound from virtual sound source A(ξ) and the ξ-th reflected sound from virtual sound source B(ξ) in position vector $\vec{V}_{\theta[A(\xi)],\,D[A(\xi)]}^{(\xi)}$ and $\vec{V}_{\theta[B(\xi)],\,D[B(\xi)]}^{(\xi)}$ and in arrival time difference $\tau_\xi(\theta_{[A]}, D_{[A]})$ and $\tau_\xi(\theta_{[B]}, D_{[B]})$. The transfer functions $\vec{a}(\omega_{[A]}, \theta_{[A]}, D_{[A]})$ and $\vec{a}(\omega_{[B]}, \theta_{[B]}, D_{[B]})$ that correspond to positions $(\theta_{[A]}, D_{[A]})$ and $(\theta_{[B]}, D_{[B]})$, respectively, can be given by equatione (127a) and (127b), respectively. The presence of the second term of equatione (127a) and (127b) provides a significant difference between transfer functions corresponding to different positions despite $\theta_{[A]}\approx\theta_{[B]}$. By extracting the difference between transfer functions by beam forming method, spot enhancement of sounds according to the positions of sound sources assumed can be performed.

$$\vec{a}(\omega, \theta_{[A]}, D_{[A]}) = \vec{h}_d(\omega, \theta_{[A]}, D_{[A]}) + \sum_{\xi=1}^{\Xi}\alpha_\xi\exp[-j\omega\tau_\xi(\theta_{[A]}, D_{[A]})]\cdot\vec{h}_{r\xi}(\omega, \theta_{[A]}, D_{[A]}) \tag{127a}$$

$$\vec{a}(\omega, \theta_{[B]}, D_{[B]}) = \vec{h}_d(\omega, \theta_{[B]}, D_{[B]}) + \sum_{\xi=1}^{\Xi}\alpha_\xi\exp[-j\omega\tau_\xi(\theta_{[B]}, D_{[B]})]\cdot\vec{h}_{r\xi}(\omega, \theta_{[B]}, D_{[B]}) \tag{127b}$$

$$\vec{h}_d(\omega, \theta_{[A]}, D_{[A]}) = [h_{d1}(\omega, \theta_{[A]}, D_{[A]}), \cdots, h_{dM}(\omega, \theta_{[A]}, D_{[A]})]^T$$

$$\vec{h}_d(\omega, \theta_{[B]}, D_{[B]}) = [h_{d1}(\omega, \theta_{[B]}, D_{[B]}), \cdots, h_{dM}(\omega, \theta_{[B]}, D_{[B]})]^T$$

$$\vec{h}_{r\xi}(\omega, \theta_{[A]}, D_{[A]}) = [h_{r1\xi}(\omega, \theta_{[A]}, D_{[A]}), \cdots, h_{rM\xi}(\omega, \theta_{[A]}, D_{[A]})]^T$$

$$\vec{h}_{r\xi}(\omega, \theta_{[B]}, D_{[B]}) = [h_{r1\xi}(\omega, \theta_{[B]}, D_{[B]}), \cdots, h_{rM\xi}(\omega, \theta_{[B]}, D_{[B]})]^T$$

$$h_{dm}(\omega, \theta_{[A]}, D_{[A]}) = f\left(\|\vec{v}_{\theta_{[A]},D_{[A]}}^{(d)} - \vec{u}_m\|\right)\cdot\exp\left[-\frac{j\omega}{c}\|\vec{v}_{\theta_{[A]},D_{[A]}}^{(d)} - \vec{u}_m\|\right]$$

$$h_{dm}(\omega, \theta_{[B]}, D_{[B]}) = f\left(\|\vec{v}_{\theta_{[B]},D_{[B]}}^{(d)} - \vec{u}_m\|\right)\cdot\exp\left[-\frac{j\omega}{c}\|\vec{v}_{\theta_{[B]},D_{[B]}}^{(d)} - \vec{u}_m\|\right]$$

$$h_{rm\xi}(\omega, \theta_{[A]}, D_{[A]}) = f\left(\|\vec{v}_{\theta_{[A(\xi)]},D_{[A(\xi)]}}^{(\xi)} - \vec{u}_m\|\right)\cdot\exp\left[-\frac{j\omega}{c}\|\vec{v}_{\theta_{[A(\xi)]},D_{[A(\xi)]}}^{(\xi)} - \vec{u}_m\|\right]$$

$$h_{rm\xi}(\omega, \theta_{[B]}, D_{[B]}) = f\left(\|\vec{v}_{\theta_{[B(\xi)]},D_{[B(\xi)]}}^{(\xi)} - \vec{u}_m\|\right)\cdot\exp\left[-\frac{j\omega}{c}\|\vec{v}_{\theta_{[B(\xi)]},D_{[B(\xi)]}}^{(\xi)} - \vec{u}_m\|\right]$$

Thus far, distance $D_h$ has been fixed in order to explain how high directivity can be achieved. Accordingly, spatial correlation matrices Q(ω) has been written as (110a) and (110b). However, by taking into account the correlation between transfer functions of M channels for different distances $D_\delta$ (δ=1, 2, . . . , G), the amount of information concerning a sound field can be increased to construct a spatial correlation matrix that provides more precise filters. The spatial correlation matrix Q(ω) can be given by equation (110c). A set to which indices φ of directions $\theta_\phi$ belong is denoted by Φ (|Φ|=P) and a set to which indices δ of distances $D_\delta$ belong is denoted by Δ (|Δ|)=G).

$$Q(\omega) = \sum_{\phi\in\Phi}\sum_{\delta\in\Delta}\vec{a}(\omega, \theta_\phi, D_\delta)\vec{a}^H(\omega, \theta_\phi, D_\delta) \tag{110c}$$

Then, by using the spatial correlation matrix Q(ω) given by equation (110c), a filter $\vec{W}(\omega, \theta_s, D_h)$ designed by the minimum variance distortionless response (MVDR) method can be written as equation (109a) instead of equation (109).

$$\vec{W}(\omega, \theta_s, D_h) = \frac{Q^{-1}(\omega)\vec{a}(\omega, \theta_s, D_h)}{\vec{a}^H(\omega, \theta_s, D_h)Q^{-1}(\omega)\vec{a}(\omega, \theta_s, D_h)} \tag{109a}$$

As has been described, the essence of the sound spot enhancement technique of the present invention is that the transmission characteristic $\vec{a}(\omega, \theta, D)=[a_1(\omega, \theta, D), \ldots, a_M(\omega, \theta, D)]^T$ is represented by the sum of the steering vector of a direct sound and the steering vectors of $\Xi$ reflected sounds. Since this does not affect the filter design concept, filters $\vec{W}(\omega, \theta_s, D_h)$ can be designed by a method other than the minimum variance distortionless response (MVDR) method.

Methods other than the MVDR method described above will be described. They are: <1> a filter design method based on SNR maximization criterion, <2> a filter design method based on power inversion, <3> a filter design method using MVDR with one or more suppression points (directions in which the gain of noise is suppressed) as a constraint condition, <4> a filter design method using delay-and-sum beam forming, <5> a filter design method using the maximum likelihood method, and <6> a filter design method using the adaptive microphone-array for noise reduction (AMNOR) method. For <1> the filter design method based on SNR maximization criterion and <2> the filter design method based on power inversion, refer to Reference 2 listed below. For <3> the filter design method using MVDR with one or more suppression points (directions in which the gain of noise is suppressed) as a constraint condition, refer to Reference 3 listed below. For <6> the filter design method using the adaptive microphone-array for noise reduction (AMNOR) method, refer to Reference 4 listed below.

<1> Filter Design Method Based on SNR Maximization Criterion

In the filter design method based on SNR maximization criterion, a filter $\vec{W}(\omega, \theta_s, D_h)$ is determined on the basis of a criterion of maximizing the SN ratio (SNR) from a position $(\theta_s, D_h)$. The spatial correlation matrix for a sound from the position $(\theta_s, D_h)$ is denoted by $R_{ss}(\omega)$ and a spatial correlation matrix for a sound from a position other than the position $(\theta_s, D_h)$ is denoted by $R_{nn}(\omega)$. Then the SNR can be given by equation (128). Here, $R_{ss}(\omega)$ can be given by equation (129) and $R_{nn}(\omega)$ can be given by equation (130). Transfer functions $\vec{a}(\omega, \theta_s, D_h)=[a_1(\omega, \theta_s, D^h), \ldots, a_M(\omega, \theta_s, D_h)]^T$ can be given by equation (125), for example (to be precise, equation (125) where $\theta$ is replaced with $\theta_s$ and D replaced with $D_h$). A set to which indices $\phi$ of directions $\theta_\phi$ belong is denoted by $\Phi$ ($|\Phi|=P$) and a set to which indices $\delta$ of distances $D_\delta$ belong is denoted by $\Delta$ ($|\Delta|=G$).

$$SNR = \frac{\vec{W}^H(\omega, \theta_s, D_h)R_{ss}(\omega)\vec{W}(\omega, \theta_s, D_h)}{\vec{W}^H(\omega, \theta_s, D_h)R_{nn}(\omega)\vec{W}(\omega, \theta_s, D_h)} \tag{128}$$

$$R_{ss}(\omega) = \vec{a}(\omega, \theta_s, D_h)\vec{a}^H(\omega, \theta_s, D_h) \tag{129}$$

$$R_{nn}(\omega) = \left(\sum_{\phi\in\Phi}\sum_{\delta\in\Delta}\vec{a}(\omega, \theta_\phi, D_\delta)\vec{a}^H(\omega, \theta_\phi, D_\delta)\right) - R_{ss}(\omega) \tag{130}$$

The filter $\vec{W}(\omega, \theta_s, D_h)$ that maximizes the SNR of equation (128) can be obtained by setting the gradient relating to filter $\vec{W}(\omega, \theta_s, D_h)$ to zero, that is, by equation (131).

$$\nabla_{\vec{W}(\omega,\theta_s,D_h)}[SNR] = 0 \tag{131}$$

where $$\nabla_{\vec{W}(\omega,\theta_s,D_h)}[SNR] = \frac{2R_{ss}(\omega)\vec{W}(\omega, \theta_s, D_h)\left(\vec{W}^H(\omega, \theta_s, D_h)R_{nn}(\omega)\vec{W}(\omega, \theta_s, D_h)\right)}{\left(\vec{W}^H(\omega, \theta_s, D_h)R_{nn}(\omega)\vec{W}(\omega, \theta_s, D_h)\right)^2} - \frac{2R_{nn}(\omega)\vec{W}(\omega, \theta_s, D_h)\left(\vec{W}^H(\omega, \theta_s, D_h)R_{ss}(\omega)\vec{W}(\omega, \theta_s, D_h)\right)}{\left(\vec{W}^H(\omega, \theta_s, D_h)R_{nn}(\omega)\vec{W}(\omega, \theta_s, D_h)\right)^2}$$

Thus, the filter $\vec{W}(\omega, \theta_s, D_h)$ that maximizes the SNR of equation (128) can be given by equation (132):

$$\vec{W}(\omega, \theta_s, D_h)=R_{nn}^{-1}(\omega)\vec{a}(\omega, \theta_s, D_h) \tag{132}$$

Equation (132) includes the inverse matrix of the spatial correlation matrix $R_{nn}(\omega)$ of a sound from a position other than the position $(\theta_s, D_h)$. It is known that the inverse matrix of $R_{nn}(\omega)$ can be replaced with the inverse matrix of a spatial correlation matrix $R_{xx}(\omega)$ of a whole input including sounds from (1) the position $(\theta_s, D_h)$ and (2) sounds from a position other direction $(\theta_s, D_h)$. Here, $R_{xx}(\omega)=R_{ss}(\omega)+R_{nn}(\omega)=Q(\omega)$. That is, the filter $\vec{W}(\omega, \theta_s, D_h)$ that maximizes the SNR of equation (128) may be obtained by equation (133):

$$\vec{W}(\omega, \theta_s, D_h)=R_{xx}^{-1}(\omega)\vec{a}(\omega, \theta_s, D_h) \tag{133}$$

<2> Filter Design Method Based on Power Inversion

In the filter design method based on power inversion, a filter $\vec{W}(\omega, \theta_s, D_h)$ is determined on the basis of a criterion of minimizing the average output power of a beam former while a filter coefficient for one microphone is fixed at a constant value. Here, an example where the filter coefficient for the first microphone among M microphones is fixed will be described. In this design method, a filter $\vec{W}(\omega, \theta_s, D_h)$ is designed that minimizes the power of sounds from all positions (all positions that can be assumed to be sound source positions)) by using a spatial correlation matrix $R_{xx}(\omega)$ (see equation (134)) under the constraint condition of equation (135). Transfer functions $\vec{a}(\omega, \theta_s, d_h)=[a_1(\omega, \theta_s, D_h), \ldots, a_M(\omega, \theta_s, D_h)]^T$ can be given by equation (125), for example (to be precise, by equation (125) where $\theta$ is replaced with $\theta_s$ and D is replaced with $D_h$).

$$\min_{\vec{W}(\omega,\theta_s,D_h)}\left(\vec{W}^H(\omega, \theta_s, D_h)R_{xx}(\omega)\vec{W}(\omega, \theta_s, D_h)\right) \tag{134}$$

$$\vec{W}^H(\omega, \theta_s, D_h)\vec{G} = \vec{G}^H R_{xx}^{-1}(\omega)\vec{G} \tag{135}$$

where $$\vec{G} = [1, 0, \cdots, 0]^T$$

It is known that the filter $\vec{W}(\omega, \theta_s, D_h)$ that is an optimum solution of equation (134) can be given by equation (136) (see Reference 2 listed below).

$$\vec{W}(\omega, \theta_s, D_h)=R_{xx}^{-1}(\omega)\vec{G} \tag{136}$$

<3> Filter Design Method Using MVDR with One or More Suppression Points as Constraint Condition In the MVDR method described earlier, a filter $\vec{W}(\omega, \theta_s, D_h)$ has been designed under the single constraint condition that a filter is obtained that minimizes the average output power of a beam former given by equation (107) (that is, the power of noise which is sounds from directions other than a position $(\theta_s, D_h)$ under the constraint condition that the filter passes sounds from a position $(\theta_s, D_h)$ in all frequency bands as expressed by equation (108). According to the method, the power of noise can be generally suppressed. However, the method is not necessarily preferable if it is previously known that there is a noise source(s) that has strong power in one or more particular directions. If this is the case, a filter is required that strongly suppresses one or more particular known directions (that is, suppression points) in which the noise source(s) exist. Therefore, the filter design method described here obtains a filter that minimizes the average output power of the beam former given by equation (107) (that is, minimizes the average output power of sounds from directions other than a position $(\theta_s, D_h)$ and the suppression points) under the constraint conditions that (1) the filter passes sounds from the position $(\theta_s, D_h)$ in all frequency bands and that (2) the filter suppresses sounds from B known suppression points $(\theta_{N1}, D_{G1}), (\theta_{N2}, D_{G2}), \ldots, (\theta_{NB}, D_{GB})$. (B is a predetermined integer greater than or equal to 1) in all frequency bands. Let a set of indices $\phi$ of directions from which noise arrives be denoted by $\{1, 2, \ldots, P\}$, then $Nj \in \{1, 2, \ldots, P\}$ (where $j \in \{1, 2, \ldots, B\}$) and $B \leq P-1$, as has been described earlier. Let a set of indices $\delta$ of distances to sound sources be denoted by $\{1, 2, \ldots, G\}$, then $Gj \in \{1, 2, \ldots, G\}$ (where $j \in \{1, 2, \ldots, B\}$) and $B \leq G-1$.

Let $\vec{a}(\omega, \theta_i, D_g)=[a_1(\omega, \theta_i, D_g), \ldots, a_M(\omega, \theta_i, D_g)]^T$ be transfer functions between a sound source assumed to be located in a position $(\theta_i, D_g)$ and the M microphones at a frequency $\omega$, in other words, transfer functions of a sound from a position $(\theta_i, D_g)$ at a frequency $\omega$ arriving at the microphones of a microphone array, then a constraint condition can be given by equation (137). Here, for indices i and g, $(i, g) \in \{(s, h), (N1, G1), (N2, G2), \ldots, (NB, GB)\}$, transfer functions $\vec{a}(\omega, \theta i, D_g)=[a_1(\omega, \theta_i, D_g), \ldots, a_M(\omega, \theta_i, D_g)]^T$ can be given by equation (125) (to be precise, by equation (125) where $\theta$ is replaced with $\theta_i$ and D is replaced with $D_h$), and $f_{i,g}(\omega)$ represents a pass characteristic at a frequency $\omega$ for a position $(\theta_i, D_g)$.

$$\vec{W}^H(\omega, \theta_s, D_h)\vec{a}(\omega, \theta_i, D_g)=f_{i,g}(\omega)$$

$$(i, g)\in\{(s, h),(N1, G1),(N2, G2), \ldots, (NB, GB)\} \tag{137}$$

Equation (137) can be represented as a matrix, for example written as equation (138). Here, $\vec{A}(\omega, \theta_s, D_h)=[(\vec{a}(\omega, \theta_s, D_h), \vec{a}(\omega, \theta_{N1}, D_{G1}), \ldots, \vec{a}(\omega, \theta_{NB}, D_{GB})]$.

$$\vec{w}^H(\omega, \theta_s, D_h)\vec{A}(\omega, \theta_s, D_h)=\vec{F} \tag{138}$$

where $$\vec{F}=[f_{s,h}(\omega, f_{N1,G1}(\omega), \ldots, f_{NB,GB}(\omega)]$$

Taking into consideration the constraint conditions that (1) the filter passes sounds from the position $(\theta_s, D_h)$ in all frequency bands and that (2) the filter suppresses sounds from B known suppression points $(\theta_{N1}, D_{G1}), (\theta_{N2}, D_{G2}), \ldots, (\theta_{NB}, D_{GB})$, in all frequency bands, ideally $f_{s,h}(\omega)=1.0$ and $f_{i,g}(\omega)=0.0$ $((i, g) \in \{(N1, G1), (N2, G2), \ldots, (NB, GB)\})$ should be set. This means that the filter completely passes sounds in all frequency bands from the position $(\theta_s, D_h)$ and completely blocks sounds in all frequency bands from B known suppression points $(\theta_{N1}, D_{G1}), (\theta_{N2}, D_{G2}), \ldots, (\theta_{NB}, D_{GB})$. In reality, however, it is difficult in some situations to effect such control as completely passing all frequency bands or completely blocking all frequency bands. In such a case, the absolute value of $f_{s,h}(\omega)$ is set to a value close to 1.0 and the absolute value of $f_{i,g}(\omega)$ $((i, g) \in \{(N1, G1), (N2, G2), \ldots, (NB, GB)\})$ is set to a value close to 0.0. Of course, $f_{i,g_i}(\omega)$ and $f_{j,g_j}(\omega)$ $(i \neq j; i \text{ and } j \in \{N1, N2, \ldots, NB\})$ may be the same or different.

According to the filter design method described here, the filter $\vec{W}(\omega, \theta_s, D_h)$ that is an optimum solution of equation (107) under the constraint condition given by equation (138) can be given by equation (139) (see Reference 3 listed below). While a spatial correlation matrix $Q(\omega)$ that can be given by equation (110c) has been used, a spatial correlation matrix given by equation (110a) or (110b) may be used.

$$\vec{W}(\omega, \theta_s, D_h)=Q^{-1}(\omega)\vec{A}(\omega, \theta_s, D_h)(\vec{A}^H(\omega, \theta_s, D_h)Q^{-1}(\omega)\vec{A}(\omega, \theta_s, D_h))^{-1}\vec{F} \tag{139}$$

<4> Filter Design Method Using Delay-And-Sum Beam Forming

Assuming that direct and reflected sounds arriving are plane waves, then a filter $\vec{W}(\omega, \theta_s, D_h)$ can be given by equation (140) according to the delay-and-sum beam forming. That is, the filter $\vec{W}(\omega, \theta_s, D_h)$ can be obtained by normalizing a transmission characteristic $\vec{a}(\omega, \theta_s, D_h)$. The transmission characteristic $\vec{a}(\omega, \theta_s, D_h)=[a_1(\omega, \theta_s, D_h), \ldots, a_M(\omega, \theta_s, D_h)]^T$ can be given by equation (125) (to be precise, by equation (125) where $\theta$ is replaced with $\theta_s$ and D is replaced with $D_h$). The filter design method does not necessarily achieve a high filtering accuracy but requires only a small quantity of computation.

$$\vec{W}(\omega, \theta_s, D_h) = \frac{\vec{a}(\omega, \theta_s, D_h)}{\vec{a}^H(\omega, \theta_s, D_h)\vec{a}(\omega, \theta_s, D_h)} \tag{140}$$

<5> Filter Design Method Using Maximum Likelihood Method

By excluding spatial information concerning sounds from a target direction from a spatial correlation matrix $Q(\omega, D_h)$ in the MVDR method described earlier, flexibility of suppression of noise can be improved and the power of noise can be further suppressed. Therefore, in the filter design method described here, the spatial correlation matrix $Q(\omega, D_h)$ is written as the second term of the right-hand side of equation (110a), that is, equation (110d). A filter $\vec{W}(\omega, \theta_s, D_h)$ can be given by equation (109) or (139). Here, the spatial correlation matrix included in equatione (109) and (139) is a spatial correlation matrix given by equation (110d).

$$Q(\omega, D_h) = \sum_{p\in\{1,\cdots,P-1\}} \vec{a}(\omega, \theta_p, D_h)\vec{a}^H(\omega, \theta_p, D_h) \tag{110d}$$

Alternatively, spatial information concerning sounds from the position $(\theta_s, D_h)$ may be excluded from the spatial correlation matrix $Q(\omega)$. In that case, a spatial correlation matrix $Q(\omega)$ is given by equation (110e) in the filter design method described here. A filter $\vec{W}(\omega, \theta_s, D_h)$ can be given by equation (109) or (139). Here, the spatial correlation matrix included in equatione (109) and (139) is given by equation (110e).

$$Q(\omega) = \left(\sum_{\phi\in\Phi}\sum_{\delta\in\Delta} \vec{a}(\omega, \theta_\phi, D_\delta)\vec{a}^H(\omega, \theta_\phi, D_\delta)\right) - \vec{a}(\omega, \theta_s, D_h)\vec{a}^H(\omega, \theta_s, D_h) \tag{110e}$$

<6> Filter Design Method Using AMNOR Method

The AMNOR method obtains a filter that allows some amount of decay D of a sound from a target direction by trading off the amount of decay D of the sound from the target direction against the power of noise remaining in a filter output signal (for example, the amount of decay D is maintained at a certain threshold $\hat{D}$ or less) and, when a mixed signal of [a] a signal produced by applying transfer functions between a sound source and microphones to a virtual signal (hereinafter referred to as the virtual signal) from a target direction and [b] noise (obtained by observation with M microphones in a noisy environment without a sound from the target direction) is input, outputs a filter output signal that reproduces best the virtual signal in terms of least squares error (that is, the power of noise contained in a filter output signal is minimized).

The filter design method described here incorporates the concept of distance into the AMNOR method and can be considered to be similar to the AMNOR method. Specifically, the method obtains a filter that allows some amount of decay D of a sound from a position $(\theta_s, D_h)$ by trading off the amount of decay D of the sound from the position $(\theta_s, D_h)$ against the power of noise remaining in a filter output signal (for example, the amount of decay D is maintained at a certain threshold $\hat{D}$ or less) and, when a mixed signal of [a] a signal produced by applying transfer functions between a sound source and microphones to a virtual target signal from a position $(\theta_s, D_h)$ (hereinafter referred to as the virtual target signal) and [b] noise (obtained by observation with M microphones in a noisy environment without a sound from the position $(\theta_s, D_h)$) is input, outputs a filter output signal that reproduces best the virtual target signal in terms of least squares error (that is, the power of noise contained in a filter output signal is minimized).

According to the filter design method described here, a filter $\vec{W}(\omega, \theta_s, D_h)$ can be given by equation (141) as in the AMNOR method (see Reference 4 listed below). Here, $R_{ss}(\omega)$ can be given by equation (126) and $R_{nn}(\omega)$ can be given by equation (127). Transfer functions $\vec{a}(\omega, \theta_s, D_h)=[a_1(\omega, \theta_s, D_h), \ldots, a_M(\omega, \theta_s, D_h)]^T$ can be given by equation (125) (to be precise, by equation (125) where $\theta$ is replaced with $\theta_s$ and D is replaced with $D_h$).

$$\vec{W}(\omega, \theta_s, D_h)=P_s\vec{a}(\omega, \theta_s, D_h)(R_{nn}(\omega)+P_sR_{ss}(\omega))^{-1} \tag{141}$$

$P_s$ is a coefficient that assigns a weight to the level of the virtual target signal and called the virtual target signal level. The virtual target signal level $P_s$ is a constant that is not dependent on frequencies. The virtual target signal level $P_s$ may be determined empirically or may be determined so that the difference between the amount of decay D of a sound from the position $(\theta_s, D_h)$ and the threshold $\hat{D}$ is within an arbitrarily predetermined error margin. The latter case will be described. The frequency response $F(\omega)$ of the filter $\vec{W}(\omega, \theta_s, D_h)$ to a sound from a position $(\theta_s, D_h)$ can be given by equation (142). Let the amount of decay $D(P_s)$ when using the filter $\vec{W}(\omega, \theta_s, D_h)$ given by equation (141) be denoted by $D(P_s)$, then the amount of decay $D(P_s)$ can be defined by equation (143). Here, $\omega_0$ represents the upper limit of frequency $\omega$ (typically, a higher-frequency adjacent to a discrete frequency $\omega$). The amount of decay $D(P_s)$ is a monotonically decreasing function of $P_s$. Therefore, a virtual target signal level $P_s$ such that the difference between the amount of decay $D(P_s)$ and the threshold $\hat{D}$ is within an arbitrarily predetermined error margin can be obtained by repeatedly obtaining the amount of decay $D(P_s)$ while changing $P_s$ with the monotonicity of $D(P_s)$.

$$F(\omega) = \vec{W}^H(\omega, \theta_s, D_h)\vec{a}(\omega, \theta_s, D_h) \tag{142}$$

$$D(P_s) = \frac{1}{2\omega_0}\int_{-\omega_0}^{\omega_0} |1 - F(\omega)|^2 \, d\omega \tag{143}$$

<Variation>

In the foregoing description, the spatial correlation matrices $Q(\omega)$, $R_{ss}(\omega)$ and $R_{nn}(\omega)$ are expressed using transfer functions. However, the spatial correlation matrices $Q(\omega)$, $R_{ss}(\omega)$ and $R_{nn}(\omega)$ can also be expressed using the frequency-domain signals $\vec{X}(\omega, k)$ described earlier. While the spatial correlation matrix $Q(\omega)$ will be described below, the following description applies to $R_{ss}(\omega)$ and $R_{nn}(\omega)$ as well. ($Q(\omega)$ can be replaced with $R_{ss}(\omega)$ or $R_{nn}(\omega)$). The spatial correlation matrix $R_{ss}(\omega)$ can be obtained using frequency-domain representations of analog signals obtained by observation with a microphone array (including M microphones) in an environment where only sounds from a position $(\theta_s, D_h)$ exist. The spatial correlation matrix $R_{nn}(\omega)$ can be obtained using frequency-domain representations of an analog signal obtained by observation with a microphone array (including M microphones) in an environment where no sounds from a position $(\theta_s, D_h)$ exist (that is, a noisy environment).

The spatial correlation matrix $Q(\omega)$ using frequency domain signals $\vec{X}(\omega, k)=[X_1(\omega, k), \ldots, X_M(\omega, k)]^T$ can be given by equation (144). Here, the operator $E[\bullet]$ represents a statistical averaging operation. When viewing a discrete time series of an analog signal received with a microphone array (including M microphones) as a stochastic process, the operator $E[\bullet]$ represents a arithmetic mean value (expected value) operation if the stochastic process is a so-called wide-sense stationary process or a second-order stationary process. In this case, the spatial correlation matrix $Q(\omega)$ can be given by equation (145) using frequency-domain signals $\vec{X}(\omega, k-i)$ $(i=0, 1, \ldots, \zeta-1)$ of a total of $\zeta$ current and past frames stored in a memory, for example. When i=0, a k-th frame is the current frame. Note that the spatial correlation matrix $Q(\omega)$ given by equation (1441) or (145) may be recalculated for each frame or may be calculated at regular or irregular interval, or may be calculated before implementation of an embodiment, which will be described later (especially when $R_{ss}(\omega)$ or $R_{nn}(\omega)$ is used, the spatial correlation matrix $Q(\omega)$ is preferably calculated beforehand by using frequency-domain signals obtained before implementation of the embodiment). If the spatial correlation matrix $Q(\omega)$ is recalculated for each frame, the spatial correlation matrix $Q(\omega)$ depends on the current and past frames and therefore the spatial correlation matrix will be explicitly represented as $Q(\omega, k)$ as in equatione (144a) and (145a).

$$Q(\omega) = E\left[\vec{X}(\omega, k)\vec{X}^H(\omega, k)\right] \tag{144}$$

$$Q(\omega) = \sum_{i=0}^{\zeta-1} \vec{X}(\omega, k-i)\vec{X}^H(\omega, k-i) \tag{145}$$

$$Q(\omega, k) = E\left[\vec{X}(\omega, k)\vec{X}^H(\omega, k)\right] \tag{144a}$$

$$Q(\omega, k) = \sum_{i=0}^{\zeta-1} \vec{W}(\omega, k-i)\vec{X}^H(\omega, k-i) \tag{145a}$$

If the spatial correlation matrix $Q(\omega, k)$ represented by equation (144a) or (145a) is used, the filter $\vec{W}(\omega, \theta_s, D_h)$ also depends on the current and past frames and therefore is explicitly represented as $\vec{W}(\omega, \theta_s, D_h, k)$. Then, a filter $\vec{W}(\omega, \theta_s, D_h)$ represented by any of equatione (109), (132), (133), (136), (139) and (141) described with the filter design methods described above is rewritten as equatione (109m), (132m), (133m), (136m), (139m) or (141m).

$$\vec{W}(\omega, \theta_s, D_h, k) = \frac{Q^{-1}(\omega, k)\vec{a}(\omega, \theta_s, D_h)}{\vec{a}^H(\omega, \theta_s, D_h)Q^{-1}(\omega, k)\vec{a}(\omega, \theta_s, D_h)} \tag{109m}$$

$$\vec{W}(\omega, \theta_s, D_h, k) = R_{nn}^{-1}(\omega, k)\vec{a}(\omega, \theta_s, D_h) \tag{132m}$$

$$\vec{W}(\omega, \theta_s, D_h, k) = R_{xx}^{-1}(\omega, k)\vec{a}(\omega, \theta_s, D_h) \tag{133m}$$

$$\vec{W}(\omega, \theta_s, D_h, k) = R_{xx}^{-1}(\omega, k)\vec{G} \tag{136m}$$

$$\vec{W}(\omega, \theta_s, D_h, k) = Q^{-1}(\omega, k)\vec{A}(\omega, \theta_s, D_h)\left(\vec{A}^H(\omega, \theta_s, D_h)Q^{-1}(\omega, k)\vec{A}(\omega, \theta_s, D_h)\right)^{-1}\vec{F} \tag{139m}$$

$$\vec{W}(\omega, \theta_s, D_h, k) = P_s\vec{a}(\omega, \theta_s, D_h)(R_{nn}(\omega, k) + P_sR_{ss}(\omega, k))^{-1} \tag{141m}$$

<<First Embodiment of Sound Spot Enhancement Technique>>

Figure 19:
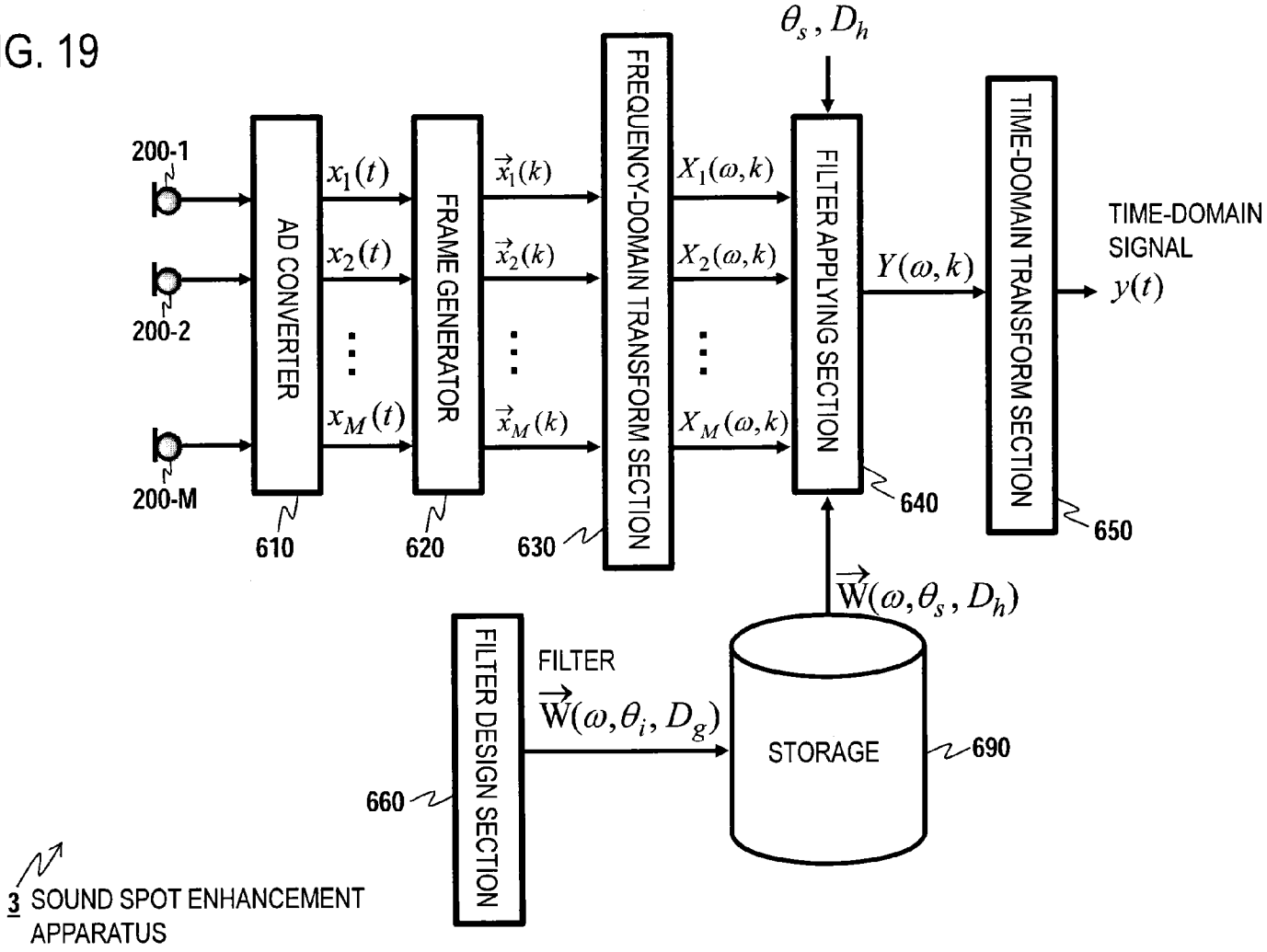
FIG. 19 is a diagram illustrating a functional configuration of a sound spot enhancement apparatus (first embodiment)
Figure 20:
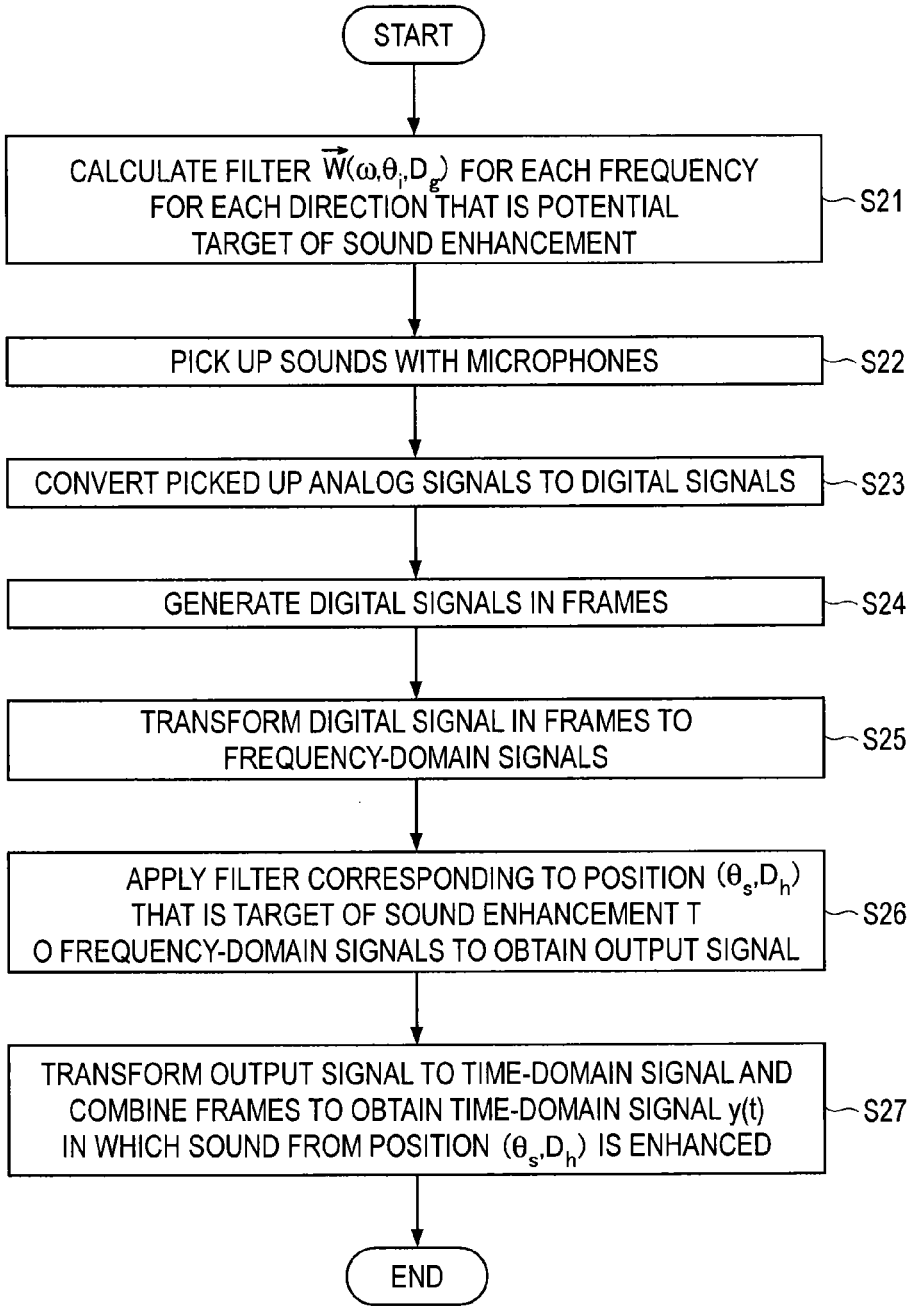
FIG. 20 is a diagram illustrating a procedure of a sound spot enhancement method (first embodiment)

FIGS. 19 and 20 illustrate a functional configuration and a process flow of a first embodiment of a sound spot enhancement technique of the present invention. A sound spot enhancement apparatus 3 of the first embodiment includes an AD converter 610, a frame generator 620, a frequency-domain transform section 630, a filter applying section 640, a time-domain transform section 650, a filter design section 660, and storage 690.

[Step S21]

The filter design section 660 calculates beforehand a filter $\vec{W}(\omega, \theta_i, D_g)$ for each frequency for each of discrete possible positions $(\theta_i, D_g)$ from which sounds to be enhanced can arrive. The filter design section 660 calculates filters $\vec{W}(\omega, \theta_1, D_1), \ldots, \vec{W}(\omega, \theta_i, D_1), \ldots, \vec{W}(\omega, \theta_I, D_1), \ldots, \vec{W}(\omega, \theta_1, D_2), \ldots, \vec{W}(\omega, \theta_i, D_2), \ldots, \vec{W}(\omega, \theta_I, D_2), \ldots, \vec{W}(\omega, \theta_1, D_g), \ldots, \vec{W}(\omega, \theta_i, D_g), \ldots, \vec{W}(\omega, \theta_I, D_g), \ldots, \vec{W}(\omega, \theta_1, D_G), \ldots, \vec{W}(\omega, \theta_i, D_G,), \ldots, \vec{W}(\omega, \theta_I, D_G)$ $(1 \le i \le I, 1 \le g \le G, \omega \in \Omega$; i and g are integers and $\Omega$ is a set of frequencies $\omega$), where I is the total number of discrete directions from which sounds to be enhanced can arrive (I is a predetermined integer greater than or equal to 1 and satisfies $I \le P$) and G is the number of the discrete distances (G is a predetermined integer greater than or equal to 1).

To do so, transfer functions $\vec{a}(\omega, \theta_i, D_g) = [a_1(\omega, \theta_i, D_g), \ldots, a_M(\omega, \theta_i, D_g)]^T$ $(1 \le i \le I, 1 \le g \le G, \omega \in \Omega)$ need to be obtained except for the case of <Variation> described above. The transfer functions $\vec{a}(\omega, \theta_i, D_g) = [a_1(\omega, \theta_i, D_g), \ldots, a_M(\omega, \theta_i, D_g)]^T$ can be calculated practically according to equation (125) (to be precise, by equation (125) where $\theta$ is replaced with $\theta_i$ and D is replaced with $D_g$) on the basis of the arrangement of the microphones in the microphone array and environmental information such as the positional relation of a reflective object such as a reflector, floor, walls, and ceiling to the microphone array, the arrival time difference between a direct sound and a $\xi$-th $(1 \le \xi \le \Xi)$reflected sound, and the acoustic reflectance of the reflective object. Note that if <3> the filter design method using MVDR with one or more suppression points as a constraint condition is used, the indices (i, g) of the directions used for calculating the transfer functions $\vec{a}(\omega, \theta_i, D_g)$ $(1 \le i \le I, 1 \le g \le G, \omega \in \Omega)$ preferably cover all of indices (N1, G1), (N2, G2), . . . , (NB, GB) of directions of at least B suppression positions. In other words, B indices N1, N2, . . . , NB are set to any of different integers greater than or equal to 1 and less than or equal to I and the B indices G1, G2, . . . , GB are set to any of different integers greater than or equal to 1 and less than or equal to G.

The number $\Xi$ of reflected sounds is set to an integer that satisfies $1 \le \Xi$. The number $\Xi$ is not limited and can be set to an appropriate value according to the computational capacity and other factors.

To calculate steering vectors, equatione (125a), (125b), (126a), or (126b), for example, can be used. Note that transfer functions obtained by actual measurements in a real environment, for example, may be used for designing the filters instead of using equatione (125).

Then, $\vec{W}(\omega, \theta_i, D_g)$ $(1 \le i \le I, 1 \le g \le G)$ is obtained according to any of equatione (109), (109a), (132), (133), (136), (139), (140) and (141), for example, by using the transfer functions $\vec{a}(\omega, \theta_i, D_g)$, except for the case described in <Variation>. Note that if equation (109), (109a), (133), (136) or (139) is used, the spatial correlation matrix $Q(\omega)$ (or $Rxx(\omega)$) can be calculated according to equation (110b), except for the case described with respect to <5> the filter design method using the maximum likelihood method. If equation (109), (109a), (133), (136) or (139) is used according to <5> the filter design method using the maximum likelihood method described earlier, the spatial correlation matrix $Q(\omega)$ (or $R_{xx}(\omega)$) can be calculated according to equation (110c) or (110d). If equation (132) is used, the spatial correlation matrix $R_{nn}(\omega)$ can be calculated according to equation (130). $I \times G \times |\Omega|$ filters $\vec{W}(\omega, \theta_i, D_g)$ $(1 \le i \le I, 1 \le g \le G, \omega \in \Omega)$ are stored in the storage 690, where $|\Omega|$ represents the number of the elements of the set $\Omega$.

[Step S22]

The M microphones 200-1, . . . , 200-M making up the microphone array are used to pick up sounds, where M is an integer greater than or equal to 2.

There is no restraint on the arrangement of the M microphones. However, a two- or three-dimensional arrangement of the M microphones has the advantage of eliminating uncertainty of a direction from which sounds to be enhanced arrive. That is, a planar or steric arrangement of the microphones can avoid the problem with a horizontal linear arrangement of the M microphones that a sound arriving from a front direction cannot be distinguished from a sound arriving from right above, for example. In order to provide a wide range of directions that can be set as sound-pickup directions, each microphone preferably has a directivity capable of picking up sounds with a certain level of sound pressure in potential target directions $\theta_s$ which are sound-pickup directions. Accordingly, microphones having relatively weak directivity, such as omnidirectional microphones or unidirectional microphones are preferable.

[Step S23]

The AD converter 610 converts the analog signals (pickup signals) picked up with the M microphones 200-1, . . . , 200-M to digital signals $\vec{x}(t) = [x_1(t), \ldots, x_M(t)]^T$, where t represents the index of a discrete time.

[Step S24]

The frame generator 620 takes inputs of the digital signals $\vec{x}(t) = [x_1(t), \ldots, x_M(t)]^T$ output from the AD converter 610, stores N samples in a buffer on a channel by channel basis, and outputs digital signals $\vec{x}(k) = [\vec{x}_1(k), \ldots, \vec{x}_M(k)]^T$ in frames, where k is an index of a frame-time number and $\vec{x}_m(k) = [x_m((k-1)N+1), \ldots, x_m(kN)]$ $(1 \le m \le M)$. N depends on the sampling frequency and 512 is appropriate for sampling at 16 kHz.

[Step S25]

The frequency-domain transform section 630 transforms the digital signals $\vec{x}(k)$ in frames to frequency-domain signals $\vec{X}(\omega, k)=[X_1(\omega, k), \ldots, X_M(\omega, k)]^T$ and outputs the frequency-domain signals, where 107 is an index of a discrete frequency. One way to transform a time-domain signal to a frequency-domain signal is fast discrete Fourier transform. However, the way to transform the signal is not limited to this. Other method for transforming to a frequency domain signal may be used. The frequency-domain signal $\vec{X}(\omega, k)$ is output for each frequency $\omega$ and frame k at a time.

[Step S26]

The filter applying section 640 applies the filter $\vec{W}(\omega, \theta_s, D_h)$ corresponding to a position $(\theta_s, D_h)$ to be enhanced to the frequency-domain signal $\vec{X}(\omega, k)=[X_1(\omega, k), \ldots, X_M(\omega, k)]^T$ in each frame k for each frequency $\omega \in \Omega$ and outputs an output signal $Y(\omega, k, \theta_s, D_h)$ (see equation (146)). The indices s and h of the position $(\theta_s, D_h)$ is $s \in \{1, \ldots, I\}$ and $h \in \{1, \ldots, G\}$ and the filter $\vec{W}(\omega, \theta_s, D_h)$ is stored in the storage 690. Therefore, the filter applying section 640 only has to retrieve the filter $\vec{W}(\omega, \theta_s, D_h)$ that corresponds to the position $(\theta_s, D_h)$ to be enhanced from the storage 690, for example, in the process at step S26. If the index s of the direction $\theta_s$ does not belong to the set $\{1, \ldots, I\}$ or the index h of direction $D_h$ does not belong to the set $\{1, \ldots, G\}$, that is, the filter $\vec{W}(\omega, \theta_s, D_h)$ that corresponds to the position $(\theta_s, D_h)$ has not been calculated in the process at step S21, the filter design section 660 may calculate at this moment the filter $\vec{W}(\omega, \theta_s, D_h)$ that corresponds to the position $(\theta_s, D_h)$ or filter $\vec{W}(\omega, \theta_{s'}, D_h)$ or $\vec{W}(\omega, \theta_s, D_{h'})$ or $\vec{}(\omega, \theta_{s'}, D_{h'})$ that corresponds to a direction $\theta_{s'}$ close to the direction $\theta_s$ and/or a distance $D_{h'}$ close to the distance $D_h$ may be used.

$$Y(\omega, k, \theta_s, D_h)=\vec{W}^H(\omega, \theta_s, D_h)\vec{X}(\omega, k) \ \forall \omega \in \Omega \tag{146}$$

[Step S27]

The time-domain transform section 650 transforms the output signal $Y(\omega, k, \theta_s, D_h)$ of each frequency $\omega \in \Omega$ in a k-th frame to a time domain to obtain a time-domain frame signal y(k) in the k-th frame, then combines the obtained frame time-domain signals y(k) in the order of frame-time number index, and outputs a time-domain signal y(t) in which the sound from a position $(\theta_s, D_h)$ is enhanced. The method for transforming a frequency-domain signal to a time-domain signal is inverse transform of the transform used in the process at step S25 and may be fast discrete inverse Fourier transform, for example.

While the first embodiment has been described here in which the filters $\vec{W}(\omega, \theta_i, D_g)$ are calculated beforehand in the process at step S21, the filter design section 660 may calculate the filter $\vec{W}(\omega, \theta_s, D_h)$ for each frequency after the position $(\theta_s, D_h)$ is determined, depending on the computational capacity of the sound spot enhancement apparatus 3.

<<Second Embodiment of Sound Spot Enhancement Technique>>

Figure 21:
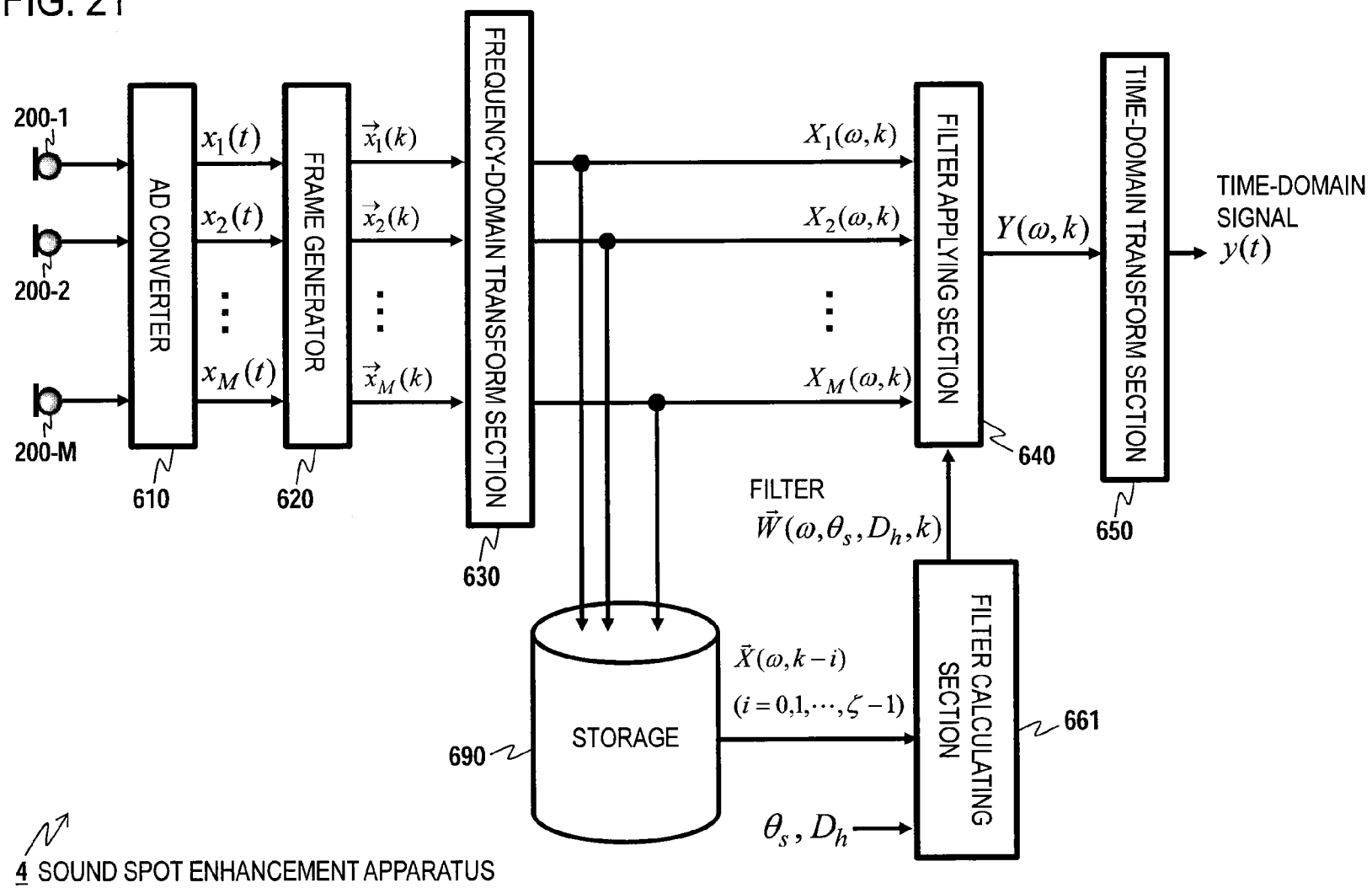
FIG. 21 is a diagram illustrating a functional configuration of a sound spot enhancement apparatus (second embodiment)
Figure 22:
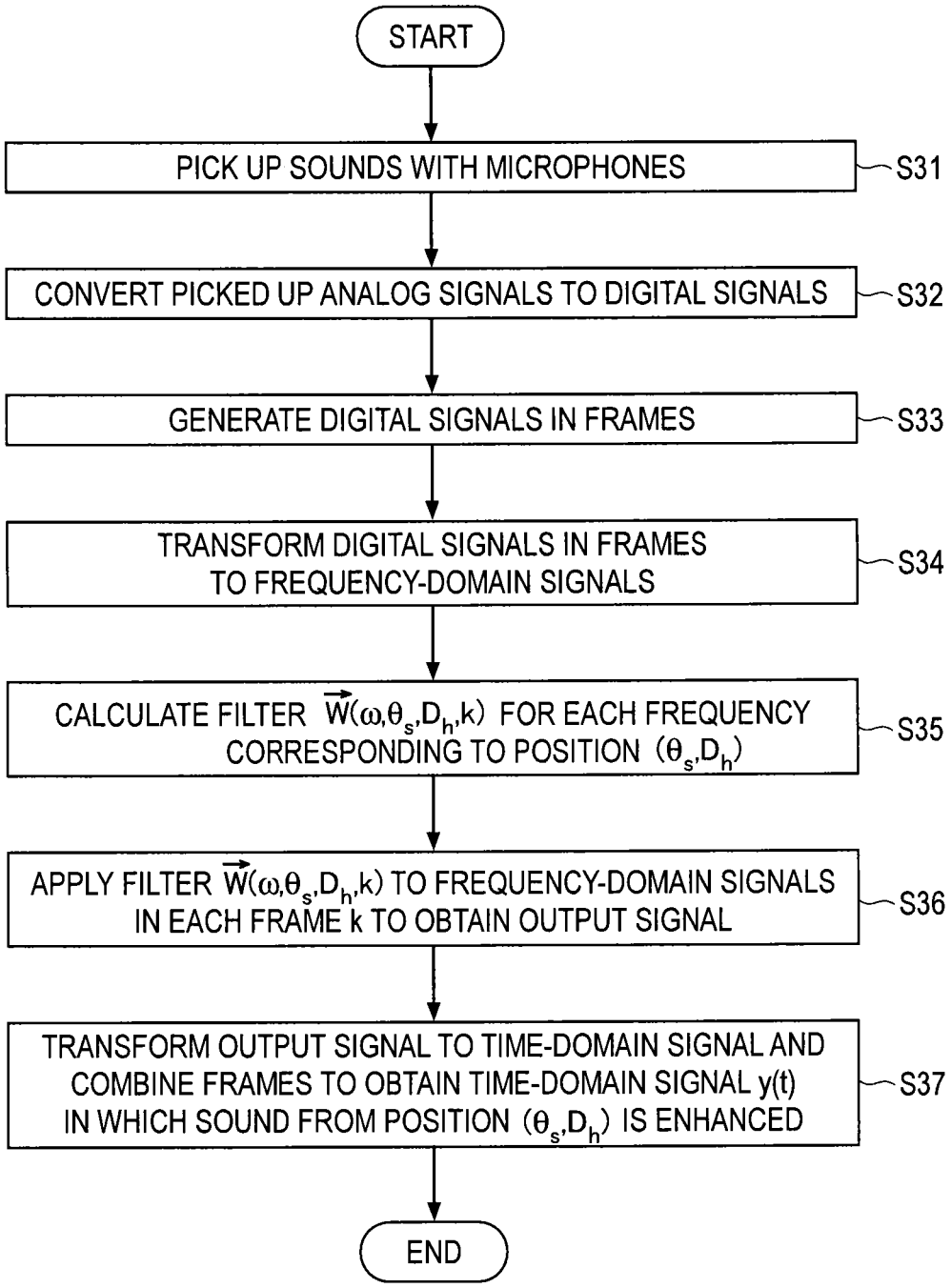
FIG. 22 is a diagram illustrating a procedure of a sound spot enhancement method (second embodiment)

FIGS. 21 and 22 illustrate a functional configuration and a process flow of second embodiment of a sound spot enhancement technique of the present invention. A sound spot enhancement apparatus 4 of second embodiment includes an AD converter 610, a frame generator 620, a frequency-domain transform section 630, a filter applying section 640, a time-domain transform section 650, a filter calculating section 661, and a storage 690.

[Step S31]

M microphones 200-1, . . . , 200-M making up a microphone array is used to pick up sounds, where M is an integer greater than or equal to 2. The arrangement of the M microphones is as described in the first embodiment.

[Step S32]

The AD converter 610 converts analog signals (pickup signals) picked up with the M microphones 200-1, . . . , 200-M to digital signals $\vec{x}(t)=[x_1(t), \ldots, x_M(t)]^T$, where t represents the index of a discrete time.

[Step S33]

The frame generator 620 takes inputs of the digital signals $\vec{x}(t)=[x_1(t), \ldots, x_M(t)]^T$ output from the AD converter 610, stores N samples in a buffer on a channel by channel basis, and outputs digital signals $\vec{x}(k)=[\vec{x}_1(k), \ldots, \vec{x}_M(k)]^T$ in frames, where k is an index of a frame-time number and $\vec{x}_m(k)=[x_m((k-1)N+1), \ldots, x_m(kN)]$ $(1 \le m \le M)$. N depends on the sampling frequency and 512 is appropriate for sampling at 16 kHz.

[Step S34]

The frequency-domain transform section 630 transforms the digital signals $\vec{x}(k)$ in frames to frequency-domain signals $\vec{X}(\omega, k)=[X_1(\omega, k), \ldots, X_M(\omega, k)]^T$ and outputs the frequency-domain signals, where $\omega$ is an index of a discrete frequency. One way to transform a time-domain signal to a frequency-domain signal is fast discrete Fourier transform. However, the way to transform the signal is not limited to this. Other method for transforming to a frequency domain signal may be used. The frequency-domain signal $\vec{X}(\omega, k)$ is output for each frequency $\omega$ and frame k at a time.

[Step S35]

The filter calculating section 661 calculates the filter $\vec{W}(\omega, \theta_s, D_h, k)$ ($\omega \in \Omega$; $\Omega$ is a set of frequencies $\omega$) that corresponds to the position $(\theta_s, D_h)$ to be used in a current k-th frame.

To do so, transfer functions $\vec{a}(\omega, \theta_s, D_h)=[a_1(\omega, \theta_s, D_h), \ldots, a_M(\omega, \theta_s, D_h)]^T$ $(\omega \in \Omega)$ need to be provided. Transfer functions $\vec{a}(\omega, \theta_s, D_h)=[a_1(\omega, \theta_s, D_h), \ldots, a_M(\omega, \theta_s, D_h)]^T$ can be calculated practically according to equation (17a) (to be precise, by equation (125) where $\theta$ is replaced with $\theta_s$ and D is replaced with $D_h$) on the basis of the arrangement of the microphones in the microphone array and environmental information such as the positional relation of a reflective object such as a reflector, floor, walls, or ceiling to the microphone array, the arrival time difference between a direct sound and a $\xi$-th reflected sound $(1 \le \xi \le \Xi)$, and the acoustic reflectance of the reflective object. Note that if <3> the filter design method using MVDR with one or more suppression points as a constraint condition is used, transfer functions $\vec{a}(\omega, \theta_{Nj}, D_{Gj})$ $(1 \le j \le B, \omega \in \Omega)$ also need to be obtained. The transfer functions can be calculated practically according to equation (125) (to be precise, by equation (125) where $\theta$ is replaced with $\theta_{Nj}$ and D is replaced with $D_{Gj}$) on the basis of the arrangement of the microphones in the microphone array and environmental information such as the positional relation of a reflective object such as a reflector, a floor, a wall, or ceiling to the microphone array, the arrival time difference between a direct sound and a $\xi$-th reflected sound $(1 \le \xi \le \Xi)$, and the acoustic reflectance of the reflective object.

The number $\Xi$ of reflected sounds is set to an integer that satisfies $1 \le \Xi$. The number $\Xi$ is not limited and can be set to an appropriate value according to the computational capacity and other factors.

To calculate steering vectors, equatione (125a), (125b), (126a), or (126b), for example, can be used. Note that transfer functions obtained by actual measurements in a real environment, for example, may be used for designing the filters instead of using equation (125).

Then, the filter calculating section 661 calculates filters $\vec{W}(\omega, \theta_s, D_h, k)$ $(\omega \in \Omega)$ according to any of equatione (109m), (132m), (133m), (136m), (139m) and (141m) using the transfer functions $\vec{a}(\omega, \theta_s, D_h)$ $(\omega \in \Omega)$ and, if needed, the transfer functions $\vec{a}(\omega, \theta_{Nj}, D_{Gj})$ $(1 \leq j \leq B, \omega \in \Omega)$. Note that the spatial correlation matrix $Q(\omega)$ (or $R_{xx}(\omega)$) can be calculated according to equation (144a) or (145a). In the calculation of the spatial correlation matrix $Q(\omega)$, frequency-domain signals $\vec{X}(\omega, k-i)$ $(i=0, 1, \ldots, \zeta-1)$ of a total of $\zeta$ current and past frames stored in the storage 690, for example, are used.

[Step S36]

The filter applying section 640 applies the filter $\vec{W}(\omega, \theta_s, D_h, k)$ corresponding to the target direction $\theta_s$ to be enhanced to the frequency-domain signal $\vec{X}(\omega, k)=[X_1(\omega, k), \ldots, X_M(\omega, k)]^T$ in each frame k for each frequency $\omega \in \Omega$ and outputs an output signal $Y(\omega, k, \theta_S, D_h)$ (see equation (147)).

$$Y(\omega, k, \theta_s, D_h)=\vec{W}^H(\omega, \theta_s, D_h, k)\vec{X}(\omega, k) \ \forall \omega \in \Omega \tag{147}$$

[Step S37]

The time-domain transform section 650 transforms the output signal $Y(\omega, k, \theta_s, D_h)$ of each frequency $\omega \in \Omega$ of a k-th frame to a time domain to obtain a time-domain frame signal y(k) in the k-th frame, then combines the obtained frame time-domain signals y(k) in the order of frame-time number index, and outputs a time-domain signal y(t) in which the sound from the position $(\theta_s, D_h)$ is enhanced. The method for transforming a frequency-domain signal to a time-domain signal is inverse transform of the transform used in the process at step S34 and may be fast discrete inverse Fourier transform, for example.

A filter $\vec{W}(\omega, \theta_i)$ that corresponds to a direction $\theta_i$ can be calculated by $\Sigma_{g=1}^{G}\beta_g\vec{W}(\omega, \theta_i, D_g)$ in the sound spot enhancement technique, where $\beta_g$ $[1 \leq g \leq G]$ is a weighting factor, which preferably satisfies $\Sigma_{g=1}^{G}\beta_g=1$ and preferably $0 \leq \beta_g$ $[1 \leq g \leq G]$. Note that the filter $\vec{W}(\omega, \theta_i, D_g)$ may be a filter represented using transfer functions measured in a real environment.

[Experimental Example of Sound Spot Enhancement Technique]

Figure 23A:
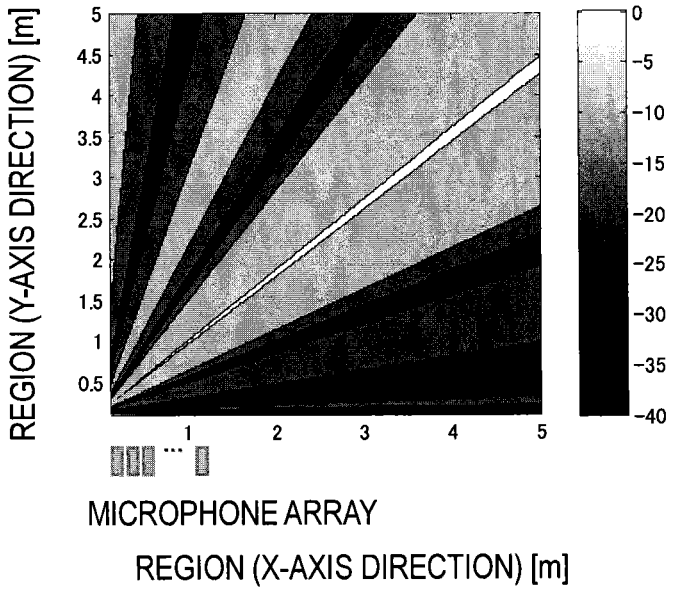
FIG. 23A illustrates the directivity (in a two dimensional domain) of a minimum variance beam former without reflector.
Figure 23B:
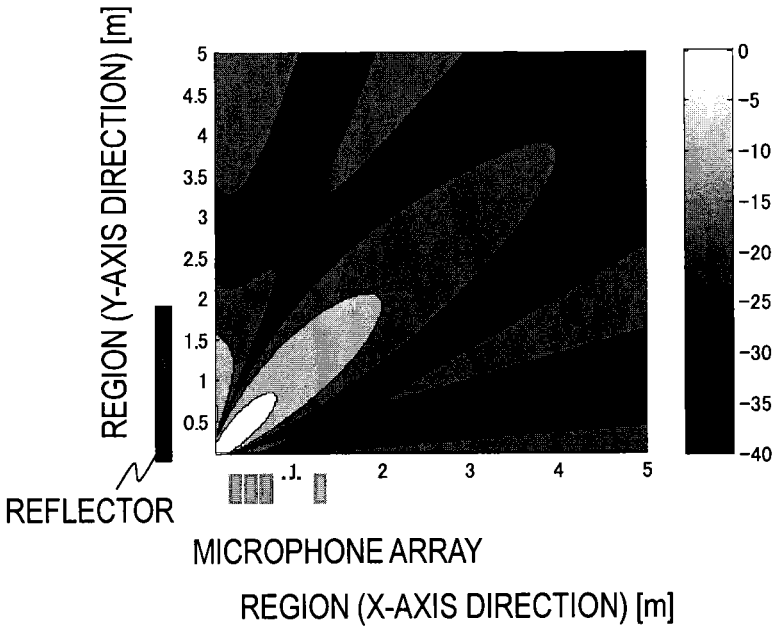
FIG. 23B illustrates the directivity (in a two dimensional domain) of a minimum variance beam former with reflector.

Results of experimental examples on the sound spot enhancement according to the first embodiment of the sound spot enhancement technique of the present invention (the minimum variance distortionless response (MVDR) method under a single constraint condition) will be described. The experiments were conducted in the same environment illustrated in FIG. 9. As illustrated in FIG. 9, 24 microphones are arranged linearly and a reflector 300 is placed so that the direction along which the microphones in the linear microphone array is normal to the reflector 300. While there is no restraint on the shape of the reflector 300, a semi-thick rigid planar reflector having a size of 1.0 m×1.0 m was used. The distance between adjacent microphones was 4 cm and the reflectance $\alpha$ of the reflector 300 was 0.8. A sound source was located in a direction $\theta_s$ of 45 degrees at a distance $D_h$ of 1.13 m. FIG. 23A shows the directivity (in a two-dimensional domain) of a minimum variance beam former obtained as a result of the experiment where a reflector 300 was not placed; FIG. 23B shows the directivity (in a two-dimensional domain) of a minimum variance beam former obtained as a result of the experiment where a reflector 300 was placed. Sound pressure [in dB] is represented as shades, where whiter regions represents higher pressures of picked-up sounds. Ideally, if only the position in a direction of 45 degrees at a distance of 1.13 m is white and the other regions are closer to black, it can be said that spot enhancement of desired sounds has been achieved. Comparison between the experimental results in FIGS. 23A and 23B shows that spot enhancement of the desired sounds cannot sufficiently be achieved without a reflector 300 and spot enhancement of the desired sounds can be achieved with a reflector 300.

<Example Applications>

Figuratively speaking, the sound spot enhancement technique is equivalent to generation of a clear image from an unsharp, blurred image and is useful for obtaining detailed information about an acoustic field. The following is description of examples of services where the sound spot enhancement technique of the present invention is useful.

A first example is creation of contents that are combination of audio and video. The use of an embodiment of the sound spot enhancement technique of the present invention allows the target sound from a great distance to be clearly enhanced even in a noisy environment with noise sounds (sounds other than target sounds). Therefore, for example sounds in a particular area corresponding to a zoomed-in moving picture of a dribbling soccer player that was shot from outside the field can be added to the moving picture.

A second example is an application to a video conference (or an audio teleconference). When a conference is held in a small room, the voice of a human speaker can be enhanced to a certain degree with several microphones according to a conventional technique. However, in a large conference room (for example, a large space where there are human speakers at a distance of 5 m or more from microphones), it is difficult to clearly enhance the voice of a human speaker at a distance with the conventional techniques by the conventional method and a microphone needs to be placed in front of each human speaker. In contrast, the use of an embodiment of the sound spot enhancement technique of the present invention is capable of clearly enhancing sounds from a particular area farther from a particular area and therefore enables construction of a video conference system that is usable in a large conference room without having to place a microphone in front of each human speaker. Furthermore, since sounds from a particular area can be enhanced, restrictions on the locations of conference participants with respect to the locations of microphones can be relaxed.

<Configurations of Implementation of Sound Enhancement Technique>

Exemplary configurations of implementations of the sound enhancement techniques of the present invention will be described below with reference to FIGS. 24 to 28. While microphone arrays in the examples are depicted as linear microphone arrays, microphone arrays are not limited to linear microphone array configurations.

In an exemplary configuration of an implementation illustrated in FIGS. 24A, 24B and 24C, M microphones 200-1, . . . , 200-M making up a linear microphone array are fixed to a rectangular flat supporting board 400 and in this state the sound pickup hole of each microphone is positioned in one flat surface (hereinafter referred to as the opening surface) of the supporting board 400 (M=13 in the depicted examples). Note that wiring lines connected to the microphones 200-1, . . . , 200-M are not depicted. A rectangular flat-plate reflector 300 is fixed at an edge of the supporting board 400 in such a manner that the direction in which the microphones 200-1, . . . , 200-M are arranged is normal to the reflector 300. The opening surface of the supporting board 400 is at an angle of 90 degrees to the reflector 300. In the exemplary configuration illustrated in FIGS. 24A, 24B and 24C, preferable properties of the reflector 300 are the same as those of the reflector described earlier. There are no restrictions on properties of the supporting board 400; it is essential only that the supporting board 400 be rigid enough to firmly fix the microphones 200-1, . . . , 200-M.

Figure 25A:
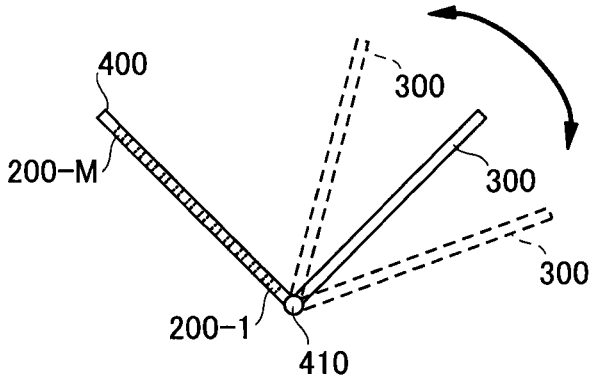
FIG. 25A is a side view illustrating another exemplary configuration of an implementation of the present invention.

In an exemplary configuration illustrated in FIG. 25A, a shaft 410 is fixed to one edge of the supporting board 400 and a reflector 300 is rotatably attached to the shaft 410. In this exemplary configuration, the geometrical placement of the reflector 300 to the microphone array can be changed.

Figure 24A:
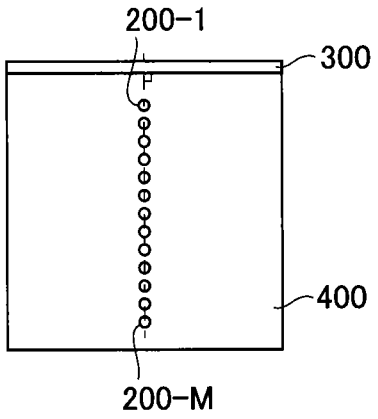
FIG. 24A is a plan view illustrating an exemplary configuration of an implementation of the present invention.
Figure 24B:
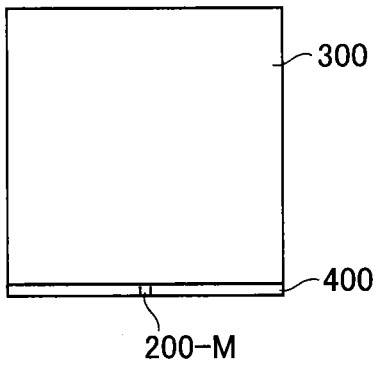
FIG. 24B is a front view illustrating the exemplary configuration of the implementation of the present invention.
Figure 24C:
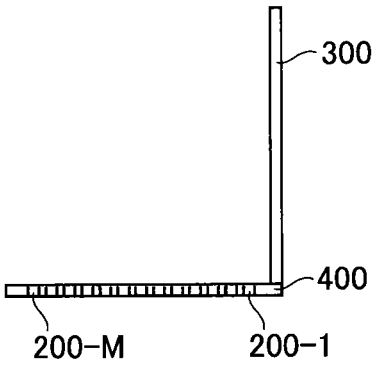
FIG. 24C is a side view illustrating the exemplary configuration of the implementation of the present invention.
Figure 25B:
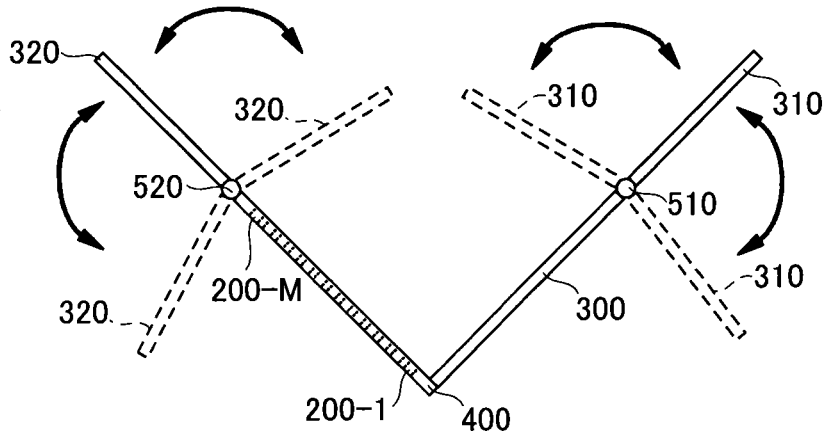
FIG. 25B is a side view illustrating another exemplary configuration of an implementation of the present invention.
Figure 26:
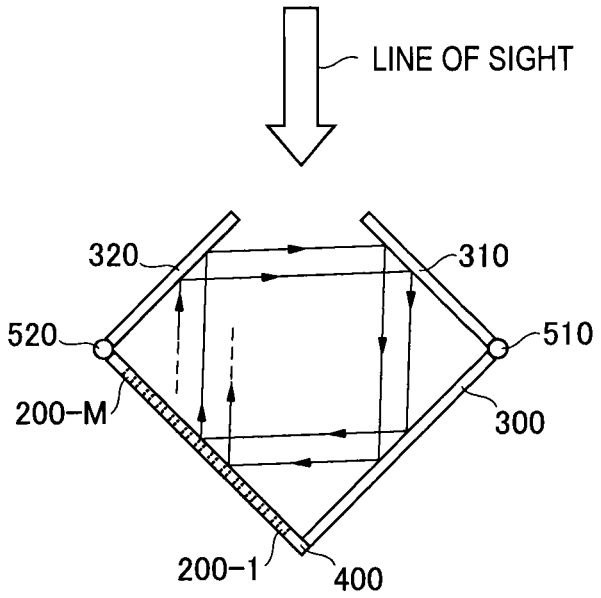
FIG. 26 is a diagram illustrating a shape in use of the exemplary configuration of the implementation illustrated in FIG. 25B.

In an exemplary configuration illustrated in FIG. 25B, two additional reflectors 310 and 320 are added to the configuration illustrated in FIGS. 24A, 24B and 24C. The two additional reflectors 310 and 320 may have the same properties as the reflector 300 or have properties different from the properties of the reflector 300. The reflector 310 may have the same properties as the reflector 320 or have different properties from the properties of the reflector 320. The reflector 300 is hereinafter referred to as the fixed reflector 300. A shaft 510 is fixed at an edge of the fixed reflector 300 (the edge opposite the edge of the fixed reflector 300 that is fixed to the supporting board 400) and the reflector 310 is rotatably attached to the shaft 510. A shaft 520 is fixed at an edge of the supporting board 400 (the edge opposite the edge of the supporting board 400 at which the fixed reflector 300 is fixed) and the reflector 320 is rotatably attached to the shaft 520. The reflectors 310 and 320 will be hereinafter referred to as the movable reflectors 310 and 320. When the movable reflector 310 is positioned so that the reflecting surface of the movable reflector 310 is flush with the reflecting surface of the fixed reflector 300 in the configuration illustrated in FIG. 25B, the combination of the fixed reflector 300 and the movable reflector 310 functions as a reflector having a larger reflecting surface than the fixed reflector 300. Furthermore, in the exemplary configuration illustrated in FIG. 25B, when the movable reflectors 310 and 320 are set at appropriate positions, a sound can be repeatedly reflected in a space enclosed by the supporting board 400 and the fixed reflectors 300, the movable reflectors 310 and 320 as depicted in FIG. 26, for example, thereby the number Ξ of reflected sounds can be controlled. Note that the supporting board 400 in the exemplary configuration illustrated in FIG. 25B functions as a reflective object and therefore preferably has the same properties as the reflective object described earlier.

Figure 27A:
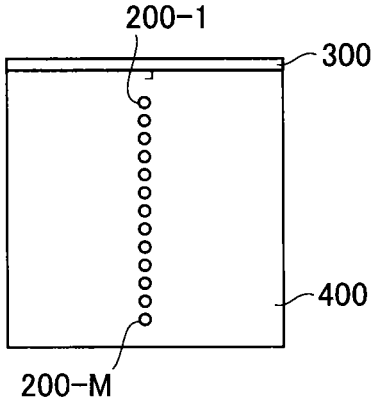
FIG. 27A is a plan view illustrating an exemplary configuration of an implementation of the present invention.
Figure 27B:
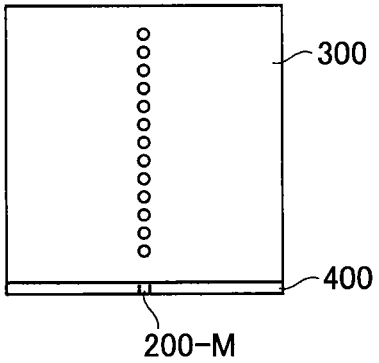
FIG. 27B is a front view illustrating the exemplary configuration of the implementation of the present invention.
Figure 27C:
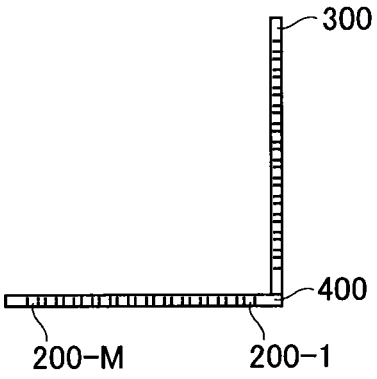
FIG. 27C is a side view illustrating the exemplary configuration of the implementation of the present invention.

An exemplary configuration of an implementation illustrated in FIGS. 27A, 27B and 27C differs from the exemplary configuration illustrated in FIGS. 24A, 24B and 24C in that a microphone array (a linear microphone array in the depicted example) is also provided in the reflector 300. While the direction in which M microphones fixed to the supporting board 400 are arranged and the direction in which M' microphones fixed to the reflector 300 are arranged are on the same plane in the exemplary configuration illustrated in FIGS. 27A, 27B and 27C, the microphones are not limited to this arrangement (M'=13 in the depicted example). For example, the M' microphones may be arranged and fixed to the reflector 300 in the direction orthogonal to the direction in which the M microphones are arranged and fixed to the supporting board 400. In the exemplary configuration illustrated in FIGS. 27A, 27B and 27C, the combination of the microphone array provided in the supporting board 400 and the reflector 300 (the reflector 300 is used as an reflective object without using the microphone array provided in the reflector 300) can be used to implement a sound enhancement technique of the present invention or the combination of the supporting board 400 (the supporting board 400 is used as a reflective object without using the microphone array provided in the supporting board 400) and the microphone array provided in the reflector 300 to implement the sound enhancement technique of the present invention.

Figure 28:
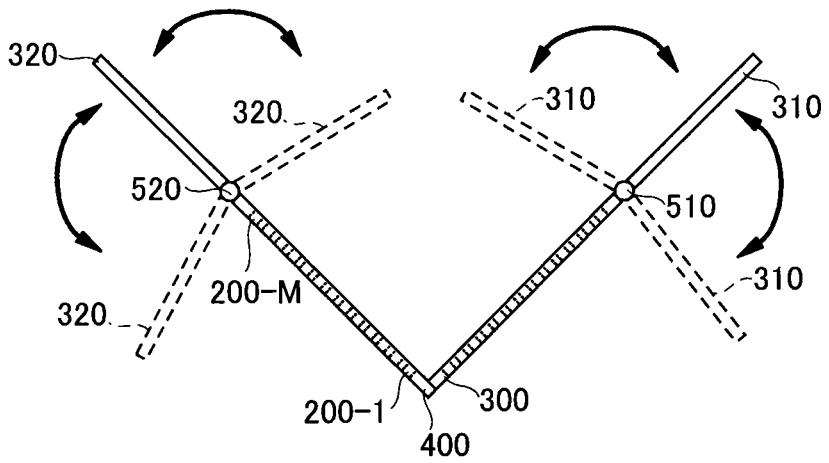
FIG. 28 is a side view illustrating an exemplary configuration of an implementation of the present invention.

In an extended exemplary configuration illustrated in FIGS. 27A, 27B and 27C, two additional reflectors 310 and 320 may be added to the exemplary configuration illustrated in FIGS. 27A, 27B and 27C as in the exemplary configuration illustrated in FIG. 25B (see FIG. 28). Although not depicted, a microphone array may be provided in at least one of the movable reflectors 310 and 320. The sound pickup hole of each of the microphones of the microphone array provided in the movable reflector 310 may be positioned at a surface (the opening surface) of the movable reflector 310 that is opposable to the opening surface of the supporting board 400, for example. The sound pickup hole of each of the microphones of the microphone array provided in the movable reflector 320 may be positioned at a flat surface (the opening surface) that can form the same plane as the opening surface of the supporting board 400, for example. This exemplary configuration can be used in the same way as the exemplary configuration illustrated in FIG. 25B. Furthermore, in this exemplary configuration, when the movable reflector 320 is positioned so that the opening surface of the movable reflector 320 is flush with the opening surface of the supporting board 400, the combination of the supporting board 400 and the movable reflector 320 function as a larger microphone array than the microphone array provided in the supporting board 400. Both of the exemplary configuration illustrated in FIG. 28 and the exemplary configuration in which a microphone array is provided at least one of the mobile reflectors 310 and 320 can be used in the same way as the exemplary configuration illustrated in FIG. 26. In both of the exemplary configuration illustrated in FIG. 28 and the exemplary configuration in which a microphone array is provided in at least one of the movable reflectors 310 and 320, the movable reflectors 310 and 320 can be used as ordinary reflective objects and the microphone array provided in the supporting board 400 and the microphone array provided in the fixed reflector 300 can be used as one combined microphone array. This is equivalent to an exemplary configuration that uses a microphone array made up of (M+M') microphones and two reflective objects.

If a microphone array is provided in the movable reflector 310, the microphone array may be placed in the movable reflector 310 so that the sound pickup hole of each of the microphones of the microphone array provided in the movable reflector 310 is positioned at the flat surface (the opening surface) opposite the flat surface of the movable reflector 310 that is opposable to the opening surface of the supporting board 400. If a microphone array is provided in the movable reflector 320, the microphone array may be placed in the movable reflector 320 so that the sound pickup hole of each of the microphones of the microphone array provided in the movable reflector 320 is positioned at the flat surface (the opening surface) opposite the flat surface of the movable reflector 320 that can form the same plane as the opening surface of the supporting board 400. Of course, a microphone array may be provided in at least one of the movable reflectors 310 and 320 so that both surfaces of the movable reflector 310 and/or 320 are opening surfaces.

[A] If a microphone array is provided in at least one of the movable reflectors 310 and 320 and, in addition, the opening surface of the movable reflector 310 is a flat surface opposable to the opening surface of the supporting board 400 or the opening surface of the movable reflector 320 is a flat surface that can form the same plane as the opening surface of the supporting board 400, positioning the movable reflector 310 and/or the movable reflector 320 in such a manner that the opening surface of the movable reflector 310 and/or movable reflector 320 is invisible from the direction of sight in the form illustrated in FIGS. 24A, 24B and 24C can provide the same effect as increasing the array size through the use of the microphone array provided in the movable reflector 310 and/or movable reflector 320, although the apparent array size as viewed from the direction of sight decreases.

[B] If a microphone array is provided in at least one of the movable reflectors 310 and 320 and, in addition, the opening surface of the movable reflector 310 is a flat surface opposite the surface opposable to the opening surface of the supporting board 400 or the opening surface of the movable reflector 320 is a flat surface opposite the surface that can form the same plane as the opening surface of the supporting board 400, the same effect as increasing the array size can be provided in the form illustrated in FIGS. 24A, 24B and 24C while the apparent array size as viewed from the direction of sight is kept the same.

Providing a microphone array in both surfaces of at least one of the movable reflectors 310 and 320 so that both surfaces of the movable reflector 310 and/or 320 are opening surfaces, can provide the same effects as both of [A] and [B].

<References>

(Reference 1) Simon Haykin, "Adaptive Filter Theory," translated by Hiroshi Suzuki et. al, first edition, Kagaku Gijutsu Shuppann, 2001, pp. 66-73, 248-255

(Reference 2) Nobuyoshi Kikuma, "Adaptive Antenna Technology," First edition, Ohmsha, 2003, pp. 35-90, ISBN4-27403611-1

(Reference 3) Futoshi Asano, "Array signal processing-sound source localization/tracking and separation," edited by the Acoustical Society of Japan, acoustical technology series 16, first edition, Corona Publishing, pp. 88-89, 259-261, ISBN978-4-339-01116-6

(Reference 4) Yutaka Kaneda, "Directivity characteristics of adaptive microphone-array for noise reduction (AMNOR)," The Journal of the Acoustical Society of Japan, Vol. 44, No. 1, 1988, pp. 23-30

<Exemplary Hardware Configuration of Sound Enhancement Apparatus>

A sound enhancement apparatus relating to the embodiments described above includes an input section to which a keyboard and the like can be connected, an output section to which a liquid-crystal display and the like can be connected, a CPU (Central Processing Unit) (which may include a memory such as a cache memory), memories such as a RAM (Random Access Memory) and a ROM (Read Only Memory), an external storage, which is a hard disk, and a bus that interconnects the input section, the output section, the CPU, the RAM, the ROM and the external storage in such a manner that they can exchange data. A device (drive) capable of reading and writing data on a recording medium such as a CD-ROM may be provided in the sound enhancement apparatus as needed. A physical entity that includes these hardware resources may be a general-purpose computer.

Programs for enhancing sounds in a narrow range and data required for processing by the programs are stored in the external storage of the sound enhancement apparatus (the storage is not limited to an external storage; for example the programs may be stored in a read-only storage device such as a ROM.). Data obtained through the processing of the programs is stored on the RAM or the external storage device as appropriate. A storage device that stores data and addresses of its storage locations is hereinafter simply referred to as the "storage".

The storage of the sound enhancement apparatus stores a program for obtaining a filter for each frequency by using a spatial correlation matrix, a program for converting an analog signal to a digital signal, a program for generating frames, a program for transforming a digital signal in each frame to a frequency-domain signal in the frequency domain, a program for applying a filter corresponding to a direction or position that is a target of sound enhancement to a frequency-domain signal at each frequency to obtain an output signal, and a program for transforming the output single to a time-domain signal.

In the sound enhancement apparatus, the programs stored in the storage and data required for the processing of the programs are loaded into the RAM as required and are interpreted and executed or processed by the CPU. As a result, the CPU implements given functions (the frame design section, the AD converter, the frame generator, the frequency-domain transform section, the filter applying section, and the time-domain transform section) to implement sound enhancement.

<Addendum>

The present invention is not limited to the embodiments described above and modifications can be made without departing from the spirit of the present invention. Furthermore, the processes described in the embodiments may be performed not only in time sequence as is written or may be performed in parallel with one another or individually, depending on the throughput of the apparatuses that perform the processes or requirements.

If processing functions of any of the hardware entities (sound enhancement apparatus) described in the embodiments are implemented by a computer, the processing of the functions that the hardware entities should include is described in a programs. The program is executed on the computer to implement the processing functions of the hardware entity on the computer.

The programs describing the processing can be recorded on a computer-readable recording medium. The computer-readable recording medium may be any recording medium such as a magnetic recording device, an optical disc, a magneto-optical recording medium, and a semiconductor memory. Specifically, for example, a hard disk device, a flexible disk, or a magnetic tape may be used as a magnetic recording device, a DVD (Digital Versatile Disc), a DVD-RAM (Random Access Memory), a CD-ROM (Compact Disc Read Only Memory), or a CD-R (Recordable)/RW (Re-Writable) may be used as an optical disk, MO (Magnet-Optical disc) may be used as a magneto-optical recording medium, and an EEP-ROM (Electronically Erasable and Programmable Read Only Memory) may be used as a semiconductor memory.

The program is distributed by selling, transferring, or lending a portable recording medium on which the program is recorded, such as a DVD or a CD-ROM. The program may be stored on a storage device of a server computer and transferred from the server computer to other computers over a network, thereby distributing the program.

A computer that executes the program first stores the program recorded on a portable recording medium or transferred from a server computer into a storage device of the computer. When the computer executes the processes, the computer reads the program stored on the recording medium of the computer and executes the processes according to the read program. In another mode of execution of the program, the computer may read the program directly from a portable recording medium and execute the processes according to the program or may execute the processes according to the program each time the program is transferred from the server computer to the computer. Alternatively, the processes may be executed using a so-called ASP (Application Service Provider) service in which the program is not transferred from a server computer to the computer but process functions are implemented by instructions to execute the program and acquisition of the results of the execution. Note that the program in this mode encompasses information that is provided for processing by an electronic computer and is equivalent to the program (such as data that is not direct commands to a computer but has the nature that defines processing of the computer).

While the hardware entities are configured by causing a computer to execute a predetermined program in the embodiments described above, at least some of the processes may be implemented by hardware.

What is claimed is:

1. A sound enhancement method of obtaining a frequency-domain output signal in which a sound from a desired position determined by a direction and a distance is enhanced by applying, for each frequency, a filter enhancing a sound from the position to frequency-domain signals transformed from M picked-up sounds picked up with M microphones, where M is an integer greater than or equal to two, the method comprising:

a filter design step of using a transmission characteristic $a_{i,g}$ of a sound that comes from each of one or a plurality of positions that are assumed to be sound sources and arrives at each of the microphones to obtain the filter for each frequency for a position that is a target of a sound enhancement, where i denotes a direction and g denotes a distance for identifying each of the positions; and a filter applying step of applying the filter obtained at the filter design step to the frequency-domain signals for each frequency to obtain the output signal;

wherein each of the transmission characteristics $a_{i,g}$ is represented by the sum of a transmission characteristic of a direct sound that comes from the position determined by the direction i and the distance g and directly arrives at the M microphones and a transmission characteristic of one or more reflected sounds, the one or more reflected sounds being produced by reflection of the direct sound off an reflective object and arriving at the M microphones.

2. The sound enhancement method according to claim 1, wherein each of the transmission characteristics $a_{i,g}$ is the sum of a steering vector of the direct sound and each steering vector of the one or more reflected sounds whose decays due to reflection and arrival time differences with respect to the direct sound are corrected.

3. The sound enhancement method according to claim 1, wherein each of transmission characteristics $a_{i,g}$ is obtained by measurement in a real environment.

4. The sound enhancement method according to any one of claims 1 to 3, wherein the filter design step obtains, for each frequency, the filter that minimizes the power of sounds from positions other than the position that is the target of sound enhancement.

5. The sound enhancement method according to any one of claims 1 to 3, wherein the filter design step obtains, for each frequency, the filter that maximizes the signal-to-noise ratio of a sound from the position that is the target of sound enhancement.

6. The sound enhancement method according to any one of claims 1 to 3, wherein the filter design step obtains, for each frequency, the filter that minimizes the power of sounds from positions other than the one or plurality of positions that are assumed to be sound source positions while a filter coefficient for one of the M microphones is fixed at a constant value.

7. The sound enhancement method according to any one of claims 1 to 3, wherein the filter design step obtains, for each frequency, the filter that minimizes the power of sounds from the positions other than the position that is the target of sound enhancement and one or more suppression points on conditions that (1) the filter passes sounds in all frequency bands from the position that is the target of sound enhancement and that (2) the filter suppresses sounds in all frequency bands from the one or more suppression points.

8. The sound enhancement method according to any one of claims 1 to 3, wherein the filter design step normalizes a transmission characteristic $a_{s,h}$ of a sound from the position in a direction i=s at distance g=h that is the target of sound enhancement to obtain the filter for each frequency.

9. The sound enhancement method according to any one of claims 1 to 3, wherein the filter design step uses a spatial correlation matrix represented by the transmission characteristics $a_{i,g}$ corresponding to the positions other than the position that is the target of sound enhancement to obtain the filter for each frequency.

10. The sound enhancement method according to any one of claims 1 to 3, wherein the filter design step obtains, for each frequency, the filter that minimizes the power of sounds from positions other than the position that is the target of sound enhancement on condition that the filter reduces decay of a sound from the position that is the target of sound enhancement to a predetermined amount or less.

11. The sound enhancement method according to any one of claims 1 to 3, wherein the filter design step uses a spatial correlation matrix represented by a frequency-domain signal to obtain the filter for each frequency, the frequency-domain signal being obtained by transforming a signal obtained by observation with a microphone array to a frequency domain.

12. The sound enhancement method according to any one of claims 1 to 3, wherein the filter design step uses a spatial correlation matrix represented by the transmission characteristics $a_{i,g}$ corresponding to each position included in one or a plurality of positions that are assumed to be sound source positions to obtain the filter for each frequency.

13. A sound enhancement apparatus obtaining a frequency-domain output signal in which a sound from a desired position determined by a direction and a distance is enhanced by applying, for each frequency, a filter enhancing a sound from the position to frequency-domain signals transformed from M picked-up sounds picked up with M microphones, where M is an integer greater than or equal to two, the apparatus comprising:

a filter design section using a transmission characteristic $a_{i,g}$ of a sound that comes from each of one or a plurality of positions that are assumed to be sound sources and arrives at each of the microphones to obtain the filter for each frequency for a position that is a target of a sound enhancement, where i denotes a direction and g denotes a distance for identifying each of the positions; and a filter applying section applying the filter obtained by the filter design section to the frequency-domain signals for each frequency to obtain the output signal;

wherein each of the transmission characteristics $a_{i,g}$ is represented by the sum of a transmission characteristic of a direct sound that comes from the position determined by the direction i and the distance g and directly arrives at the M microphones and a transmission characteristic of one or more reflected sounds, the one or more reflected sounds being produced by reflection of the direct sound off an reflective object and arriving at the M microphones.

14. The sound enhancement apparatus according to claim 13, further comprising one or more reflective objects providing each of the reflected sounds to the M microphones.

15. A sound enhancement method of obtaining a frequency-domain output signal in which a sound from a desired direction is enhanced by applying, for each frequency, a filter enhancing a sound from the direction to frequency-domain signals transformed from M picked-up sounds picked up with M microphones, where M is an integer greater than or equal to two, the method comprising:

a filter design step of using a transmission characteristic $a_\phi$ of a sound that comes from each of one or a plurality of directions $\phi$ that are assumed to be directions from which sounds come and arrives at each of the microphones to obtain the filter for each frequency for a direction that is a target of a sound enhancement; and a filter applying step of applying the filter obtained at the filter design step to the frequency-domain signals for each frequency to obtain the output signal;

wherein each of the transmission characteristics $a_\phi$ is represented by the sum of a transmission characteristic of a direct sound that comes from the direction $\phi$ and directly arrives at the M microphones and a transmission characteristic of one or more reflected sounds, the one or more reflected sounds being produced by reflection of the direct sound off an reflective object and arriving at the M microphones.

16. The sound enhancement method according to claim 15, wherein each of the transmission characteristics $a_\phi$ is the sum of a steering vector of the direct sound and each steering vector of the one or more reflected sounds whose decays due to reflection and arrival time differences with respect to the direct sound are corrected.

17. The sound enhancement method according to claim 15, wherein each of the transmission characteristics $a_\phi$ is obtained by measurement in a real environment.

18. The sound enhancement method according to any one of claims 15 to 17, wherein the filter design step obtains, for each frequency, the filter that minimizes the power of sounds from directions other than the direction that is the target of sound enhancement.

19. The sound enhancement method according to any one of claims 15 to 17, wherein the filter design step obtains, for each frequency, the filter that maximizes the signal-to-noise ratio of a sound from the direction that is the target of sound enhancement.

20. The sound enhancement method according to any one of claims 15 to 17, wherein the filter design step obtains, for each frequency, the filter that minimizes the power of sounds from the one or plurality of directions that are assumed to be directions from which sounds come, while a filter coefficient for one of the M microphones is fixed at a constant value.

21. The sound enhancement method according to any one of claims 15 to 17, wherein the filter design step obtains, for each frequency, the filter that minimizes the power of sounds from the directions other than the direction that is the target of sound enhancement and one or more null directions on conditions that (1) the filter passes sounds in all frequency bands from the direction that is the target of sound enhancement and that (2) the filter suppresses sounds in all frequency bands from the one or more null directions.

22. The sound enhancement method according to any one of claims 15 to 17, wherein the filter design step normalizes a transmission characteristic $a_s$ of a sound from the position in the direction $\phi$=s that is the target of sound enhancement to obtain the filter for each frequency.

23. The sound enhancement method according to any one of claims 15 to 17, wherein the filter design step uses a spatial correlation matrix represented by the transmission characteristics $a_\phi$ corresponding to directions other than the directions that is the target of sound enhancement to obtain the filter for each frequency.

24. The sound enhancement method according to any one of claims 15 to 17, wherein the filter design step obtains, for each frequency, the filter that minimizes the power of sounds from directions other than the direction that is the target of sound enhancement on condition that the filter reduces decay of a sound from the direction that is the target of sound enhancement to a predetermined amount or less.

25. The sound enhancement method according to any one of claims 15 to 17, wherein the filter design step uses a spatial correlation matrix represented by a frequency-domain signal to obtain the filter for each frequency, the frequency-domain signal being obtained by transforming a signal obtained by observation with a microphone array to a frequency domain.

26. A sound enhancement apparatus obtaining a frequency-domain output signal in which a sound from a desired direction is enhanced by applying, for each frequency, a filter enhancing a sound from the direction to frequency-domain signals transformed from M picked-up sounds picked up with M microphones, where M is an integer greater than or equal to two, the apparatus comprising:

a filter design section using a transmission characteristic $a_\phi$ of a sound that comes from each of one or a plurality of directions .phi. that are assumed to be directions from which sounds come and arrives at each of the microphones to obtain the filter for each frequency for a direction that is a target of a sound enhancement; and a filter applying section applying the filter obtained by the filter design section to the frequency-domain signals for each frequency to obtain the output signal;

wherein each of the transmission characteristics $a_\phi$ is represented by the sum of a transmission characteristic of a direct sound that comes from the direction $\phi$ and directly arrives at the M microphones and a transmission characteristic of one or more reflected sounds, the one or more reflected sounds being produced by reflection of the direct sound off an reflective object and arriving at the M microphones.

27. The sound enhancement apparatus according to claim 26, further comprising one or more reflective objects providing each of the reflected sounds to the M microphones.

28. A non-transitory computer-readable recording medium having recorded thereon a computer program for causing a computer to execute the steps of the sound enhancement method according to claim 1 or 15.

* * * * *

UNITED STATES PATENT AND TRADEMARK OFFICE

CERTIFICATE OF CORRECTION

PATENT NO. : 9,191,738 B2
APPLICATION NO. : 13/996302
DATED : November 17, 2015
INVENTOR(S) : Kenta Niwa et al.

It is certified that error appears in the above-identified patent and that said Letters Patent is hereby corrected as shown below:

On the title page, Item (73), the Assignee's information is incorrect. Item (73) should read:

--(73) Assignee: NIPPON TELEGRAPH AND TELEPHONE CORPORATION,
Tokyo, (JP)--

Signed and Sealed this
Twenty-eighth Day of June, 2016

Michelle K. Lee

Michelle K. Lee
*Director of the United States Patent and Trademark Office*